US012448725B2

(12) United States Patent
Yoon et al.

(10) Patent No.: US 12,448,725 B2
(45) Date of Patent: Oct. 21, 2025

(54) LAUNDRY TREATING APPARATUS

(71) Applicant: LG Electronics Inc., Seoul (KR)

(72) Inventors: Juhan Yoon, Seoul (KR); Donghyun Jin, Seoul (KR); Sanghun Kim, Seoul (KR); Manseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 912 days.

(21) Appl. No.: 17/679,812

(22) Filed: Feb. 24, 2022

(65) Prior Publication Data

US 2022/0267944 A1 Aug. 25, 2022

(30) Foreign Application Priority Data

Feb. 24, 2021 (KR) ..... 10-2021-0024984
Feb. 24, 2021 (KR) ..... 10-2021-0024985

(51) Int. Cl.
*D06F 58/24* (2006.01)
*D06F 58/08* (2006.01)

(52) U.S. Cl.
CPC ..... *D06F 58/24* (2013.01); *D06F 58/08* (2013.01)

(58) Field of Classification Search
None
See application file for complete search history.

(56) References Cited

U.S. PATENT DOCUMENTS

2007/0033970 A1* 2/2007 Lee ..... D06F 25/00 68/19.2
2009/0320313 A1* 12/2009 Bae ..... D06F 58/203 34/132
2011/0277334 A1* 11/2011 Lee ..... D06F 58/206 34/73
2016/0083894 A1* 3/2016 Bison ..... D06F 58/22 34/85
2016/0115643 A1* 4/2016 Bison ..... D06F 58/24 34/75

(Continued)

FOREIGN PATENT DOCUMENTS

CN 101886320 11/2010
CN 105531415 4/2016

(Continued)

OTHER PUBLICATIONS

Office Action in Taiwanese Appln. No. 111106870, mailed on Nov. 29, 2022, 21 pages (with English translation).

(Continued)

*Primary Examiner* — David J Laux
(74) *Attorney, Agent, or Firm* — Fish & Richardson P.C.

(57) ABSTRACT

A laundry treating apparatus includes a cabinet including a rear plate that defines a rear surface of the cabinet, a drum rotatably disposed in the cabinet and configured to accommodate laundry, an air supply disposed in the cabinet and configured to dehumidify air discharged from the drum and to supply the dehumidified air to the drum, and a drain pipe configured to guide water that is condensed from the air discharged from the air by the air supply. The drain pipe passes through a first portion of the rear plate from an interior of the cabinet to an exterior of the cabinet, extends along a rear side of the rear plate at the exterior of the cabinet, and is inserted through a second portion of the rear plate from the exterior of the cabinet to the interior of the cabinet.

20 Claims, 20 Drawing Sheets

(56) References Cited

U.S. PATENT DOCUMENTS

| | | | | |
|---|---|---|---|---|
| 2017/0314181 | A1* | 11/2017 | Wakizaka | D06F 58/30 |
| 2018/0148885 | A1* | 5/2018 | Kitayama | D06F 58/20 |
| 2018/0163340 | A1* | 6/2018 | Lee | D06F 58/20 |

FOREIGN PATENT DOCUMENTS

| | | |
|---|---|---|
| CN | 106319908 | 1/2017 |
| CN | 111850931 | 10/2020 |
| CN | 111850934 | 10/2020 |
| CN | 112074638 | 12/2020 |
| CN | 112088231 | 12/2020 |
| DE | 102009047155 | 6/2011 |
| DE | 102014209732 | 11/2015 |
| EP | 3299513 | 3/2018 |
| KR | 20130047565 | 5/2013 |
| KR | 10-2013-0094584 | 8/2013 |
| KR | 10-2013-0114780 | 10/2013 |
| KR | 10-2015-0069820 | 6/2015 |
| KR | 20190128487 | 11/2019 |
| KR | 20200065931 | 6/2020 |
| KR | 20200075667 | 6/2020 |
| KR | 20200112166 | 10/2020 |
| WO | WO2008099549 | 8/2008 |
| WO | WO2014187506 | 11/2014 |
| WO | WO2016045173 | 3/2016 |

OTHER PUBLICATIONS

Extended European Search Report in European Appln. No. 22158396.6, dated Jul. 19, 2022, 9 pages.

International Search Report and Written Opinion in International Appln. No. PCT/KR2022/002653, dated Jun. 17, 2022, 8 pages.

Office Action in Chinese Appln. No. 202210172165.1, mailed on Mar. 24, 2023, 20 pages (with English translation).

Notice of Allowance in Chinese Appln. No. 202210172165.1, mailed on May 8, 2024, 7 pages (with English translation).

Office Action in Australian Appln. No. 2022225883, mailed on Sep. 19, 2024, 5 pages.

* cited by examiner

LAUNDRY TREATING APPARATUS

CROSS-REFERENCE TO RELATED APPLICATIONS

This application claims the benefit of Korean Patent Application Nos. 10-2021-0024984, filed on Feb. 24, 2021, and 10-2021-0024985, filed on Feb. 24, 2021, the disclosures of which are hereby incorporated by reference as if fully set forth herein.

TECHNICAL FIELD

The present disclosure relates to a laundry treating apparatus, and more particularly, to a laundry treating apparatus including a driver directly connected to a drum and configured to rotate the drum.

BACKGROUND

A laundry treating apparatus may include a washing machine for washing laundry (an object to be washed or an object to be dried), a dryer for drying the laundry, and an apparatus capable of performing both the washing and the drying of the laundry.

For example, the dryer may include various components such as a drum, a heat exchanger, a hot air flow channel, and the like that may be disposed inside a cabinet of the dryer.

In some cases, the dryer may include a drain pipe disposed inside the cabinet. In some cases, where the entire drain pipe is placed inside the cabinet, a design of the dryer may become complicated to avoid interference with other components such as the drum, the heat exchanger, the hot air flow channel, and the like, and sizes of other components may become relatively small.

In some cases, the dryer may include a return pipe that may help avoid overflow of water from a water storage tank. In some cases, where the entire return pipe is placed inside the cabinet, the design may become complicated to avoid interference with other components such as the drum, the heat exchanger, the hot air flow channel, and the like, and the sizes of other components may become relatively small.

Accordingly, arrangement of the drain pipe and the return pipe may help utilize the inner space of the cabinet more efficiently.

SUMMARY

The present disclosure describes a laundry treating apparatus including a drain pipe in which a portion of the drain pipe is exposed to an outside of a rear plate.

The present disclosure describes a laundry treating apparatus including a return pipe in which a portion of the return pipe is exposed to the outside of a rear plate.

The present disclosure describes a laundry treating apparatus including a rear cover configured to cover a drain pipe exposed to the outside.

The present disclosure describes a laundry treating apparatus including a rear cover configured to cover a return pipe exposed to the outside.

The present disclosure describes a laundry treating apparatus including a water storage and an external discharge pipe for discharging condensed water of a water collector to the outside.

The present disclosure describes a laundry treating apparatus that can help prevent injury of a user resulted from contact with a duct through a rear cover that covers the duct.

The present disclosure describes a laundry treating apparatus that can help prevent damage to a driver resulted from an external impact through a rear cover configured to cover the driver.

The present disclosure describes a laundry treating apparatus including a rear cover that insulates a duct.

The present disclosure describes a laundry treating apparatus including a rear cover that radiates heat of a driver.

The present disclosure describes a laundry treating apparatus having a drain pipe for guiding condensed water condensed in a heat exchanger to a water collector that can be disposed outside, and having a rear cover configured to cover the drain pipe.

According to one aspect of the subject matter described in this application, a laundry treating apparatus includes a cabinet including a rear plate that defines a rear surface of the cabinet, a drum rotatably disposed in the cabinet and configured to accommodate laundry, an air supply disposed in the cabinet and configured to dehumidify air discharged from the drum and to supply the dehumidified air to the drum, and a drain pipe configured to guide water that is condensed from the air discharged from the air by the air supply. The drain pipe passes through a first portion of the rear plate from an interior of the cabinet to an exterior of the cabinet, extends along a rear side of the rear plate at the exterior of the cabinet, and is inserted through a second portion of the rear plate from the exterior of the cabinet to the interior of the cabinet.

Implementations according to this aspect can include one or more of the following features. For example, the laundry treating apparatus can include a duct defined at the rear plate and configured to guide the dehumidified air into the drum, a water vapor remover disposed in the air supply and configured to condense the water from the air discharged from the drum, a water collector disposed in the cabinet and configured to receive the condensed water from the water vapor remover, and a water storage disposed in the cabinet and configured to receive the condensed water from the water collector. The drain pipe can connect the water collector to the water storage and be configured to guide the condensed water from the water collector to the water storage.

In some implementations, the laundry treating apparatus can include a return pipe that extends from the water storage in the interior of the cabinet to the exterior of the cabinet through the rear plate, where the return pipe is configured to guide the condensed water from the water storage to the water collector. The return pipe can extend along the rear side of the rear plate at the exterior of the cabinet, be inserted from the exterior of the cabinet to the interior of the cabinet through the rear plate, and be connected to the water collector in the interior of the cabinet. In some examples, the drain pipe can include a water collecting drain pipe that extends from the water collector to the exterior of the cabinet through the rear plate, a drain exposed pipe that extends from the water collecting drain pipe along the duct of the rear plate, and a reservoir drain pipe that extends from the drain exposed pipe and passes through the rear plate, where the reservoir drain pipe is connected to the water storage. The return pipe can include a reservoir return pipe that extends from the water storage to the exterior of the cabinet through the rear plate, a return exposed pipe that extends from the reservoir return pipe along the duct of the rear plate, and a water collecting return pipe that extends from the return exposed pipe and passes through the rear plate, where the water collecting return pipe is connected to the water collector.

In some implementations, the water collector can be disposed below the drum, and the water storage can be disposed above the drum. In some examples, the reservoir drain pipe is connected to a top of the water storage. In some examples, the laundry treating apparatus can further include a drainage including the drain pipe and a drain pump, where the drain pump is connected to the water collecting drain pipe and configured to flow the condensed water through the drain pipe from the water collector to the water storage.

In some implementations, the laundry treating apparatus can include a washer disposed in the air supply and configured to wash the water vapor remover with the condensed water that has passed through the drain pump, a washing flow channel that connects the washer and the water collecting drain pipe to each other, and a flow channel switching valve disposed at the water collecting drain pipe and connected to the washing flow channel, where the flow channel switching valve is configured to selectively guide, to the washer or the water storage, the condensed water that has passed through the drain pump.

In some implementations, the rear plate can define a water collecting connection hole and a water storage connection hole that are spaced apart from each other, where the water collecting drain pipe and the water collecting return pipe pass through the water collecting connection hole, and the reservoir drain pipe and the reservoir return pipe pass through the water storage connection hole. In some examples, the laundry treating apparatus can include a rear cover that is coupled to the rear plate from the rear side of the rear plate and covers the duct of the rear plate. In some examples, the rear plate can include a rear cover coupling portion that protrudes rearward from the rear side of the rear plate and is coupled to the rear cover, where the rear cover coupling portion defines the duct of the rear plate, the water collecting connection hole, and the water storage connection hole.

In some implementations, the water collecting connection hole and the water storage connection hole can be defined at positions that are located outward relative to the duct with respect to a rotation axis of the drum, where the rear cover extends outward relative to the duct and covers the water collecting connection hole and the water storage connection hole, and the rear plate has a region located outside the rear cover coupling portion and exposed outside the rear cover. In some examples, the rear cover can cover the drain exposed pipe and the return exposed pipe to thereby hide the drain exposed pipe and the return exposed pipe from the exterior of the cabinet.

In some implementations, the laundry treating apparatus can include an external discharge pipe disposed at the drain exposed pipe and configured to discharge the water from the drain exposed pipe to an outside of the drain exposed pipe, where the rear cover defines a cover-through-portion at a position corresponding to the external discharge pipe. The cover-through-portion can be configured to expose the external discharge pipe to the exterior of the cabinet. In some examples, the rear cover can include a rear cover door configured to open and close the cover-through-portion.

In some implementations, the rear cover can include a duct cover that covers the duct of the rear plate, and a coupling portion cover that extends from the duct cover and covers a portion of the rear cover coupling portion located outward relative to the duct with respect to a rotation axis of the drum, where an inner circumferential surface of the coupling portion cover faces an outer circumferential surface of the rear cover coupling portion. In some examples, the rear cover coupling portion can have a lower portion that is located at a lower portion of the rear plate, that is opened downward, and that accommodates a portion of the air supply, where a portion of the coupling portion cover is opened downward and coupled to the lower portion of the rear cover coupling portion.

In some implementations, the laundry treating apparatus can include a driver coupled to the rear plate from the rear side of the rear plate and configured to rotate the drum, where the duct protrudes rearward from the rear side of the rear plate and surrounds the driver, and at least a portion of the rear cover has a shape corresponding to the duct and covers the duct and the driver. The rear cover can expose at least a portion of the rear plate to the exterior of the cabinet. In some examples, the rear cover can further include a driver rib that protrudes from an inner surface of the rear cover toward the rear plate and surrounds the driver, where the driver is located inward relative to the duct.

In some implementations, the driver rib can define a heat dissipation space that is exposed to the exterior of the cabinet through an open rear surface of the rear cover, and the driver rib can be spaced apart from the driver and has a front portion that is in contact with the rear plate at a position inward relative to the duct. In some examples, the driver rib can define a rib slit at an inner circumferential portion of the driver rib facing the driver, where the rib slit passes through the inner circumferential portion of the driver rib and extends along a protruding direction of the driver rib. The rib slit can fluidly communicate an interior of the duct with the heat dissipation space.

In some implementations, the rear cover can further include a cover accommodating portion that is surrounded by the inner circumferential portion of the driver rib and that defines a heat dissipation hole that fluidly communicates the interior of the duct with an exterior of the duct. In some examples, the driver can include a drive rotation shaft connected to the drum through the rear plate, where the cover accommodating portion further defines a cover recessed portion that is recessed rearward from a front surface of the rear cover facing the driver and accommodates at least a portion of the drive rotation shaft.

DETAILED DESCRIPTION

Hereinafter, one or more implementations of the present disclosure will be described in detail with reference to the accompanying drawings.

Figure 1:
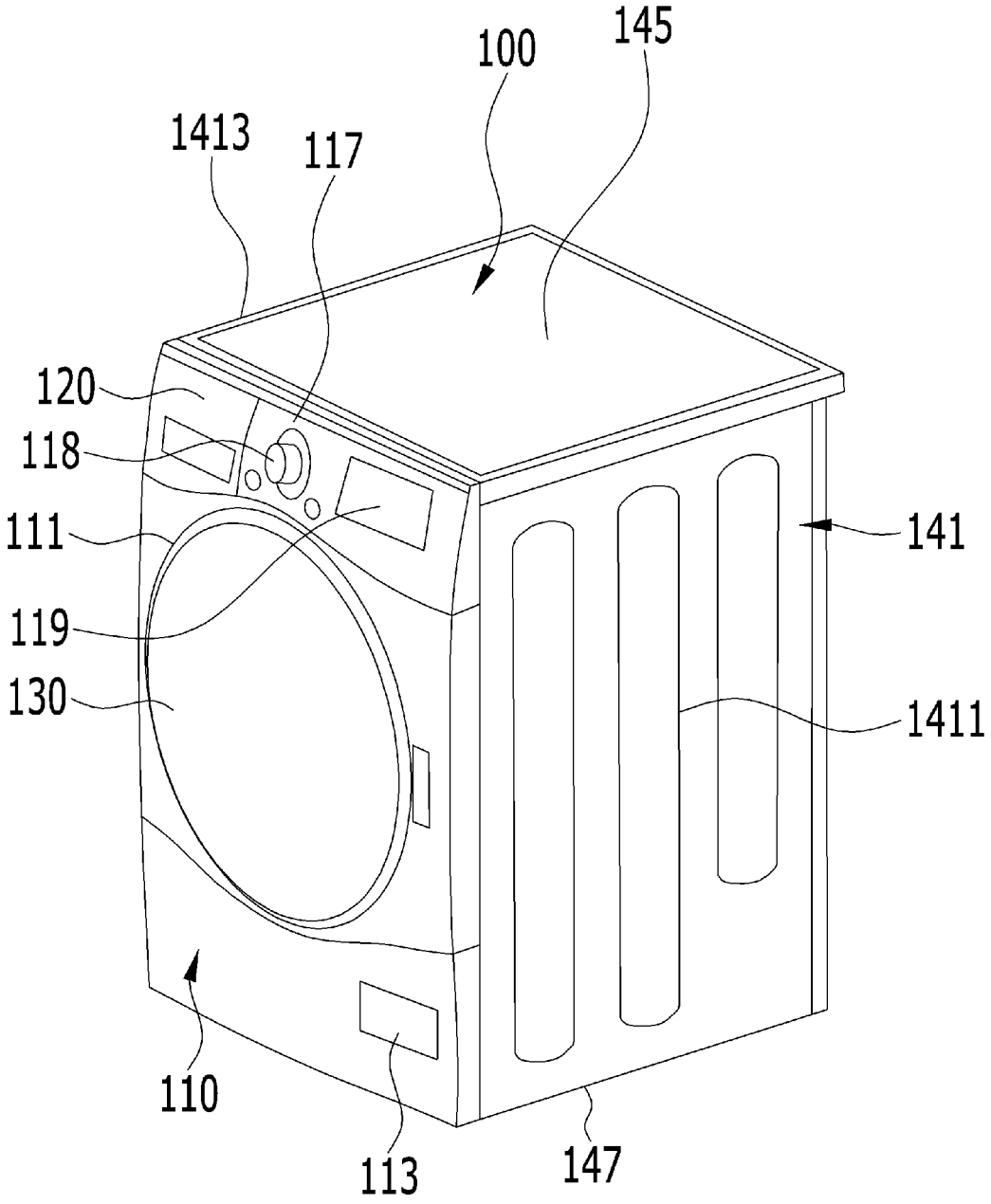
FIG. 1 is a perspective view showing an example of a laundry treating apparatus.
Figure 2:
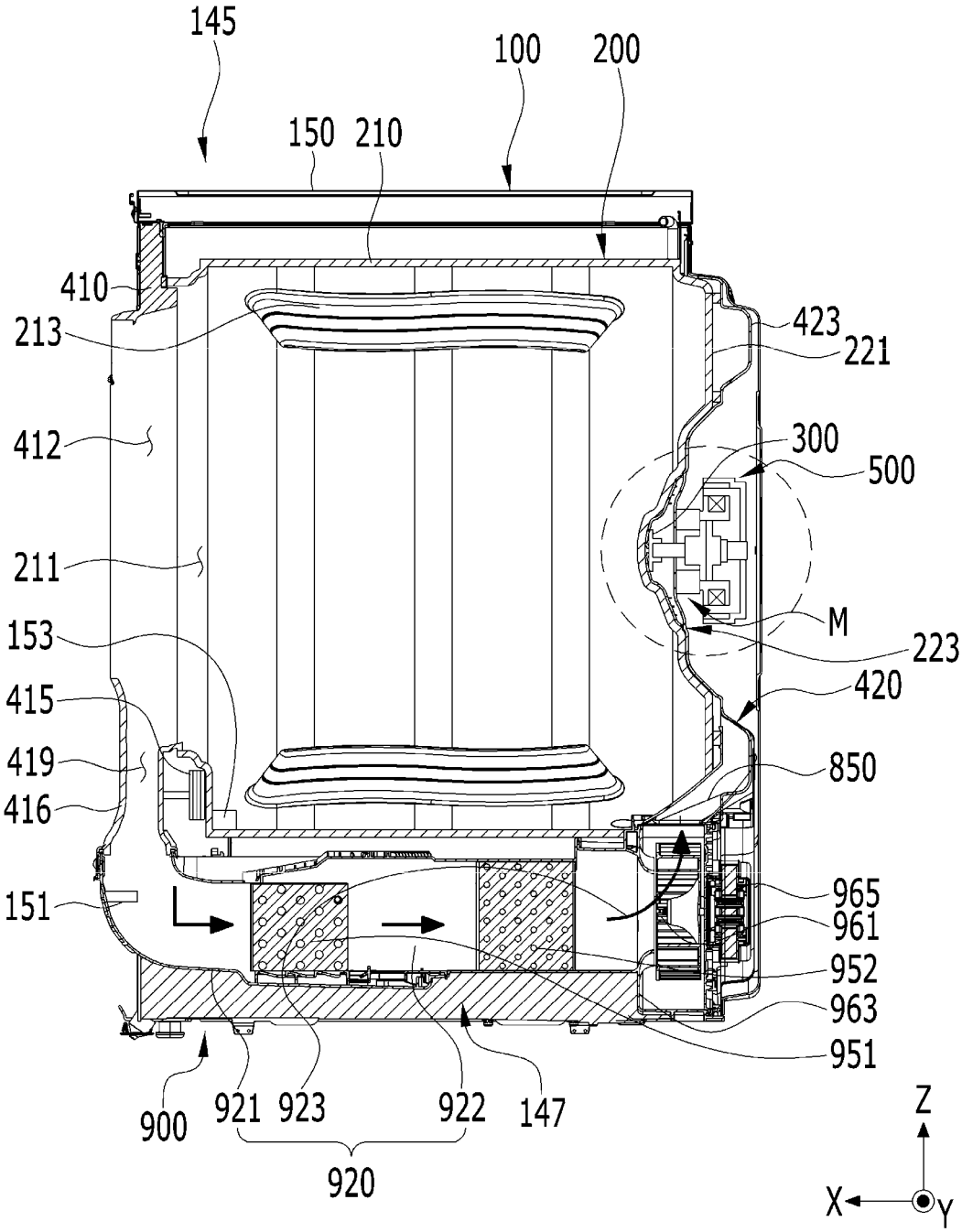
FIG. 2 is a view showing an internal cross-section of the laundry treating apparatus shown in FIG. 1.

FIG. 1 is a perspective view showing an example of a laundry treating apparatus, and FIG. 2 is a view showing an internal cross-section of the laundry treating apparatus shown in FIG. 1.

Referring to FIGS. 1 and 2, the laundry treating apparatus can include a cabinet 100 that defines an appearance of the laundry treating apparatus.

In some implementations, the cabinet 100 can have a front plate 410 that defines a front surface thereof, side plates 141 respectively that define both side surfaces thereof, a top plate 145 that defines a top surface thereof, and a bottom plate 147 that defines a bottom surface thereof.

In some examples, the front plate 410, the side plates 141, the top plate 145, and the bottom plate 147 can be connected to each other to define a space therein. In some examples, the cabinet 100 can further include a rear plate 420 forming a rear surface thereof, and the rear plate 420 can be coupled to the cabinet 100 from the rear to shield the interior of the cabinet 100.

That is, the rear plate 420 can form the rear surface of the cabinet 100. However, referring to FIG. 15, a rear cover 430, which will be described later, can be coupled to the rear plate 420 from the rear, and the rear cover 430 can form the rear surface of the cabinet 100. In addition, the rear cover 430 and the rear plate 420 together can form the rear surface of the cabinet.

As the interior of the cabinet 100 can be shielded from the outside because of the rear plate 420, a drum 200, a hot air supply 900, a water collector 170, and the like can be disposed inside the cabinet 100, and the components disposed inside the cabinet 100 can be prevented from being exposed to the outside.

The front plate 410 and the rear plate 420 will be described later in detail.

In some examples, the cabinet 100 can further include a front panel 110 coupled to the front plate 410 from the front. The front panel 110 can be coupled to a front surface of the front plate 410 to prevent the front plate 410 and components coupled to the front plate 410 from being exposed to the outside.

That is, the front panel 110 can define the front surface of the cabinet 100 together with the front plate 410. In some examples, the front panel 110 can be formed integrally with or formed separately from the front plate 410. In FIGS. 1 and 2, the front panel 110 and the front plate 410 are illustrated as being separately formed, but the present disclosure should not be construed as being limited thereto.

The front panel 110 can include an inlet 111 defined to be in communication with the drum 200 to be described later and a door 130 pivotably coupled to the cabinet to open and close the inlet 111.

A control panel 117 can be installed on the front panel 110. The control panel 117 can include an input device 118 for receiving a control command from a user, and a display 119 for outputting information such as a control command or the like selectable by the user. The control command can include a drying course or a drying option capable of performing a series of drying operations. The control panel 117 can include a main controller for controlling a command for performing the drying course or the drying option.

The input device 118 can include a power supply requesting device that requests power supply of the laundry treating apparatus, a course input device that allows the user to select a desired course among a number of courses, and an execution requesting device that requests start of the course selected by the user.

The display 119 can include at least one of a display panel capable of outputting text and figures, and a speaker capable of outputting a voice signal and sound.

In some examples, the laundry treating apparatus can include a water storage 7 configured to separately store moisture generated in a process of drying laundry. The water storage 7 can include a water storage tank that is configured to be withdrawn from one side of the front panel 110 to the outside. The water storage tank can be configured to collect condensed water received from a drain pump to be described later.

The user can remove the condensed water by withdrawing the water storage tank from the cabinet 100 and then re-install the water storage tank in the cabinet 100. Accordingly, the laundry treating apparatus can be disposed at any place where a sewer or the like is not installed.

In some examples, the water storage 7 can be disposed above the door 130. Accordingly, when the user withdraws the water storage tank from the front panel 110, the user is able to bend a waist relatively less.

The laundry treating apparatus can further include a filter member capable of removing foreign substances from a circulation flow channel. The front panel 110 can include a filter mounting hole 113 defined such that the filter member is withdrawn or inserted.

Figure 3:
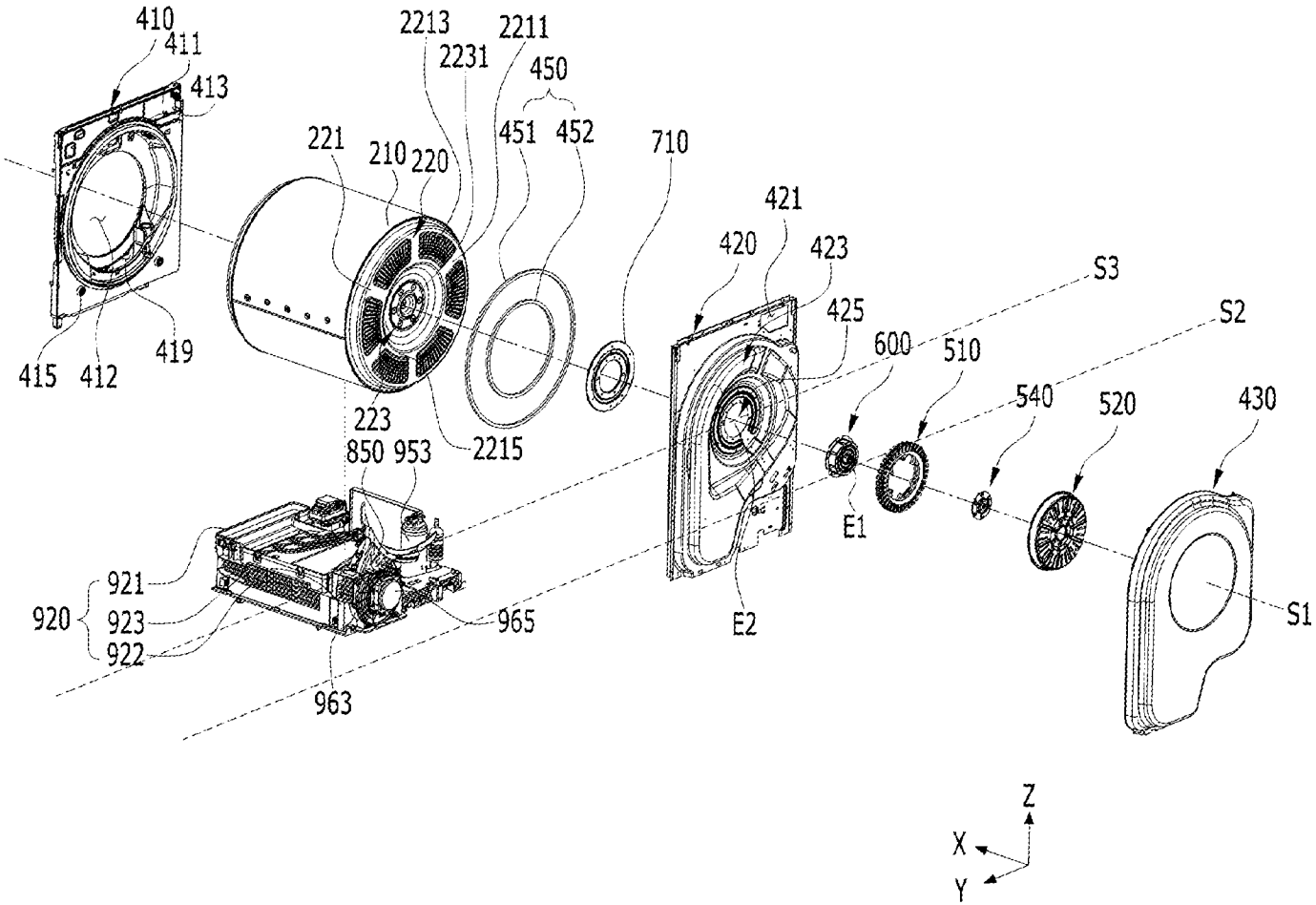
FIG. 3 is an exploded perspective view of the laundry treating apparatus.

FIG. 3 is an exploded perspective view.

Referring to FIGS. 2 and 3, the laundry treating apparatus can include the drum 200 accommodated inside the cabinet 100 and accommodating the laundry therein, a driver M that rotates the drum 200, and the hot air supply 900 configured to supply hot air to the drum 200.

The drum 200 can be formed in a cylindrical shape to accommodate the laundry therein. In some cases, where water is not provided into the drum 200 and water condensed inside the drum 200 is not discharged to the outside, a through-hole defined along a circumference of the drum 200 can be omitted.

The driver M can be in direct connection with the drum 200 to rotate the drum 200. For example, the driver M can be formed in a direct drive unit (DD) type. Accordingly, the driver M can control a rotation direction of the drum 200 or a rotation speed of the drum 200 by directly rotating the drum 200 by omitting a component such as a belt, a pulley, and the like.

In the case of the DD type washing machine, the driver M can be coupled and fixed to a tub that accommodates the drum 200 therein, and the drum 200 can be coupled to the driver M and supported by the tub. However, because the laundry treating apparatus is configured to intensively perform a drying operation, the tub fixed to the cabinet 100 to accommodate the drum 200 is omitted.

Accordingly, the laundry treating apparatus can further include a support 400 configured to fix or support the drum 200 or the driver M inside the cabinet 100. The support 400 can include the front plate 410 and the rear plate 420 described above.

The front plate 410 can be disposed in front of the drum 200, and the rear plate 420 can be disposed at the rear of the drum 200.

The front plate 410 and the rear plate 420 can be formed in a plate shape and respectively disposed to face a front surface and a rear surface of the drum 200. A distance between the front plate 410 and the rear plate 420 can be the same as a length of the drum 200 or can be set to be greater than the length of the drum 200.

The drum 200 can include a drum inlet 211 having an open front surface. The drum inlet 211 can be in communication with the inlet 111 defined in the front panel 110 through the front plate 410. The driver M can be installed on the rear plate 420 and connected to the rear surface of the drum 200 as the drum inlet 211 is defined in the front surface of the drum 200.

The rear plate 420 can be configured such that the driver M is mounted and supported thereon in a region facing the rear surface of the drum 200. Accordingly, the driver M can rotate the drum 200 in a state in which a position thereof is stably fixed through the rear plate 420.

At least one of the front plate 410 and the rear plate 420 can rotatably support the drum 200. At least one of the front plate 410 and the rear plate 420 can rotatably accommodate a front end or a rear end of the drum 200 therein.

For example, the front surface of the drum 200 can be accommodated and rotatably supported in the front plate 410, and the rear surface of the drum 200 can be indirectly supported by the rear plate 420 by being spaced apart from the rear plate 420 and connected to the driver M mounted on the rear plate 420.

Accordingly, a region in which the drum 200 is in contact with or rubbed against the support 400 can be minimized and noise or vibration can be prevented from occurring.

In some examples, the drum 200 can be rotatably supported by both the front plate 410 and the rear plate 420.

In some examples, the laundry treating apparatus can include the circulation flow channel along which, based on the drum 200, air inside the drum 200 is discharged through the front surface of the drum 200, and the discharged air passes through an exterior of the drum 200 and again flows into the rear surface of the drum 200.

The hot air supply 900 can be disposed outside the drum such that the air discharged from the interior of the drum 200 flows therein, and can define a portion of the circulation flow channel. For example, the hot air supply 900 can be placed on the bottom plate 147 of the cabinet 100.

The hot air supply 900 can include an evaporator 951 for cooling the air discharged from the interior of the drum 200 and condensing water vapor contained in the air, and a condenser 952 for heating the air that has passed through the evaporator 951. The hot air supply 900 can be configured to supply the air that has passed through the condenser 952 back into the drum 200.

The air discharged from the interior of the drum 200 can change in a temperature and a water vapor content by the hot air supply 900, and can dry the laundry accommodated in the drum 200 through continuous circulation by flowing along the circulation flow channel.

The air located inside the drum 200 can be hot air circulating along the circulation flow channel. That is, the air whose properties are changed by the hot air supply 900 and circulating along the circulation flow channel can be referred to as the hot air. The air and the hot air can be used as the same meaning hereinafter for convenience of description. A specific configuration of the hot air supply 900 will be described later.

The drum 200 can be disposed above the hot air supply 900, so that the drum inlet 211 of the drum 200 can be disposed at a relatively high position inside the cabinet 100. The user can easily withdraw the laundry located inside the drum 200.

As described above, the hot air supply 900 can have a plurality of heat exchangers installed therein for cooling or heating the hot air flowing therein, and can have a washer 940 installed therein for removing foreign substances attached to the heat exchanger using the condensed water in which the water vapor contained in the hot air is condensed.

Referring back to FIGS. 2 and 3, the drum 200 of the laundry treating apparatus can be rotated by being directly coupled to the driver M rather than being rotated by being indirectly coupled to a belt or the like. Therefore, unlike the drum of the conventional dryer formed in a cylindrical shape with open front and rear surfaces, the drum 200 of the laundry treating apparatus can have the shielded rear surface and be directly coupled to the driver M.

Specifically, the drum 200 can include a drum body 210 formed in a cylindrical shape to accommodate the laundry therein, and a drum rear surface 220 coupled to the drum body 210 from the rear to form the rear surface of the drum 200. That is, the drum rear surface 220 can refer to the rear surface of the drum 200.

The drum rear surface 220 can be configured to shield the drum body 210 from the rear and can be coupled to a drum rotating shaft 650 of the driver M. That is, the drum rear surface 220 can be configured so as to be connected to the driver M to receive power from the drum rotating shaft 650 to rotate the drum body 210. As a result, the drum inlet 211 into which the laundry is put can be defined in front of the drum body 210 and the drum body 210 can be shielded by the drum rear surface 220 from the rear.

FIG. 2 schematically shows a bushing. Referring back to FIG. 2, a bushing 300 can be coupled to or formed integrally with the drum rear surface 220. The drum rotating shaft 650 of the driver M can be coupled to the bushing 300, and the drum rear surface 220 can be coupled to the drum rotating shaft 650 through the bushing 300. The drum rotating shaft 650 can be coupled to the drum rear surface 220 from the rear through the bushing 300, or can penetrate the drum rear surface 220 through the bushing 300 such that a front end thereof is positioned inside the drum 200.

When the drum rotating shaft 650 penetrates the drum 200, the front end of the drum rotating shaft 650 can be coupled to fixing fastening means for fixing the drum rotating shaft 650 in an axial direction. In addition, a cap for preventing contact between the drum rotating shaft 650 and the laundry, and suppressing heat transfer can be installed inside the drum 200.

As a result, the drum 200 of the laundry treating apparatus may not be rotated by the belt or the like, but can be rotated as the drum rear surface 220 is directly coupled to the driver M.

Therefore, even when the driver M changes the rotation direction or a rotation acceleration is large, the drum 200 of the laundry treating apparatus can be rotated by reflecting the same immediately.

In some examples, the front plate 410 can include an inlet communication hole 412 penetrating the front plate 410 to accommodate a front portion of the drum body 210 or the drum inlet 211 therein. A gasket 413 for accommodating the drum body 210 can be disposed on an outer circumferential surface of the inlet communication hole 412.

The gasket 413 can rotatably support the drum inlet 211 of the drum body 210 and can be able to be in contact with an outer circumferential surface of the drum inlet 211. The gasket 413 can prevent the hot air inside the drum 200 from leaking between the drum body 210 and the front plate 410.

The gasket 413 can be made of a plastic resin or an elastic material, and a separate sealing member can be additionally coupled to an inner circumferential surface of the gasket 413 to prevent the laundry or the hot air from escaping the drum inlet 211 of the drum body 210 to the front plate 410.

In some examples, a duct communication hole 419 in communication with the drum body 210 such that the hot air injected into the drum body 210 can be discharged can be defined in the inner circumferential surface of the gasket 413 or the inlet communication hole 412. A front flow channel connecting the duct communication hole 419 and the hot air supply 900 to each other can be installed in the front plate 410.

Accordingly, the duct communication hole 419 can guide the hot air discharged from the drum body 210 to be supplied to the hot air supply 900.

The filter member that blocks foreign substances, lint, or the like discharged from the drum 200 from being put to the hot air supply 900 as described above can be installed in the front flow channel.

A front wheel 415 configured to be able to be in contact with an outer circumferential surface of the drum body 210 to rotatably support the drum 200 can be installed on the front plate 410. The front wheel 415 can be configured to support an outer circumferential surface of an inlet of the drum body 210, and can include a plurality of front wheels spaced apart from each other along the outer circumferential surface of the inlet communication hole 412. The front wheel 415 can rotate together when the drum 200 rotates while supporting a lower portion of the drum body 210.

The front plate 410 can include a front tank support hole 414, and the water storage tank of the water storage 7 can be inserted into and supported by the front tank support hole 414. The front tank support hole 414 can be defined in a region corresponding to a portion of the front panel 110 where the water storage 7 is disposed, and can be defined through the front plate 410.

The rear plate 420 can include a rear tank support hole 421 defined at a position corresponding to the front tank support hole 414. The water storage tank can be supported by being inserted into the front tank support hole 411 and the rear tank support hole 421 together. The rear tank support hole 421 can be defined through the rear plate 420.

Referring back to FIG. 2, as described above, the hot air supply 900 can define a portion of the circulation flow channel that circulates the hot air to the drum 200. That is, the hot air supply 900 can include a hot air flow channel 920 through which the hot air discharged from the drum 200 can circulate outside the drum 200.

The hot air flow channel 920 can be formed in a shape of a duct disposed outside the drum 200. The hot air flow channel 920 can include a supply duct 921 in communication with the duct communication hole 419 to be supplied with the hot air of the drum 200, a flow duct 922 through which the hot air supplied from the supply duct 921 flows, and a discharge duct 923 through which the hot air that has passed through the flow duct 922 is discharged.

The supply duct 921 can be formed to be in communication with the duct communication hole 419 of the front plate 410 to be in communication with the front flow channel installed inside the front plate 410. The flow duct 922 can extend from a distal end of the supply duct 921 rearwardly of the drum 200. The discharge duct 923 can be disposed at a distal end of the flow duct 922.

In some examples, the hot air supply 900 can include a heat pump 950 that can cool the hot air to remove the water vapor contained in the hot air and re-heat the hot air from which the water vapor has been removed.

The heat pump 950 can include the evaporator 951 that is installed inside the flow duct 922 to cool the hot air to condense the water vapor contained in the hot air, and the condenser 952 that is disposed downstream of the evaporator 951 or disposed to be spaced apart from the evaporator 951 toward the discharge duct 923 and re-heats the hot air.

The heat pump 950 can further include an expansion valve that cools a refrigerant that has passed through the condenser 952 and guides the cooled refrigerant back to the evaporator 951, and a compressor 953 that pressurizes and heats the refrigerant that has passed through the evaporator 951 and supplies the pressurized and heated refrigerant to the condenser 952. The compressor 953 can be disposed outside the flow duct 922. That is, the plurality of heat exchangers described above installed inside the hot air supply 900 can refer to the evaporator 951 and the condenser 952.

In some examples, the hot air supply 900 can further include a blower 960 capable of providing power to circulate the hot air to the drum 200.

The blower 960 can be connected to the hot air flow channel 920. That is, the blower 960 can be connected to the discharge duct 923 from the rear, and can receive the hot air from the discharge duct 923, accelerate the hot air, and guide the hot air to the rear of the drum 200.

The blower 960 can include a blower fan 961 that accelerates the hot air in contact with the hot air, and a blower fan housing 963 connected to the discharge duct 923 and having the blower fan 961 disposed therein.

One side of the blower fan housing 963 can be opened and connected to the discharge duct 923, and the other side thereof can be opened to guide the hot air to the rear of the drum 200. For example, as shown in FIG. 2, the blower fan housing 963 can have an open front surface to be connected to the discharge duct 923, and can have an open top surface to guide the hot air to the rear of the drum 200.

In addition, the blower 960 can further include a blower fan driver 965 coupled to the blower fan housing 963. The blower fan driver 965 can be coupled to the blower fan housing 963 from the rear and connected to the blower fan 961 to provide power to rotate the blower fan 961.

Figure 4:
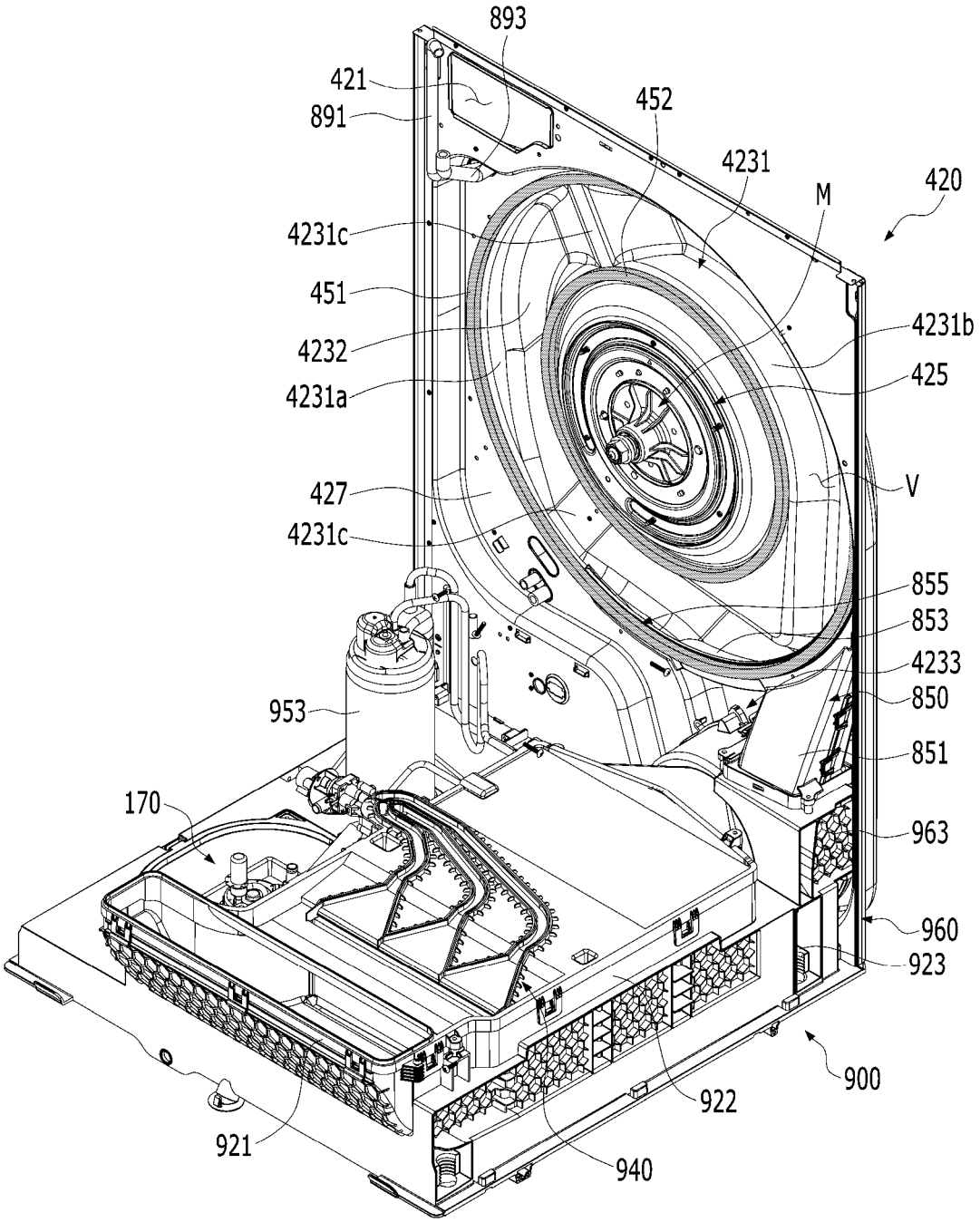
FIG. 4 is a view showing an example of a hot air supply and a rear plate.

In some examples, FIG. 4 is a view showing a bottom plate and a rear plate.

Referring to FIG. 4, a space efficiency of the bottom plate 147 of the cabinet 100 can be increased as the driver M is disposed on the rear plate 420.

Specifically, the bottom plate 147 of the cabinet 100 can have the hot air supply 900 and other components. Other components can include the water collector 170 and the driver M. Other components may not be limited to the water collector 170 and the driver M, and can include any component that can be disposed on the bottom plate 147.

As described above, the hot air supply 900 can include the hot air flow channel 920, the evaporator 951 and the condenser 952 disposed inside the hot air flow channel 920, the compressor 953 disposed outside the hot air flow channel 920, and the blower 960 connected to the hot air flow channel 920.

On the bottom plate 147 of the cabinet 100, the hot air flow channel 920 in which the hot air flows and the blower 960 can be integrally disposed, or the hot air flow channel 920 and the blower 960 can be spaced apart from each other, so that the water collector 170 and the driver M can be disposed.

The space utilization efficiency of the bottom plate 147 of the cabinet 100 can be increased as the driver M is disposed on the rear plate 420 compared to the case in which the driver M is disposed on the bottom plate 147 of the cabinet 100.

That is, the bottom plate 147 of the cabinet 100 can increase a size of the existing component and make an arrangement of existing components to be efficient by utilizing the position where the driver M is disposed compared to the case in which the driver M is disposed on the bottom plate 147 of the cabinet 100.

For example, the water collector 170 can be disposed at the position where the driver M is disposed or extended to the position where the driver M is disposed compared to the case in which the driver M is disposed on the bottom plate 147 of the cabinet 100. That is, the water collector 170 can be larger than in the case in which the driver M is disposed on the bottom plate 147 of the cabinet 100, thereby storing relatively more condensed water.

In some examples, referring to FIGS. 2 and 4, the water collector 170 can be disposed in parallel with the evaporator 951 along a lateral direction. In addition, the compressor 953 can be disposed in parallel with the condenser 952 in the lateral direction.

Specifically, the hot air flow channel 920 can extend from the front plate 410 toward the rear plate 420, and can be disposed close to one of the side plates 141 of the cabinet 100.

For example, FIG. 4 shows that the hot air flow channel 920 is disposed close to a first side plate 1411. However, the present disclosure may not be limited thereto, and the hot air flow channel 920 can be disposed close to a second side plate 1413. For convenience of description, the hot air flow channel 920 will be described as being disposed close to the first side plate 1411.

The water collector 170 and the compressor 953 can be disposed outside the hot air flow channel 920, and can be disposed close to the second side plate 1413 as the hot air flow channel 920 extends in a front and rear direction and is disposed close to the first side plate 1411.

The evaporator 951 and the condenser 952 can be disposed spaced apart from each other inside the hot air flow channel 920, and the water collector 170 can be disposed in parallel with the evaporator 951 to minimize a distance at which the condensed water is introduced from the evaporator 951. In addition, the compressor 953 can be disposed in parallel with the condenser 952 to minimize a distance at which the compressed refrigerant is supplied to the condenser 952.

FIG. 4 shows that, as the hot air is discharged from the front of the drum 200, the evaporator 951 is disposed forwardly of the condenser 952, and the water collector 170 is disposed forwardly of the compressor 953. However, the present disclosure may not be limited thereto, and an arrangement of the evaporator 951 and the condenser 952 can be changed depending on the direction in which the hot air is discharged from the drum 200, and an arrangement of the water collector 170 and the compressor 9530 can also be changed responding thereto.

In some examples, referring back to FIG. 4, the rear plate 420 can include a duct 423.

The duct 423 can receive the hot air from the hot air supply 900 and guide the hot air into the drum 200.

The duct 423 can be recessed rearwards from one surface of the rear plate 420. As described above, the rear plate 420 can be located at the rear of the drum 200. The duct 423 can be recessed from one surface of the rear plate 420 to be away from the drum 200, and one surface of the rear plate 420 can be a front surface of the rear plate 420.

The duct 423 can be recessed rearwards from the front surface of the rear plate 420. That is, the duct 423 can have a flow space V through which the hot air can flow therein, and can have an open front surface.

From another point of view, the duct 423 can protrude rearwards from a rear surface of the rear plate 420, a front surface of the rearwardly protruding portion can be opened, and the flow space V can be defined as much as the portion protruding rearwards. In the flow space V, the hot air introduced from the hot air supply 900 can flow, and the hot air can be guided into the drum 200 from the rear of the drum 200.

Specifically, as the hot air is continuously supplied from the hot air supply 900 to the flow space V, the hot air can be diffused throughout the flow space V. As the hot air diffused throughout the flow space V flows into the drum 200 through the open front surface of the duct 423, an area in which the hot air is introduced can be maximized. Accordingly, the duct 423 can allow the hot air to be efficiently guided into the drum 200 through the flow space V.

In addition, in the duct 423, at least a portion of a fan duct 850 for connecting the hot air supply 900 and the duct 423 to each other can be disposed. The fan duct 850 can provide the hot air of the hot air supply 900 to the duct 423 by communicating the hot air supply 900 and the duct 423 to each other. A portion of the fan duct 850 can be inserted into the flow space V, and the fan duct 850 can be in contact with the duct 423 to receive a supporting force from the duct 423. The fan duct 850 will be described later in detail.

Further, a portion of the hot air supply 900 can be disposed in the duct 423. The portion of the hot air supply 900 can be a rear end of the hot air supply 900 as the duct 423 is defined in the rear plate 420, and specifically can be a portion of the blower 960 described above. The portion of the blower 960 can be inserted into the flow space V, and can be in contact with the duct 423 to receive the supporting force from the duct 423.

Figure 5C:
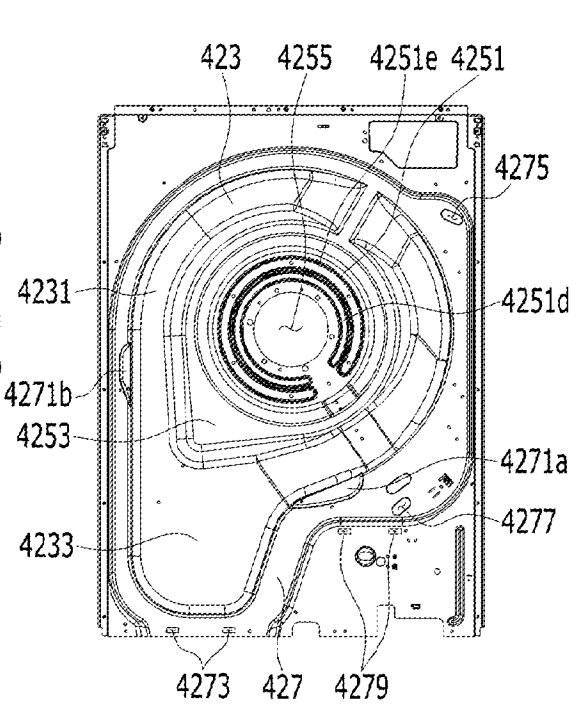
FIGS. 5A to 5C are views showing an example of a rear plate and a fan duct.
Figure 5B:
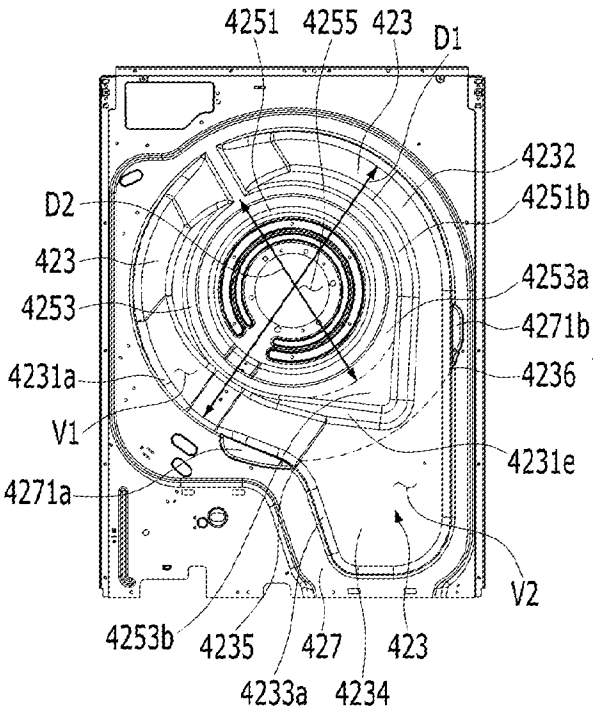
Figure 5A:
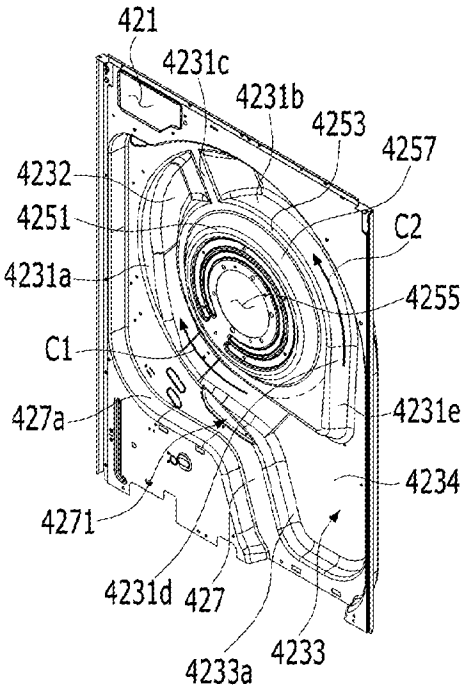

In some examples, FIGS. 5A to 5C are views showing an example of a rear plate. Specifically, FIG. 5A is a perspective view of the rear plate, FIG. 5B is a front view of the rear plate, and FIG. 5C is a rear view of the rear plate.

Referring to FIG. 5A, the duct 423 can include a flow portion 4231.

The flow portion 4231 can guide the hot air introduced from the hot air supply 900 into the drum 200 through the drum rear surface 220 of the drum 200.

The flow portion 4231 can be recessed rearwards from one surface of the rear plate 420 facing the drum rear surface 220. That is, the flow portion 4231 can have a first flow space V1 defined therein through which the hot air can flow, and can have an open front surface. One surface of the rear plate 420 can be the front surface of the rear plate 420, and the aforementioned flow space V can include the first flow space V1.

In the flow portion 4231, the hot air introduced from the fan duct 850 flows in the first flow space V1, and the hot air flowing in the first flow space V1 can be guided into the drum 200 through the drum rear surface 220.

The flow portion 4231 can be formed in an annular shape. The above-mentioned annular shape can be understood that an extended shape forms a closed curve. Accordingly, the annular shape can be defined as a closed cross-section surrounded by the closed curve.

Specifically, the flow portion 4231 can include a flow outer circumferential portion 4231*a* for surrounding the first flow space V1 in which the hot air flows from the outside. That is, the flow outer circumferential portion 4231*a* can correspond to an outer circumferential surface of the flow portion 4231 in the state in which the flow portion 4231 protrudes rearwards.

The flow portion 4231 can include a flow inner circumferential portion 4231*b* surrounding the first flow space V1 in which the hot air flows from the inside. That is, the flow outer circumferential portion 4231*a* can correspond to an inner circumferential surface of the flow portion 4231 in the state in which the flow portion 4231 protrudes rearwards.

In addition, the flow portion 4231 can include a flow recessed surface 4232 connecting the flow outer circumferential portion 4231*a* and the flow inner circumferential portion 4231*b* to each other. The flow recessed surface 4232 can correspond to one surface facing the drum rear surface 220.

The flow outer circumferential portion 4231*a* can be a portion extending rearwards from the front surface of the rear plate 420. Based on a radial direction of the flow portion 4231, the flow inner circumferential portion 4231*b* can be located inwardly of the flow outer circumferential portion 4231*a*, and can be a portion extending rearwards from the front surface of the rear plate 420. The flow recessed surface 4232 can be curved or extend parallel to the front surface of the rear plate 420, and can connect the flow outer circumferential portion 4231*a* and the flow inner circumferential portion 4231*b* to each other.

FIG. 5C shows the rear plate in FIGS. 5A and 5B viewed from the rear. Referring to FIG. 5C, the rear plate will be described as viewed from the rear.

The flow outer circumferential portion 4231*a* can be a portion protruding rearwards from the rear surface of the rear plate 420. The flow inner circumferential portion 4231*b* can be located inwardly of the flow outer circumferential portion 4231*a*, and can be a portion protruding rearwards from the rear surface of the rear plate 420. The flow recessed surface 4232 can be the portion connecting the flow outer circumferential portion 4231*a* and the flow inner circumferential portion 4231*b* to each other.

In some examples, with reference to FIGS. 5A to 5C, the flow outer circumferential portion 4231*a* and the flow inner circumferential portion 4231*b* can be configured such that boundary portions thereof with the front surface of the rear plate 420 is rounded. In addition, the flow outer circumferential portion 4231*a* and the flow inner circumferential portion 4231*b* can extend rearwards in parallel with each other, or can extend rearwards such that a distance therebetween decreases rearwardly. In FIGS. 5A to 5C, the flow outer circumferential portion 4231*a* and the flow inner circumferential portion 4231*b* are shown to be closer to each other rearwardly, but the present disclosure is not limited thereto. Furthermore, the flow recessed surface 4232 can be configured such that portions thereof connected to the flow outer circumferential portion 4231*a* and the flow inner circumferential portion 4231*b* are rounded.

When viewed from the front with reference to FIG. 5B, the flow outer circumferential portion 4231*a* and the flow inner circumferential portion 4231*b* can be formed in a generally circular shape. For example, when a diameter of the flow outer circumferential portion 4231*a* is D1 and a diameter of the flow inner circumferential portion 4231*b* is D2, D1 can be greater than D2. The flow recessed surface 4232 can be an annular surface having an outer diameter of D1 and an inner diameter of D2. An overall shape of the flow portion 4231 can be a donut shape.

Referring to FIG. 3 together, the driver M can be coupled to the rear surface of the rear plate 420 at a location inwardly of the flow inner circumferential portion 4231*b*. That is, the flow inner circumferential portion 4231*b* can be configured to surround the driver M to protect the driver M from external impact.

Figure 6A:
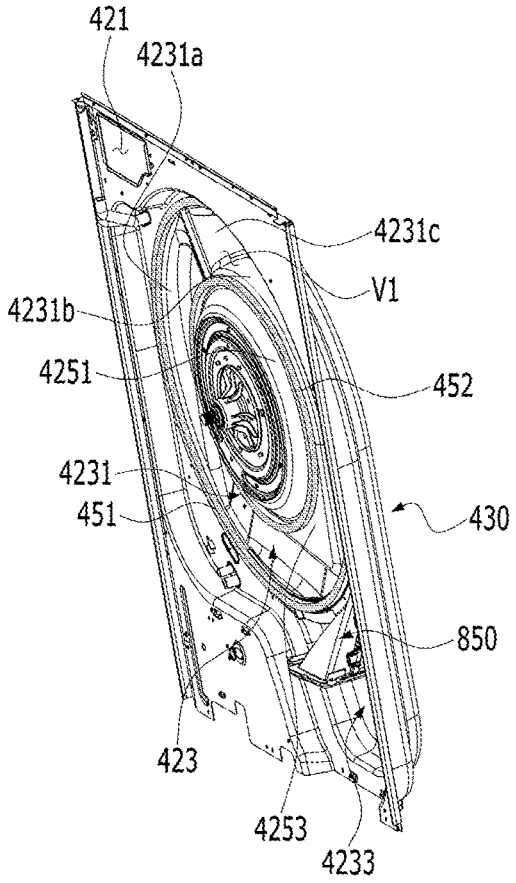
FIGS. 6A and 6B are views showing an example of a rear plate.
Figure 6B:
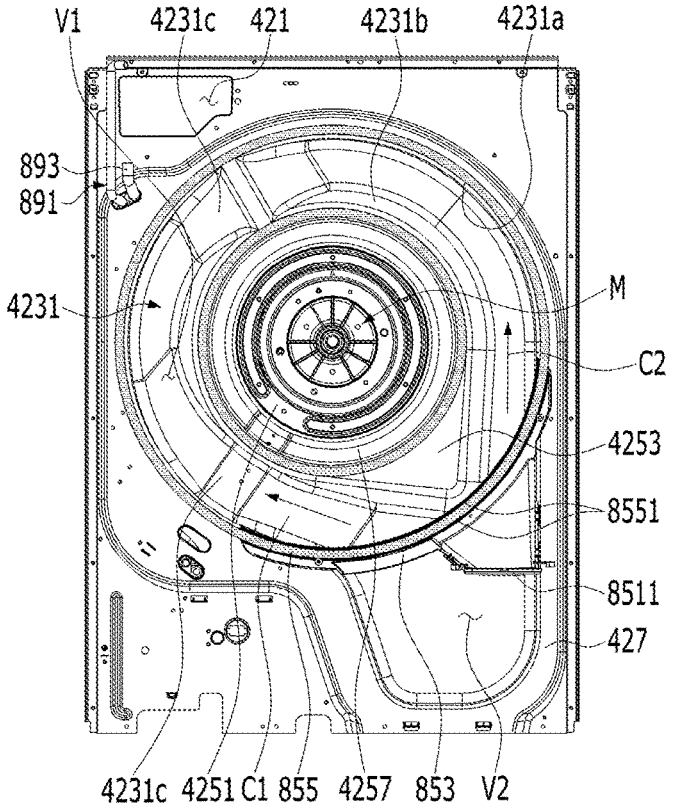

In some examples, FIGS. 6A and 6B are views showing an example of a rear plate and a fan duct. Specifically, FIG. 6A is a perspective view of the rear plate to which the fan duct is coupled, and FIG. 6B is a front view of the rear plate to which the fan duct is coupled.

Referring to FIGS. 5A, 5B and FIGS. 6A and 6B, the duct 423 can further include an inlet 4233 in which the fan duct 850 can be disposed.

The inlet 4233 can extend in a shape protruding from the flow portion 4231. The inlet 4233 can extend from the flow portion 4231 in a radial direction of the flow portion 4231. The inlet 4233 can extend downwards from the flow portion 4231. The inlet 4233 can extend from the flow portion 4231 toward the fan duct 850 and can be in communication with the flow portion 4231.

The fan duct 850 can be disposed in the inlet 4233, and the inlet 4233 can receive the hot air from the fan duct 850 and guide the hot air to the flow portion 4231. In addition, the inlet 4233 can provide only an installation space for the fan duct 850 such that the flow portion 4231 can directly receive the hot air from the fan duct 850 without via the inlet 4233. FIGS. 6A and 6B show that the fan duct 850 is disposed in the inlet 4233 and directly supplies the hot air to the flow portion 4231, but the present disclosure is not construed as being limited thereto.

For example, as described above, the hot air supply 900 can be located below the drum 200, the flow portion 4231 can face the drum rear surface 220, and the fan duct 850 can guide the hot air from the hot air supply 900 to the flow portion 4231.

Accordingly, at least a portion of the fan duct 850 can be located below the flow portion 4231, and the inlet 4233 can extend downwards from the flow portion 4231 to provide the installation space for the fan duct 850. For example, the inlet 4233 can extend downwards from one side in the lateral direction of the flow portion 4231.

Specifically, the inlet 4233 can be recessed rearwards from one surface of the rear plate 420 facing the fan duct 850. That is, the inlet 4233 can be recessed to be away from the fan duct 850 from one surface of the rear plate 420 facing the fan duct 850. One surface of the rear plate 420 can be the front surface of the rear plate 420.

The inlet 4233 can have a second flow space V2 defined therein, and can have an open front surface. That is, the second flow space V2 can be the same as the installation space for the fan duct 850 described above, and can be in communication with the first flow space V1 to define the aforementioned flow space V together.

At least a portion of the fan duct 850 can be coupled by being inserted into the second flow space V2 of the inlet 4233. That is, the fan duct 850 can be supported by an inlet circumferential portion 4233*a* to be described later, and can be coupled to an inlet recessed surface 4234 to be described later to receive supporting and coupling forces. The inlet circumferential portion 4233*a* and the inlet recessed surface 4234 will be described in detail later.

In some examples, in the inlet 4233, the fan duct 850 and the hot air supply 900 can be disposed together.

That is, the inlet 4233 can extend from the flow portion 4231 to have the fan duct 850 inserted thereinto, and can have a shape of further extending from the fan duct 850 toward the hot air supply 900.

Accordingly, the inlet 4233 can provide an installation space for the hot air supply 900 as well as the installation space for the fan duct 850 disposed between the hot air supply 900 and the flow portion 4231.

As described above, the hot air supply 900 can be disposed on the bottom plate 147 of the cabinet 100, and can be disposed close to the first side plate 1411. The inlet 4233 can extend downwards from the flow portion 4231, and can extend to be closer to the first side plate 1411 in a direction toward the bottom plate 147. That is, the inlet 4233 can extend from the flow portion 4231 toward the first side plate 1411.

Specifically, in the inlet 4233, one surface of the rear plate 420 facing the fan duct 850 and the hot air supply 900 can be recessed rearwards. That is, the inlet 4233 can be recessed away from the fan duct 850 and the hot air supply 900 from one surface of the rear plate 420 facing the fan duct 850 and the hot air supply 900. One surface of the rear plate 420 can be the front surface of the rear plate 420.

In other words, the second flow space V2 of the inlet 4233 described above can be additionally extended from the fan duct 850 to define the space in which the hot air supply 900 is disposed.

As the inlet 4233 is defined in the rear plate 420, a rear end of the hot air supply 900 can be disposed in the inlet 4233, and the rear end of the hot air supply 900 can be the blower 960 described above. As the blower 960 is disposed in the second flow space V2, the limited internal space of the cabinet 100 can be efficiently utilized.

For example, a length of the hot air flow channel 920 located in front of the blower 960 can be greater than that before utilizing the second flow space V2 of the inlet 4233, and sizes of the evaporator 951 and the condenser 952 disposed inside the hot air flow channel 920 can also be greater.

Specifically, in the inlet 4233, the blower fan driver 965 and the blower fan housing 963 of the blower 960 can be inserted into and disposed in the second flow space V2. For example, in FIG. 2, a portion of the blower fan driver 965 is illustrated as being inserted into the second flow space V2.

However, the present disclosure may not be limited thereto. An entirety of the blower fan driver 965 can be inserted into and disposed in the second flow space V2, and an entirety of the blower fan driver 965 and the blower fan housing 963 can be inserted into and disposed in the second flow space V2. In addition, the rear end of the hot air flow channel 920 can further be inserted into and disposed in the second flow space V2.

In some examples, more specifically, the inlet 4233 can include the inlet circumferential portion 4233*a* and the inlet recessed surface 4234 that provide the supporting and coupling forces to the fan duct 850 and the hot air supply 900.

The second flow space V2 can have a shape extending from the first flow space V1, and the inlet circumferential portion 4233*a* can extend from the flow outer circumferential portion 4231*a* to form a circumference of the second flow space V2. That is, the flow outer circumferential portion 4231*a* and the inlet circumferential portion 4233*a* can together form a circumference of the duct 423.

The inlet circumferential portion 4233*a* can extend toward the hot air supply 900 from one side of the flow outer circumferential portion 4231*a*, and can be connected to the other side of the flow outer circumferential portion 4231*a* via a lower portion of the rear plate 420.

The first flow space V1 and the second flow space V2 can be in communication with each other as described above as one side and the other side of the flow outer circumferential portion 4231*a* are opened, and can define one flow space V.

That is, the flow outer circumferential portion 4231*a* can be formed in a shape of a partially open circle, that is, in a shape of an arc, rather than forming a perfect circle shape. The inlet circumferential portion 4233*a* can form a continuous circumference with the flow outer circumferential portion 4231*a* from one side to the other side of the flow outer circumferential portion 4231*a*.

In addition, the inlet recessed surface 4234 can connect opposite sides of the inlet circumferential portions 4233*a*. For example, the flow outer circumferential portion 4231*a* can extend in the shape of the arc, the inlet circumferential portion 4233*a* can extend to connect the both sides of the flow outer circumferential portion 4231*a* to each other, and the inlet recessed surface 4234 can extend from the flow recessed surface 4232 of the flow portion 4231 to connect the opposite sides of the inlet circumferential portions 4233*a* to each other.

That is, the inlet circumferential portion 4233*a* can surround a portion of the circumference of the inlet recessed surface 4234, and the inlet recessed surface 4234 can be connected to the flow recessed surface 4232 in a region excluding the inlet circumferential portion 4233*a*.

The inlet recessed surface 4234 can defined the second flow space V2 by shielding the inlet circumferential portions 4233*a*. That is, the inlet recessed surface 4234 can refer to a recessed surface of the inlet 4233. One side and the other side of the flow outer circumferential portion 4231*a* connected to the inlet circumferential portion 4233*a* can be opened, so that the inlet recessed surface 4234 and the flow recessed surface 4232 can be connected to each other, and the inlet recessed surface 4234 and the flow recessed surface 4232 can form a continuous surface.

For example, as described above, the inlet 4233 can extend downwardly from the flow portion 4231 and can extend downwardly from a lower portion of the flow portion 4231. Further, the inlet 4233 can extend from a portion biased to one side in the lateral direction of the cabinet 100 of the flow portion 4231. That is, the inlet 4233 can extend downwards from one side in the lateral direction of the flow portion 4231.

The inlet 4233 can extend from the flow portion 4231 toward the bottom plate 147, and further, can extend to be closer to the first side plate 1411. One side of the flow outer circumferential portion 4231*a* can be located farther from the first side plate 1411 than the other side, and can be located closer to the bottom plate 147 of the cabinet 100.

The flow outer circumferential portion 4231*a* can form a 'q-shaped' circumference together with the inlet circumferential portion 4233*a*, and the inlet recessed surface 4234 can form a 'q-shaped' cross-section together with the flow recessed surface 4232.

As described above, the fan duct 850 and the blower fan driver 965 can be coupled to the inlet recessed surface 4234. As a coupling scheme, various schemes such as screw coupling, rivet coupling, fitting coupling, and the like can be used. In addition, the fan duct 850 and the blower fan driver 965 can be supported in contact with the inlet circumferential portion 4233*a*.

That is, the inlet 4233 can provide strong coupling and supporting forces to the fan duct 850 and the blower fan driver 965 through the inlet circumferential portion 4233*a* and the inlet recessed surface 4234.

In addition, the inlet circumferential portion 4233*a* can be configured such that a portion thereof connected to the flow outer circumferential portion 4231*a*, a portion thereof connected to the front surface of the rear plate 420, and a portion thereof connected to the inlet recessed surface 4234 are rounded, so that injury can be prevented as much as possible even when the user is in contact with the inlet circumferential portion 4233*a*.

In some examples, referring back to FIG. 5B, the flow portion 4231 and the inlet 4233 can be integrally formed. The inlet recessed surface 4234 can form one continuous surface of the duct 423 with the flow recessed surface 4232, and the flow outer circumferential portion 4231*a* can form a continuous circumference of the duct 423 of the same depth as the inlet circumferential portion 4233*a*. As the flow portion 4231 and the inlet 4233 are integrally manufactured, manufacturing convenience can be increased.

In addition, the rear plate 420 can be formed integrally with the duct 423. That is, the duct 423 can be defined by being recessed rearwards from the front surface of the rear plate 420. Accordingly, leakage of the hot air through a gap of a portion where the duct 423 and the rear plate 420 are coupled to each other that occurs when the duct 423 is separately formed and attached to the rear plate 420 can be prevented. In addition, convenience of manufacturing the rear plate 420 can be increased.

That is, as the inlet 4233 and the flow portion 4231 are integrally manufactured and the rear plate 420 and the duct 423 are integrally manufactured, the leakage can be prevented as much as possible in the rear plate 420.

In some examples, referring back to FIGS. 2 and 3, the drum rear surface 220 can include a drum shielding portion 221 through which the hot air flows into the drum 200.

As described above, the drum rear surface 220 can face the flow portion 4231, and can receive the hot air from the flow portion 4231 and guide the hot air into the drum 200.

The drum shielding portion 221 can be disposed in front of the open front surface of the flow portion 4231. The drum shielding portion 221 can shield the open front surface of the flow portion 4231. That is, the drum shielding portion 221 can be disposed in front of the first flow space V1, and can shield the first flow space V1.

The drum shielding portion 221 can face the flow recessed surface 4232, and the hot air can flow between the drum shielding portion 221 and the flow recessed surface 4232. The drum shielding portion 221 can be formed in a shape corresponding to the flow portion 4231 to more easily receive the hot air from the flow portion 4231. That is, the drum shielding portion 221 can be formed in a donut shape.

In addition, the drum shielding portion 221 can include a drum inlet 2213 configured such that the hot air can be introduced into the drum 200.

The drum inlet 2213 can be defined as a plurality of holes defined through the drum shielding portion 221 or can be defined as a net in a form of a mesh. In addition, a plurality of drum inlet 2213 can be defined to be spaced apart from each other in a circumferential direction of the drum shielding portion 221.

In addition, the drum shielding portion 221 can further include a reinforcing rib 2211 and a circumferential rib 2215 to secure structural rigidity.

The reinforcing rib 2211 can be disposed between the two adjacent drum inlets 2213 along the circumferential direction of the drum shielding portion 221, and the circumferential rib 2215 can include circumferential ribs 2215 disposed inwardly of the reinforcing rib 2211 and inwardly of the drum inlet 2213. The circumferential rib 2215 can be formed in an annular shape, and can be formed integrally with the reinforcing rib 2211.

In addition, the reinforcing rib 2211 and the circumferential rib 2215 can be disposed relatively rearward as the drum inlet 2213 protrudes frontwards from the drum shielding portion 221, or can protrude rearwards from the drum shielding portion 221.

In addition, a portion of the drum rear surface 220 can be configured to correspond to a mounting accommodating portion 4251 to be described below. That is, the drum rear surface 220 can include a drum accommodating portion 223 configured to correspond to the mounting accommodating portion 4251.

Specifically, the drum rear surface 220 can include a drum accommodating portion 223 that is recessed frontwards from an interior of the drum shielding portion 221. The drum accommodating portion 223 can accommodate the mounting accommodating portion 4251 therein.

The drum accommodating portion 223 can be easy to be coupled with the drum rotating shaft 650 of the driver M extending through the mounting hole 4255 as the mounting accommodating portion 4251 is inserted thereinto, and can shield the open front surface of the flow portion 4231 more easily by allowing the drum shielding portion 221 to be disposed relatively close to the flow portion 4231. Details of the mounting accommodating portion 4251 will be described later in detail.

Figure 7:
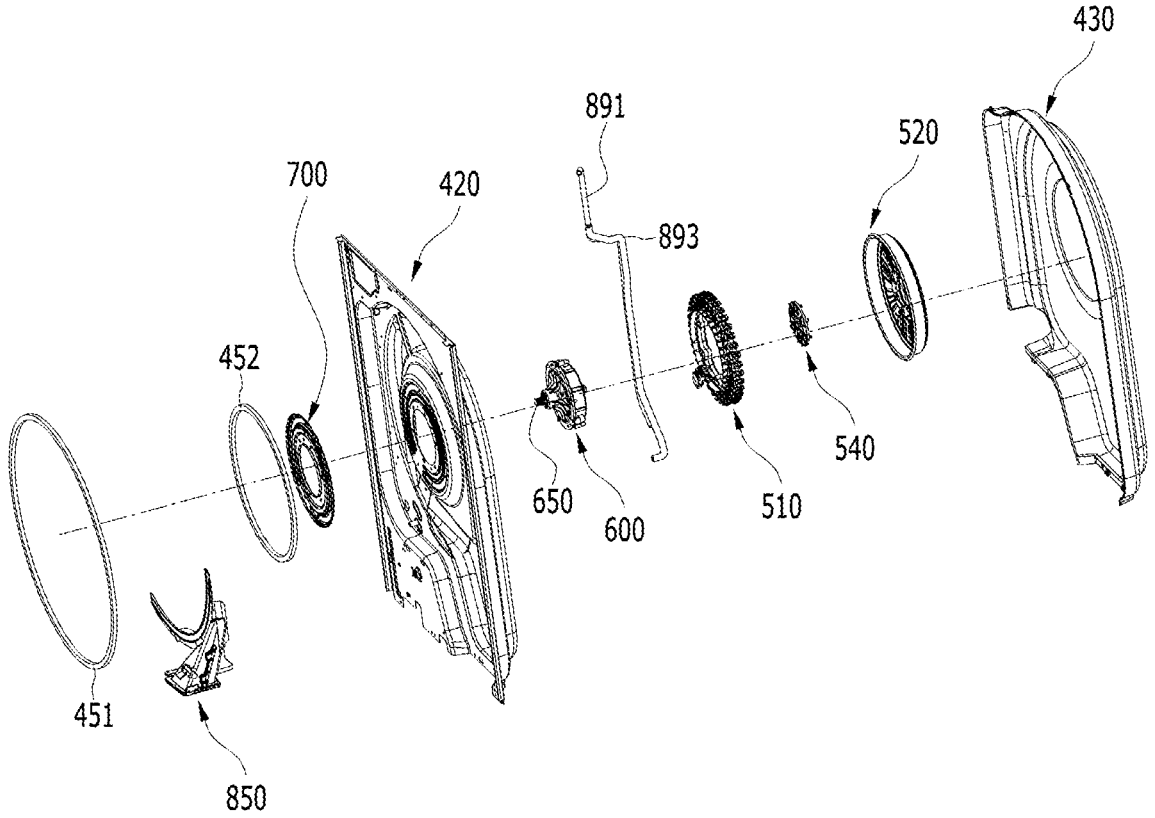
FIG. 7 is an exploded perspective view shown an example of a rear plate, a fan duct, and a driver.
Figure 8:
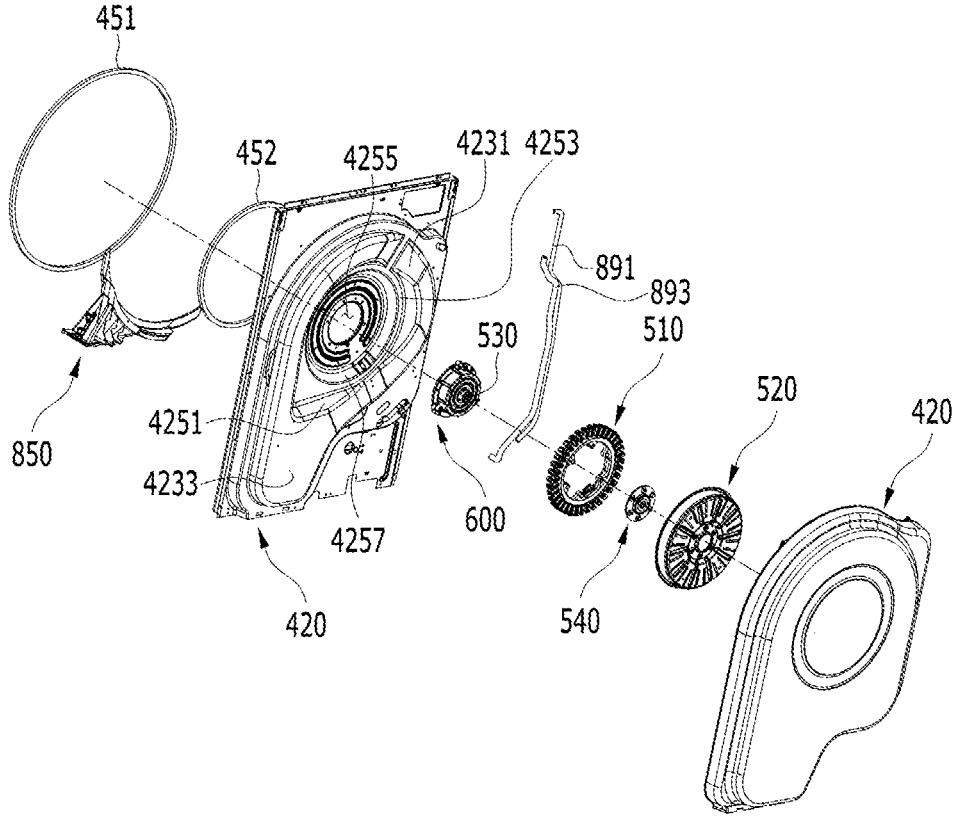
FIG. 8 is an exploded perspective view showing an example of a rear plate, a fan duct, and a driver shown in FIG. 7 viewed from another side.

In some examples, FIG. 7 is an exploded perspective view of a rear plate, a fan duct, and a driver. FIG. 8 is an exploded perspective view of a rear plate, a fan duct, and a driver shown in FIG. 7 viewed from another side.

Referring to FIGS. 4 and 7 to 8, the laundry treating apparatus can include a sealing portion 450 for preventing the leakage of the hot air to the outside of the drum 200.

The sealing portion 450 can prevent the leakage of the hot air flowing through the first flow space V1 to the outside of the drum 200 through the space between the flow outer circumferential portion 4231*a* and the drum rear surface 220 resulted from the front surface of the flow portion 4231 being opened. In addition, the sealing portion 450 can prevent the hot air flowing through the first flow space V1 from leaking to the outside of the drum 200 through the space between the flow inner circumferential portion 4231*b* and the drum rear surface 220.

The sealing portion 450 can include a first sealing portion 451 disposed along an outer circumference of the flow portion 4231.

The first sealing portion 451 can be disposed between the front surface of the rear plate 420 and the drum shielding portion 221 of the drum rear surface 220. The first sealing portion 451 can be disposed between the drum shielding portion 221 and the flow portion 4231.

The first sealing portion 451 can be formed in a shape corresponding to the flow outer circumferential portion 4231*a*, and can be disposed outwardly of the flow outer circumferential portion 4231*a*. When the flow outer circumferential portion 4231*a* is formed in a circular shape, the first sealing portion 451 can be formed in an annular shape in which both inner and outer sides thereof are formed in a circular shape.

Referring to FIGS. 6A and 6B, when a diameter of the flow outer circumferential portion 4231*a* is D1, an outer diameter of the first sealing portion 451 can be greater than D1, and an inner diameter of the first sealing portion 451 can be equal to or greater than D1.

The first sealing portion 451 can be disposed at an outer edge of the drum shielding portion 221. The first sealing portion 451 can have an inner circumferential surface located outwardly of the drum inlet 2213. A thickness of the first sealing portion 451 can be greater than a rearwardly protruding length of the drum inlet 2213.

As described above, the hot air flows into the drum 200 through the plurality of through-holes defined in the drum inlet 2213, so that the first sealing portion 451 can be disposed to surround the drum inlet 2213 from the outside of the drum inlet 2213 to effectively prevent the leakage to the outside of the drum 200.

In addition, the first sealing portion 451 has the thickness greater than the rearwardly protruding depth of the drum inlet 2213, so that the leakage of the hot air to the outside of the drum 200 before flowing into the drum 200 through the drum inlet 2213 can be prevented as much as possible. The first sealing portion 451 can be configured to be in contact with both the drum shielding portion 221 and the front surface of the rear plate 420 to more effectively prevent the leakage.

The sealing portion 450 can include a second sealing portion 452 disposed along an inner circumference of the flow portion 4231.

The second sealing portion 452 can be disposed between the front surface of the rear plate 420 and the drum shielding portion 221 of the drum rear surface 220. The second sealing portion 452 can be disposed between the drum shielding portion 221 and the flow portion 4231.

The second sealing portion 452 can be formed in a shape corresponding to the flow inner circumferential portion 4231*b*. When the flow inner circumferential portion 4231*b* is formed in a circular shape, the second sealing portion 452 can be formed in an annular shape in which both inner and outer sides thereof are formed in a circular shape. The second sealing portion 452 can be disposed inwardly of the flow inner circumferential portion 4231*b*. when a diameter of the flow inner circumferential portion 4231*b* is D2, an outer diameter of the second sealing portion 452 can be equal to or smaller than D2.

The second sealing portion 452 can be disposed at an inner edge of the drum shielding portion 221. That is, the second sealing portion 452 can be disposed on the circumferential rib 2215. The second sealing portion 452 can be disposed to surround the driver M connected to the drum rear surface 220.

The second sealing portion 452 can have an inner circumferential surface located inwardly of the drum inlet 2213. A thickness of the second sealing portion 452 can be greater than the rearwardly protruding length of the drum inlet 2213.

As described above, the hot air flows into the drum 200 through the plurality of through-holes defined in the drum inlet 2213, so that the second sealing portion 452 can be disposed to surround the driver M from the inside of the drum inlet 2213 to effectively prevent the hot air from leaking to the driver M.

In addition, the first sealing portion 451 has the thickness greater than the rearwardly protruding depth of the drum inlet 2213, so that the leakage of the hot air to the driver M before flowing into the drum 200 through the drum inlet 2213 can be prevented as much as possible.

When the heat is generated by the rotation of the driver M and the hot air of the flow portion 4231 is introduced, the driver M can be further heated and a malfunction of the driver M can occur. The driver M can be disposed to be exposed to the outside. When the hot air flows into the driver M, the hot air can leak to the outside of the drum 200. The second sealing portion 452 can be disposed to be in contact with both the drum shielding portion 221 and the front surface of the rear plate 420 to more effectively prevent the leakage.

Because the drum 200 rotates during the operation of the laundry treating apparatus, continuous friction is applied to the sealing portion 450 by the drum rear surface 220. Therefore, the sealing portion 450 can be made of an elastic material capable of sealing the drum rear surface 220 and the flow portion 4231 without deterioration in performance even with a frictional force and frictional heat generated based on the rotation.

Figure 9A:
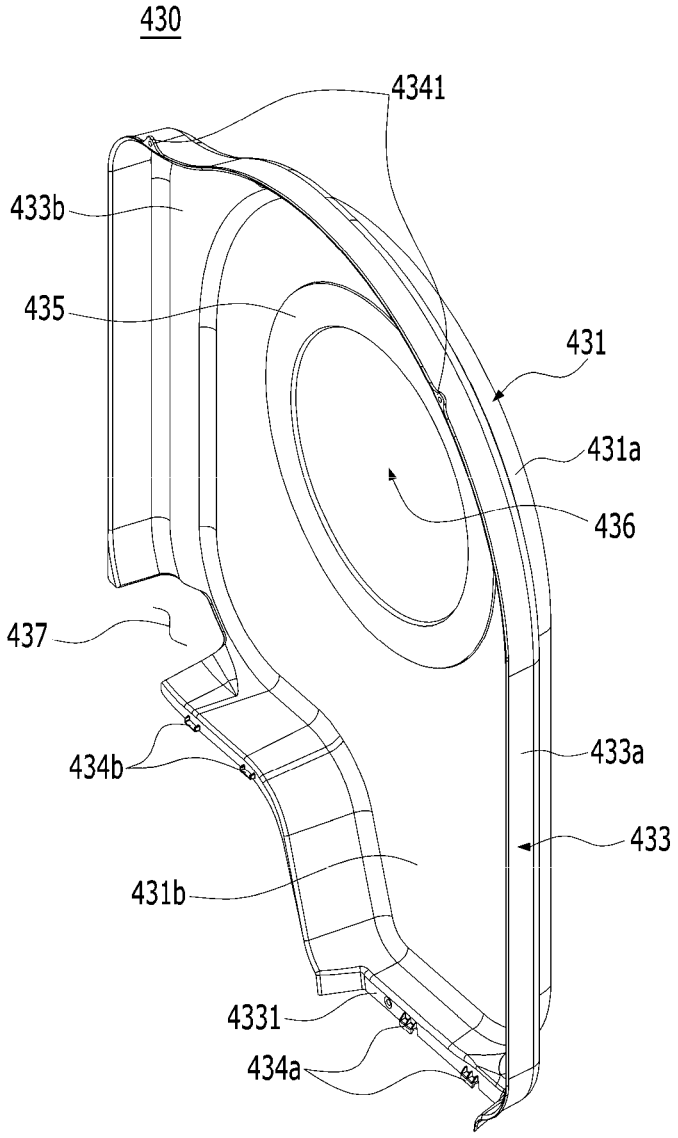
FIGS. 9A and 9B are views showing an example of a rear cover.
Figure 9B:
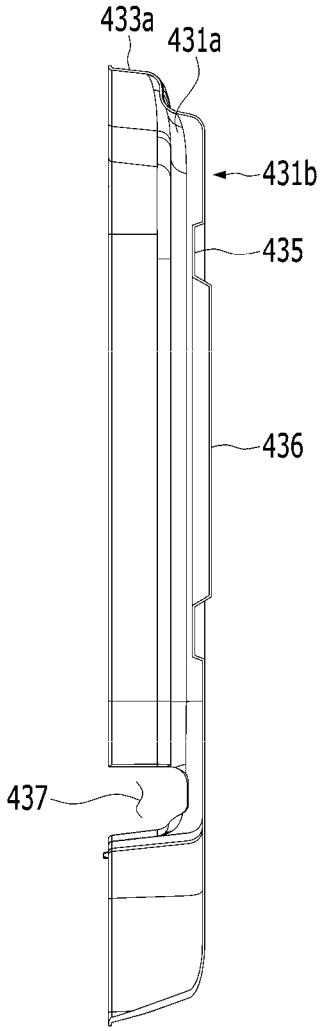
Figure 10A:
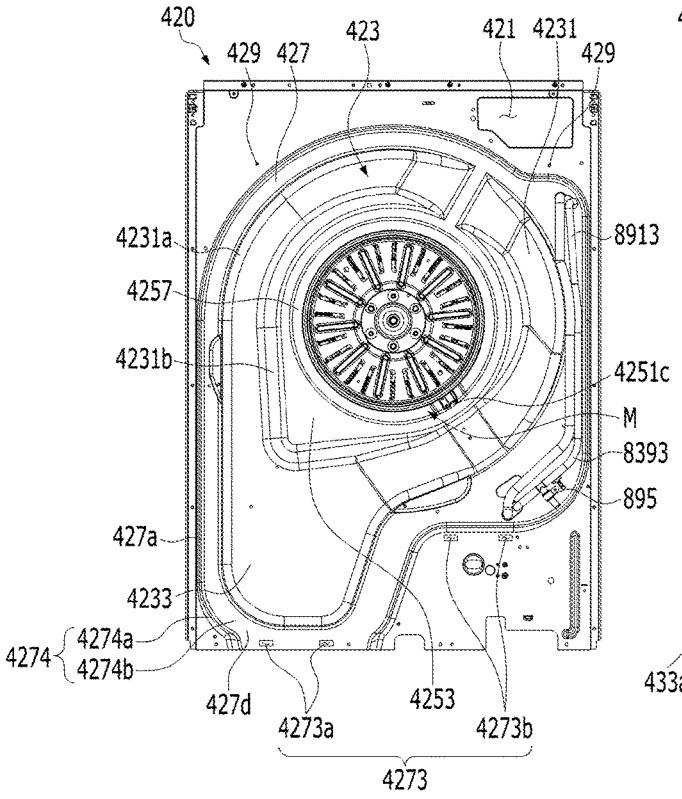
FIGS. 10A and 10B are views showing an example of a rear cover coupled to a rear plate.
Figure 10B:
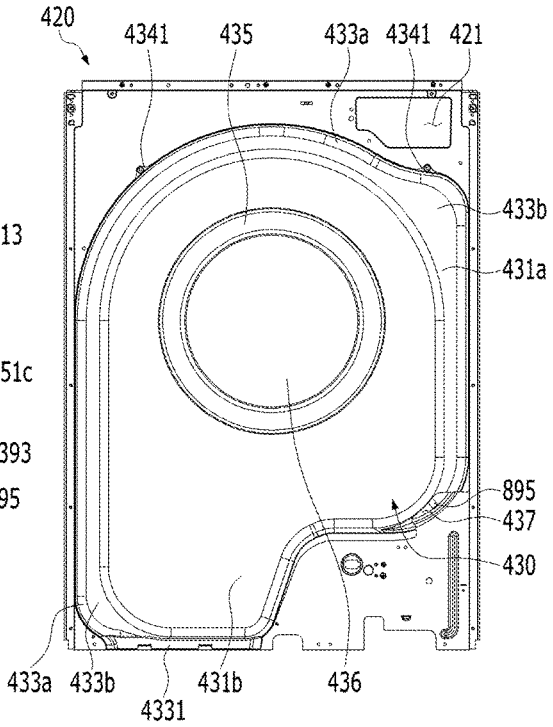

In some examples, FIGS. 9A and 9B are views showing an example of a rear cover. FIGS. 10A and 10B are views showing a rear plate and a rear cover.

Specifically, FIG. 10A is a rear view of the rear plate to which the driver is coupled, and FIG. 10B is a rear view of the rear plate to which the rear cover is coupled.

Referring to FIGS. 9A and 9B, and FIG. 10B, the laundry treating apparatus can include a rear cover 430 for covering the rear plate 420.

The rear cover 430 can be configured to cover the rear plate 420 from the rear, and can prevent components disposed at the rear of the rear plate 420 from being exposed to the outside. Accordingly, the rear cover 430 can protect the components disposed at the rear of the rear plate 420 from external impact and improve aesthetics.

As described above, the duct 423 can be defined in the rear plate 420, and the driver M can be coupled to the rear surface of the rear plate 420. The rear cover 430 can be coupled to the rear surface of the rear plate 420 to cover the duct 423 and the driver M, and can prevent the duct 423 and the driver M from being exposed to the outside.

Accordingly, the rear cover 430 can prevent a safety accident that can occur when the user comes into contact with the duct 423 or the driver M, and can prevent damage to the duct 423 and driver M resulted from external impact.

In addition, the rear cover 430 can prevent the hot air flowing inside the duct 423 from exchanging heat with the outside by shielding the duct 423 that guides the hot air to the drum rear surface 220 from the outside, thereby preventing the reduction of the drying efficiency.

At least a portion of the rear cover 430 can be formed in a shape corresponding to the duct 423. As described above, because the driver M can be located inwardly of the duct 423 and can be coupled to the rear surface of the rear plate 420, when the rear cover 430 is formed in the shape at least partially corresponding to the duct 423 and covers the duct 423, the driver M can also be covered.

The rear cover 430 can expose a portion of the rear surface of the rear plate 420 except for the duct 423 and the driver M to the outside. That is, the rear cover 430 can be configured to cover only some components for insulation or protection rather than covering the entire rear surface of the rear plate 420, thereby minimizing a volume and reducing a manufacturing cost.

In addition, components can be freely disposed in a portion exposed to the outside of the rear surface of the rear plate 420. For example, the water storage tank can be inserted into the rear plate 420 through the rear tank support hole 421 described above. The water storage tank can further extend rearwards through the rear tank support hole 421, and can be prevented from interfering with the rear cover 430. Details of the rear cover 430 will be described later.

Figures 11A, 11B, 11C:
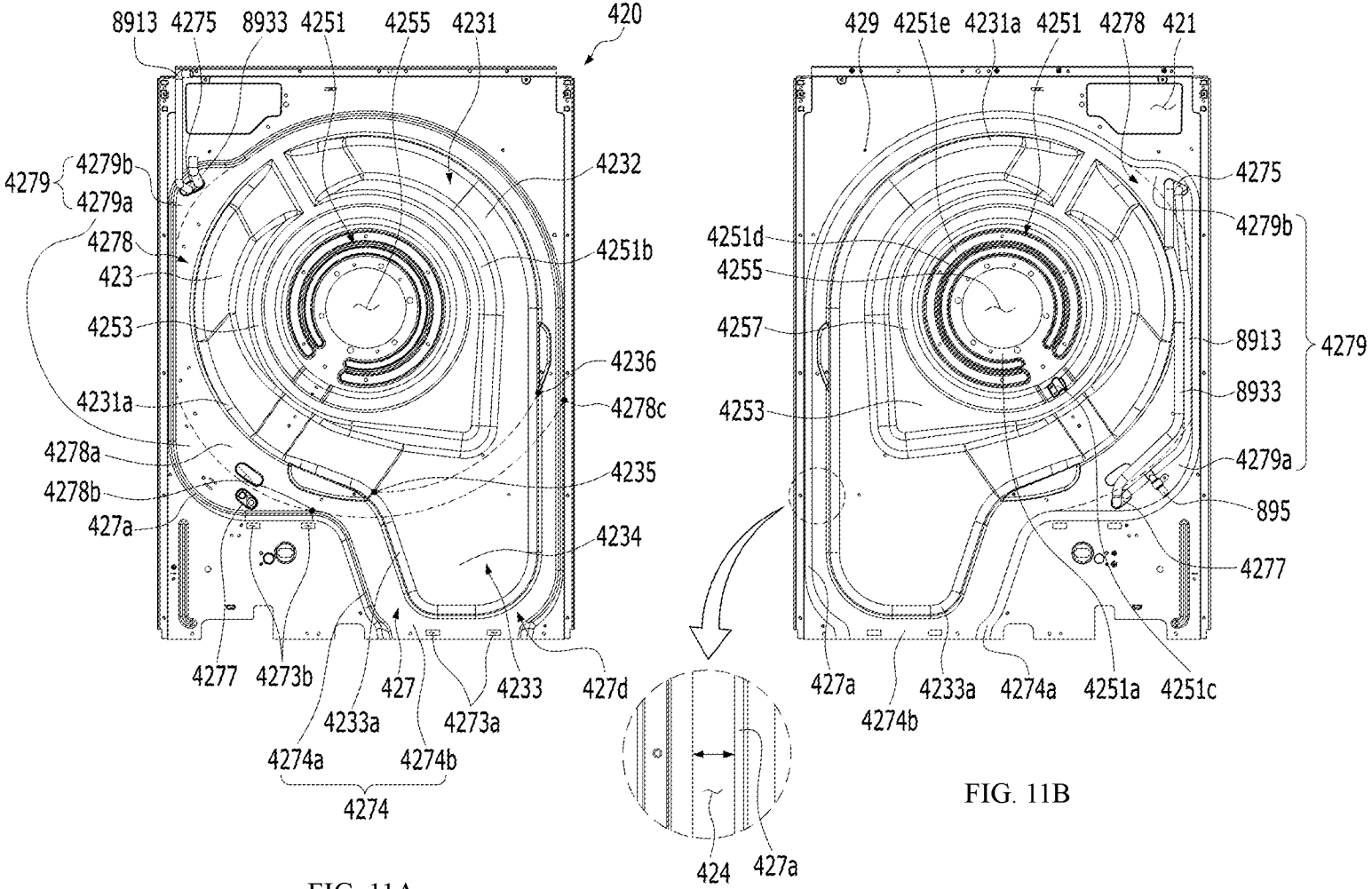
FIGS. 11A to 11C are views showing an example of a rear cover coupling portion of a rear plate.

In some examples, FIGS. 11A to 11C are views showing an example of a rear cover coupling portion of a rear plate.

Specifically, FIG. 11A is a front view of the rear cover coupling portion, and FIG. 11B is a rear view of the rear cover coupling portion. FIG. 11C is a view showing a coupling support of the rear plate.

Referring to FIGS. 11A to 11C, the rear plate 420 can include a rear cover coupling portion 427 to which the rear cover 430 is coupled. The rear cover coupling portion 427 can be inserted inwardly of the rear cover 430 to be coupled with the rear cover 430, thereby improving the supporting force of the rear cover 430.

The rear cover coupling portion 427 can protrude rearwards from one surface of the rear plate 420, and the rear cover coupling portion 427 can extend outwardly of the duct 423 to surround at least a portion of the duct 423. FIGS. 11A to 11C illustrate the rear cover coupling portion surrounding the entire duct.

The duct 423 can protrude rearwards from the rear cover coupling portion 427, and the rear cover coupling portion 427 can be connected to an outer circumference of the duct 423. That is, the rear plate 420 can be formed in a shape in which the duct 423 protrudes more rearwards than the rear cover coupling portion 427.

In some implementations, the rear cover coupling portion 427 can be formed to be stepped with the duct 423, thereby increasing the structural rigidity of the entire rear plate 420 and serving as a guide when the rear cover 430 is coupled to the rear surface of the rear plate 420.

Specifically, the rear cover coupling portion 427 can include a rear coupling circumferential portion 427*a* forming a circumference of the rear cover coupling portion 427, and a rear coupling recessed surface 427*d* extending from the rear coupling circumferential portion 427*a* and connected to the duct 423.

The rear coupling recessed surface 427*d* can be positioned in front of the flow recessed surface 4232 and the inlet recessed surface 4234 of the duct 423. The above-described first sealing portion 451 can be disposed on the rear coupling recessed surface 427*d*, and a fan duct accommodating portion 4271 to be described later can be disposed in a boundary region of the flow outer circumferential portion 4231*a* and the inlet circumferential portion 4233*a*.

The rear coupling circumferential portion 427*a* can be formed in a shape at least partially corresponding to the flow outer circumferential portion 4231*a* and the inlet circumferential portion 4233*a*.

That is, an entirety of the rear coupling circumferential portion 427*a* can be formed in a shape corresponding to the flow outer circumferential portion 4231*a* and the inlet circumferential portion 4233*a*, or a portion of the rear coupling circumferential portion 427*a* can be formed in a shape corresponding to the flow outer circumferential portion 4231*a* and the inlet circumferential portion 4233*a*.

For example, the rear coupling circumferential portion 427*a* can be spaced apart by a predetermined spacing from and formed in a shape generally corresponding to the flow outer circumferential portion 4231*a* and the inlet circumferential portion 4233*a*. In addition, the rear coupling circumferential portion 427*a* can extend to be away from the flow outer circumferential portion 4231*a* or the inlet circumferential portion 4233*a* in a specific portion.

As the rear coupling circumferential portion 427*a* extends to be away from the flow outer circumferential portion 4231*a* or the inlet circumferential portion 4233*a* in the specific portion, the rear coupling recessed surface 427*d* connecting the flow outer circumferential portion 4231*a*, the inlet circumferential portion 4233*a*, and the rear coupling circumferential portion 427*a* can be expanded.

Because a drain pipe 891 and a return pipe 893 to be described later can be installed in the expanded region of the rear coupling recessed surface 427*d*, thereby increasing the space utilization efficiency.

In some examples, referring back to FIGS. 9A to 10B, the rear cover 430 can include a duct cover 431 configured to cover the duct 423. The duct cover 431 can have a space defined therein, and the duct 423 can be inserted into the space.

Specifically, the duct cover 431 can include a duct cover circumferential portion 431*a* configured to surround a circumference of the duct 423 and a cover shielding portion 431*b* extending from the duct cover circumferential portion 431*a*, and the cover shielding portion 431*b* can shield an interior of the duct cover 431.

The duct cover circumferential portion 431*a* can have an inner circumferential surface facing the flow outer circumferential portion 4231*a* and the inlet circumferential portion 4233*a* of the duct 423, and the cover shielding portion 431*b* can face the flow recessed surface 4232 and the inlet recessed surface 4234 of the duct 423.

In some implementations, the rear cover 430 can be composed of only the duct cover 431 such that an end of the duct cover circumferential portion 431*a* is in contact with the rear coupling recessed surface 427*d* to cover only the duct 423 and the driver M.

In addition, the rear cover 430 can be composed of only the duct cover 431 such that the duct cover circumferential portion 431*a* surrounds the rear coupling circumferential portion 427*a* and comes into contact with the rear surface of the rear plate 420 positioned outwardly of the rear coupling circumferential portion 427*a* to cover up to the rear cover coupling portion 427 together with the duct 423 and the driver M.

A shape of the rear cover 430 can be determined variously in consideration of manufacturing conditions, an arrangement relationship with components disposed on the rear surface of the rear plate 420, and the like.

In addition, the rear cover 430 can include a coupling portion cover 433 configured to cover the rear cover coupling portion 427.

The coupling portion cover 433 can be connected to the duct cover 431 and can shield the interior of the rear cover 430 together with the duct cover 431. As the duct 423 protrudes more rearwards from the rear surface of the rear plate 420 than the rear cover coupling portion 427, the duct cover 431 can protrude more rearwards than the coupling portion cover 433.

The duct cover 431 and the coupling portion cover 433 can have different degrees of protrusions to be stepped to each other, and the rear cover 430 can have increased structural rigidity by the duct cover 431 and the coupling portion cover 433.

Specifically, the coupling portion cover 433 can include a coupling cover circumferential portion 433*a* surrounding a circumference of the rear cover coupling portion 427, and a cover extension 433*b* extending from the coupling cover circumferential portion 433*a* and connected to the duct cover circumferential portion 431*a*.

The coupling cover circumferential portion 433*a* can have an inner circumferential surface facing the rear coupling circumferential portion 427*a* of the rear cover coupling portion 427, and the cover extension 433*b* can face the rear coupling recessed surface 427*d* of the rear cover coupling portion 427.

The coupling cover circumferential portion 433*a* can be connected to the duct cover circumferential portion 431*a* through the cover extension 433*b* or directly connected to the duct cover circumferential portion 431*a*. That is, the coupling cover circumferential portion 433*a* can be formed integrally with the duct cover circumferential portion 431*a* to surround the duct 423 and the rear cover coupling portion 427 together.

From another point of view, at least a portion of the duct cover 431 can be configured to correspond to the duct 423. That is, an entirety of the duct cover 431 can be configured to correspond to the duct 423 to cover the duct 423, or a portion of the duct cover 431 can be configured to correspond to the duct 423 to cover the duct 423.

Specifically, the duct cover circumferential portion 431*a* can maintain a certain spacing from and can be formed in a shape generally corresponding to the flow outer circumferential portion 4231*a* and the inlet circumferential portion 4233*a*, and can extend to be away from the flow outer circumferential portion 4231*a* or the inlet circumferential portion 4233*a* in a specific portion.

As the duct cover circumferential portion 431*a* extends to be away from the flow outer circumferential portion 4231*a* or the inlet circumferential portion 4233*a* in the specific portion, the cover shielding portion 431*b* connecting the duct cover circumferential portion 431*a* can be expanded.

The rear cover 430 can have a space defined inside the duct cover 431 by a rearwardly extending length of the duct cover circumferential portion 431*a*, and can have a space defined inside the coupling portion cover 433 by a rearwardly extending length of the coupling cover circumferential portion 433*a*.

That is, the rear cover 430 can have a space defined by a length obtained by adding the extended length of the coupling cover circumferential portion 433*a* to the extended length of the duct cover circumferential portion 431*a* at the front of the duct cover 431.

That is, the duct cover 431 can protrude rearwards more than the coupling portion cover 433 to define a larger space therein, and can easily cover the separate component disposed on the rear surface of the rear cover coupling portion 427.

For example, the cover shielding portion 431*b* can further extend in a radial direction of the flow portion 4231 from one surface facing the flow recessed surface 4232, so that an external discharge pipe 895 to be described later can be easily disposed between the cover shielding portion 431*b* and the rear coupling recessed surface 427*d*, and a space can be provided such that a cover door 439 selectively exposing the external discharge pipe 895 to the outside is easily installed. A relationship between the rear cover 430, the external discharge pipe 895, and the cover door 439 will be described later in detail.

In some examples, referring to FIGS. 4 and FIG. 11A, in the rear cover coupling portion 427, at least a portion of the blower 960 can be disposed.

That is, the rear cover coupling portion 427 can accommodate at least a portion of the blower 960 together with the inlet 4233, and can support the blower 960. In the blower 960, the blower fan housing 963 can be located forwardly of the blower fan driver 965, and a width of the blower fan housing 963 can be larger than a width of the inlet 4233, so that it can be difficult for the blower fan housing 963 to be accommodated in the inlet 4233.

As the rear cover coupling portion 427 can be configured to be recessed rearwards from the front surface of the rear plate 420 outwardly of the inlet 4233, the rear cover coupling portion 427 can have a width larger than the width of the inlet 4233 and can accommodate at least a portion of the blower fan housing 963.

As the rear coupling circumferential portion 427*a* of the rear cover coupling portion 427 can be in contact with the blower fan housing 963 to support the blower fan housing 963, the rear coupling circumferential portion 427*a* can strongly support the entire blower 960 even with the vibration of the blower fan driver 965.

As the rear coupling recessed surface 427*d* of the rear cover coupling portion 427 can be coupled with the blower fan housing 963 by being penetrated by a separate fastening member, a position of the entire blower fan 961 can be fixed firmly.

In addition, the rear cover coupling portion 427 can be configured such that a portion thereof facing the blower 960 is opened toward the bottom plate 147. That is, the rear cover coupling portion 427 can have an open lower end, so that the blower 960 and the bottom plate 147 can be more easily disposed.

The rear cover coupling portion 427 can protrude rearwards from one surface of the rear plate 420. That is, the rear cover coupling portion 427 can be formed to be stepped with one surface of the rear plate 420 positioned outwardly thereof.

In some examples, the rear coupling circumferential portion 427*a* can be inclined with one surface of the rear plate 420 connected to the rear coupling circumferential portion 427*a*. When the blower fan housing 963 of the blower 960 and the bottom plate 147 are located inside the rear cover coupling portion 427, the blower fan housing 963 of the blower 960 and the bottom plate 147 can come into contact with the rear coupling circumferential portion 427*a*, where the rear coupling circumferential portion 427*a* can be inclined for the placement of the blower fan housing 963 of the blower 960 and the bottom plate 147.

Accordingly, the rear coupling circumferential portion 427*a* can have a portion thereof facing the blower 960 and the bottom plate 147 opened toward the bottom plate 147 to allow the rear coupling recessed surface 427*d* to form one continuous surface up to a lower end of the rear plate 420.

That is, the rear coupling circumferential portion 427*a* can be formed in a shape with an open lower end, rather than a continuous closed curve, and a lower portion of the rear coupling recessed surface 427*d* of the rear cover coupling portion 427 may not be surrounded by the rear coupling circumferential portion 427*a*.

Specifically, the rear cover coupling portion 427 can include a flow cover coupling portion 4278 corresponding to the flow portion 4231, and an inlet cover coupling portion

4274 connected to the flow cover coupling portion 4278 and corresponding to the inlet 4233.

The flow cover coupling portion 4278 can include a flow coupling circumferential portion 4278*a* forming a circumference of the flow cover coupling portion 4278 and corresponding to the flow outer circumferential portion 4231*a*, and the inlet cover coupling portion 4274 can include an inlet coupling circumferential portion 4274*a* connected to the fluid coupling circumferential portion 278*a* and corresponding to the inlet circumferential portion 4233*a*.

In addition, one side of the inlet coupling circumferential portion 4274*a* can extend from a first flow coupling connection portion 4278*b* corresponding to the first flow connection portion 4235, and the other side thereof can extend from a second flow coupling connection portion 4278*c* corresponding to the second flow connection portion 4236.

The inlet coupling circumferential portion 4274*a* can have one side connected to the first flow coupling connection portion 4278*b* in contact with the outside, and can have the other side connected to the second flow coupling connection portion 4278*c* in contact with the outside.

The inlet coupling circumferential portion 4274*a* may not form a continuous closed curve from the first flow coupling connection portion 4278*b* to the second flow coupling connection portion 4278*c*, and an inlet coupling recessed surface 4274*b* corresponding to the inlet recessed surface 4234 can be continuous up to a lower end of the rear plate 420, so that the inlet coupling recessed surface 4274*b* can come into contact with the outside. The aforementioned rear coupling recessed surface 427*d* can include the inlet coupling recessed surface 4274*b*.

In some implementations, as the rear cover coupling portion 427 is opened toward the bottom plate 147, even when the rear plate 420 is coupled to the bottom plate 147 in the manufacturing process of the laundry treating apparatus 10, a space for the blower fan housing 963 and the bottom plate 147 can be sufficiently secured inside the rear cover coupling portion 427, and the blower fan housing 963 and the bottom plate 147 can be conveniently coupled.

In addition, in some implementations, while bringing the rear plate 420 into contact with the bottom plate 147, the rear plate 420 can be coupled to the top plate 145 and the side plates 141 using a portion of the rear plate 420 in contact with the bottom plate 147 as a rotation center. In addition, the rear cover coupling portion 427 can be prevented from contacting the bottom plate 147 and the blower fan housing 963 by the open lower end of the rear coupling circumferential portion 427*a*. Thus, the rear plate 420 can be easily coupled to the bottom plate 147, the top plate 145, and the side plates 141 to form the cabinet 100.

In some examples, referring to FIGS. 9A to 10B, in the rear cover 430, a portion of the circumference facing the inlet coupling recessed surface 4274*b* of the rear cover coupling portion 427 can be opened.

As described above, the inlet coupling circumferential portion 4274*a* and the inlet coupling recessed surface 4274*b* can extend to the lower end of the rear plate 420, and the coupling cover circumferential portion 433*a* of the coupling portion cover 433 surrounding the inlet coupling circumferential portion 4274*a* can surround a portion or an entirety of the inlet coupling circumferential portion 4274*a*.

When the coupling cover circumferential portion 433*a* surrounds the portion of the inlet coupling circumferential portion 4274*a*, the coupling cover circumferential portion 433*a* can extend to a portion spaced apart by a predetermined distance from the lower end of the rear plate 420. As a lower end of the coupling cover circumferential portion 433*a* is opened, a portion of the inlet coupling recessed surface 4274*b* can be exposed to the outside. The coupling cover circumferential portion 433*a* can have the open lower end, so that contact with the inlet coupling recessed surface 4274*b* can be prevented, and the rear cover 430 can be easily coupled to the rear plate 420.

When the coupling cover circumferential portion 433*a* surrounds the entirety of the inlet coupling circumferential portion 4274*a*, the coupling cover circumferential portion 433*a* can extend to the lower end of the rear plate 420, and the entire inlet coupling recessed surface 4274*b* can be prevented from being exposed to the outside. Even in this case, the lower end of the coupling cover circumferential portion 433*a* can be opened to prevent the contact with the bottom plate 147, and the rear cover 430 can be easily coupled to the rear plate 420.

When viewing from another point of view, the coupling cover circumferential portion 433*a* can be opened at a position corresponding to the open portion of the inlet coupling circumferential portion 4274*a*, and the rear cover 430 can be prevented from contacting the inlet coupling recessed surface 4274*b* through the open portion of the coupling cover circumferential portion 433*a*, so that the rear cover 430 can be easily coupled to the rear plate 420.

In addition, the coupling portion cover 433 can include a coupling cover coupling surface 4331 facing the inlet coupling recessed surface 4274*b*.

The coupling cover coupling surface 4331 can be the cover extension 433*b* connecting the duct cover circumferential portion 431*a* of the duct cover 431 and the coupling cover circumferential portion 433*a* to each other, or can be a separate surface extending from the duct cover circumferential portion 431*a* or the coupling cover circumferential portion 433*a*.

The coupling cover coupling surface 4331 can be disposed in parallel with the inlet coupling recessed surface 4274*b*, can be in contact with the inlet coupling recessed surface 4274*b* as the lower end of the coupling cover circumferential portion 433*a* is opened, and can be in contact with the inlet coupling recessed surface 4274*b* to provide a supporting force to the rear cover 430.

In some examples, referring back to FIGS. 9A to 10B, the rear cover 430 can include a hook coupling portion 434 and a cover fastening portion 4341 coupled to the rear plate 420.

Specifically, the rear cover 430 can include the hook coupling portion 434 that is disposed along the circumference of the rear cover 430 and is hook-coupled to the rear plate 420, and the rear plate 420 can include a hook accommodating portion 4273 defined through the rear plate 420 at a position corresponding to the hook coupling portion 434. The hook coupling portion 434 can be inserted into the hook accommodating portion 4273, and can have an end protruding to be caught in the hook accommodating portion 4273.

Positions where a plate fastening portion 429 and the hook accommodating portion 4273 are disposed can be variously set depending on a manufacturing condition, a manufacturing method, a shape of the rear plate 420, and a shape of the rear cover 430, and positions where the cover fastening portion 4341 and the hook coupling portion 434 are disposed can also be variously set depending on the manufacturing condition, the manufacturing method, the shape of the rear plate 420, and the shape of the rear cover 430.

For example, the hook coupling portion 434 can be disposed at one open side of the above-described coupling portion cover 433, and the hook accommodating portion 4273 can also be disposed at one open side of the rear cover coupling portion 427 to correspond to the hook coupling portion 434.

Specifically, the hook coupling portion 434 can include a first hook coupling portion 434*a* disposed on the coupling cover coupling surface 4331, and the hook accommodating portion 4273 can include a first hook accommodating portion 4273*a* defined in the rear coupling recessed surface 427*d* facing the coupling cover coupling surface 4331.

The first hook coupling portion 434*a* can be inserted into and coupled to the first hook accommodating portion 4273*a*, and a cross-sectional area of the coupling cover coupling surface 4331 in the coupling portion cover 433 can be secured to be equal to or greater than a certain area, which can be advantageous for the first hook coupling portion 434*a* to be disposed.

In addition, the hook coupling portion 434 can include a second hook coupling portion 434*b* disposed on the coupling cover circumferential portion 433*a*, and the hook accommodating portion 4723 can include a second hook accommodating portion 4273*b* defined through one surface of the rear plate 420 positioned outwardly of the rear coupling recessed surface 427*d*. The second hook coupling portion 434*b* can be inserted into and coupled to the second hook accommodating portion 4273*b*.

In addition, the rear cover 430 can include a cover fastening portion 4341 disposed along the circumference of the rear cover 430. The cover fastening portion 4341 can extend around the coupling cover circumferential portion 433*a* to face the rear surface of the rear plate 420, can include a plurality of cover fastening portions disposed to be spaced apart from each other along the circumference of the coupling cover circumferential portion 433*a*, and can be coupled to the rear plate 420 by being penetrated by a separate fastening member.

The rear plate 420 can include the plate fastening portion 429 formed through one surface of the rear plate 420 at a position corresponding to the cover fastening portion 4341, and the plate fastening portion 429 can fix the rear cover 430 and the rear plate 420 as the separate fastening member is inserted thereinto together with the cover fastening portion 4341. That is, the plate fastening portion 429 can be bolt-coupled to the cover fastening portion 4341.

In summary, the rear cover 430 can be fixed with the rear plate 420 through welding, adhesive bonding, and the like, but can be fixed to the rear plate 420 using a relatively simple coupling scheme such as the hook coupling through the hook coupling portion 434 or the bolt coupling through the cover fastening portion 4341 depending on the manufacturing condition and the like.

The rear cover 430 can be fixed to the rear plate 420 using one of the hook coupling and the bolt coupling, and can be fixed to the rear plate 420 using both the hook coupling and the bolt coupling.

In addition, referring to FIG. 11C, the rear plate 420 can further include a coupling support 424 for supporting the coupling with the rear cover 430.

The coupling support 424 can accommodate an end of the rear cover 430 therein to support the entire rear cover 430. That is, the coupling support 424 can accommodate the coupling cover circumferential portion 433*a* of the rear cover 430 therein to support the entire rear cover 430.

The coupling support 424 can be recessed frontwards from the rear surface of the rear plate 420 or can be defined in a relatively recessed space between the rear coupling circumferential portion 427*a* protruding rearwards from the rear surface of the rear plate 420 and a plate coupling portion coupled to the side plate 141 of the rear plate 420.

Specifically, the rear plate 420 can include plate coupling portions protruding rearwards from the rear plate 420 such that the side plates 141 can be accommodated therein and coupled thereto at both ends thereof. The coupling support 424 can be defined between the plate coupling portion and the rear coupling circumferential portion 427*a* protruding rearwards from the rear plate 420, so that the end of the coupling cover circumferential portion 433*a* of the rear cover 430 can be inserted into the coupling support 424.

That is, the coupling support 424 can be defined between the plate coupling portion and the rear coupling circumferential portion 427*a* facing the plate coupling portion, and can extend in a longitudinal direction of the rear plate 420. The longitudinal direction of the rear plate 420 can be a direction from the bottom plate 147 to the top plate 145.

In addition, the coupling support 424 can include a plurality of coupling supports defined in the vicinity of the first side plate 1411 and in the vicinity of the second side plate 1413.

The coupling support 424 can accommodate the coupling cover circumferential portion 433*a* therein, so that the coupling cover circumferential portion 433*a* is stably fixed by the rear coupling circumferential portion 427*a* and the plate coupling portion.

Figure 12:
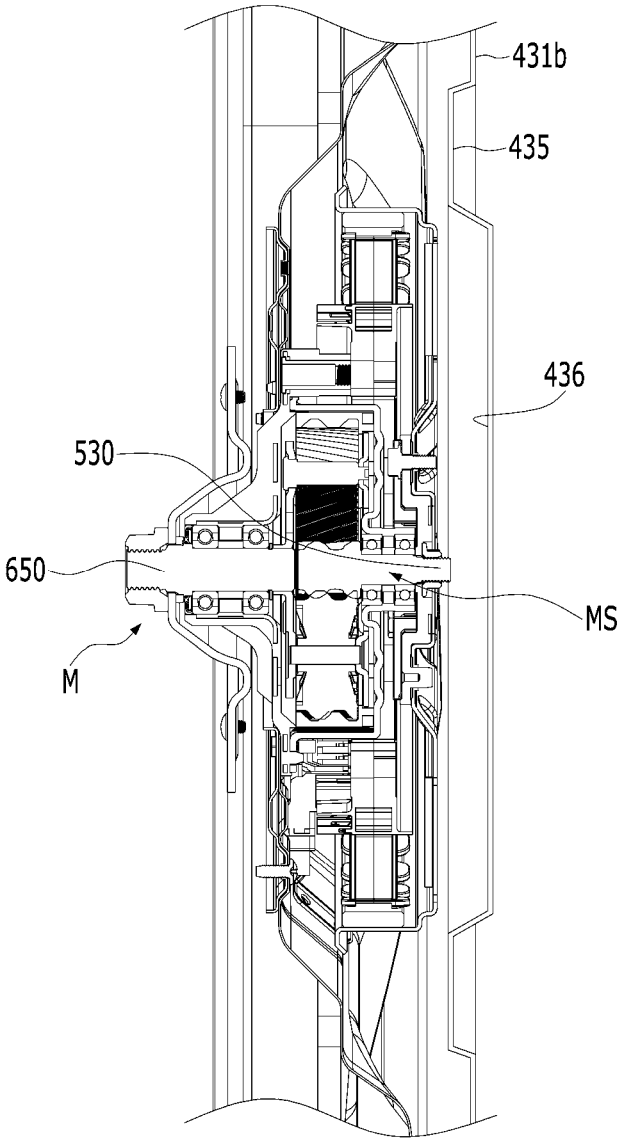
FIG. 12 is a cross-sectional view showing an example of a rear cover coupled to a rear plate.

In some examples, FIG. 12 is a cross-sectional view of a rear cover coupled to a rear plate.

Referring to FIG. 12, the rear cover 430 can include a driver rib 435.

The driver rib 435 can protrude toward the rear plate 420 from one surface of the rear cover 430. Specifically, the driver rib 435 can protrude from the front surface of the rear cover 430 to correspond to an outer circumference of the driver M and be disposed outwardly of the driver M. The driver rib 435 can be the most forwardly protruding portion of the front surface of the rear cover 430, and the front surface of the rear cover 430 can be the same as the cover shielding portion 431*b*.

That is, the driver rib 435 can cause a height difference in a front and rear direction of one surface of the rear cover 430 when viewed from the side, and can improve the structural rigidity of the rear cover 430.

In addition, referring to FIG. 9B together, the driver rib 435 can be configured to prevent contact between the duct 423 and the driver M.

As the driver M provides power to rotate the drum 200, even when the driver M is coupled to the rear plate 420, the vibration can occur. The duct 423 can be formed integrally with the rear plate 420 to vibrate together with the vibration of the driver M and the vibration of the drum 200.

The driver rib 435 can be disposed between the duct 423 and the driver M, and can be configured to be spaced apart from the duct 423 and the driver M to be prevented from contacting with the duct 423 and the driver M.

Specifically, the driver M can be surrounded by the flow inner circumferential portion 4231*b* of the duct 423, and the driver rib 435 can be disposed between the flow inner circumferential portion 4231*b* and the driver M. The driver rib 435 can have an outer circumferential surface spaced apart from the flow inner circumferential portion 4231*b* and an inner circumferential surface spaced apart from the driver M.

That is, the driver rib 435 can be prevented as much as possible from contacting the duct 423 and the driver M.

For example, the flow inner circumferential portion 4231*b* and the outer circumferential surface of the driver M can be formed in an annular shape, and the driver rib 435 can be formed in an annular shape and can be disposed between the flow inner circumferential portion 4231*b* and the driver M.

In some examples, referring back to FIG. 12, the rear cover 430 can include a cover accommodating portion 436 that is recessed to be away from the driver M from one surface of the rear cover 430. The cover accommodating portion 436 can prevent the driver M from contacting the rear cover 430. The above-described cover extension 433*b* can include the cover accommodating portion 436 and the driver rib 435.

The cover accommodating portion 436 can be recessed from one surface of the rear cover 430 facing the driver M, and said one surface of the rear cover 430 facing the driver M can be the front surface of the rear cover 430.

In addition, the cover accommodating portion 436 can be defined inwardly of the driver rib 435 and can be connected to the inner circumferential surface of the driver rib 435. The cover accommodating portion 436 can be recessed rearwards than one surface of the rear cover 430 positioned on outwardly of the driver rib 435.

In summary, the driver M can be a vibrating body disposed on the rear surface of the rear plate 420, and the cover accommodating portion 436 can be recessed to be away from the driver M to be prevented from contacting with the driver M as much as possible.

In some examples, referring to FIG. 10A and FIGS. 11A and 11B, the rear plate 420 can include a mounting portion 425 to which the driver M is coupled and seated.

The mounting portion 425 can be defined inwardly of the flow portion 4231, and can be surrounded by the flow portion 4231.

Specifically, the mounting portion 425 can include the mounting accommodating portion 4251 to which the driver M is coupled, and a mounting circumferential portion 4253 surrounding the mounting accommodating portion 4251 and connected to the flow inner circumferential portion 4231*b*.

The mounting accommodating portion 4251 can be defined at a center of the mounting portion 425, and can protrude frontwards more than the mounting circumferential portion 4253, so that the driver M can be accommodated into and coupled to the mounting accommodating portion 4251.

Specifically, the mounting accommodating portion 4251 can include a mounting surface 4251*a* to which the driver M is coupled, and a mounting hole 4255 passing through the mounting surface 4251*a*. The mounting hole 4255 can be connected to the drum rear surface 220 by being penetrated by the driver M. The mounting surface 4251*a* and the mounting hole 4255 can allow the driver M to be easily connected to the drum rear surface 220 and serve to support the driver M.

For example, the mounting hole 4255 can be formed in a circular shape at a center of the mounting surface 4251*a*, and the mounting surface 4251*a* can be formed in an annular shape by the mounting hole 4255.

The mounting circumferential portion 4253 can connect the mounting accommodating portion 4251 and the flow inner circumferential portion 4231*b* to each other, and can provide a separation distance between the driver M coupled to the mounting accommodating portion 4251 and the flow inner circumferential portion 4231*b*.

In some examples, the mounting accommodating portion 4251 can include a mounting connecting portion 4257 that extends rearwards from the mounting surface 4251*a* and is connected with the mounting circumferential portion 4253.

The mounting connecting portion 4257 can face the outer circumferential surface of the driver M, and can be prevented from contacting the driver M.

Specifically, the mounting connecting portion 4257 can extend to increase in diameter rearwardly in the mounting surface 4251*a*. The mounting connecting portion 4257 can protect the driver M from the external impact, and can be prevented as much as possible from contacting the driver M.

In summary, with respect to the mounting surface 4251*a*, the mounting connecting portion 4257 can be connected at a location radially outward of the mounting portion 425, the mounting circumferential portion 4253 can be connected at a location radially outward of the mounting connecting portion 4257, and the flow inner circumferential portion 4231*b* can be connected at a location radially outward of the mounting circumferential portion 4253.

The mounting accommodating portion 4251 can include mounting supports 4251*d* and 4251*e* that protrude rearwards from the mounting surface 4251*a*. For example, the mounting supports 4251*d* and 4251*e* can protrude rearwards such that a portion of the mounting surface 4251*a* is bent rearwards to define a space therein. The mounting supports 4251*d* and 4251*e* can increase the structural rigidity of the mounting surface 4251*a*, and can serve to guide coupling of a bracket that supports the coupling of the driver M.

Each of the mounting supports 4251*d* and 4251*e* can include a plurality of mounting supports radially spaced apart from each other to further increase structural rigidity of the mounting surface 4251*a*.

The mounting supports 4251*d* and 4251*e* can be formed in a shape corresponding to the mounting surface 4251*a*. For example, the mounting surface 4251*a* can be formed in an annular shape, and the mounting supports 4251*d* and 4251*e* can also be formed in an annular shape.

In addition, the mounting supports 4251*d* and 4251*e* can protrude except for a certain section such that a terminal of the stator 510 can be located. That is, the mounting supports 4251*d* and 4251*e* can be in an annular shape with one side open, and can extend in an arc shape. In some cases, where the terminal is located in the region that does not protrude from the mounting supports 4251*d* and 4251*e*, the stable coupling structure of the driver M can be implemented.

In addition, the mounting accommodating portion 4251 can include a wire support 4251*c* disposed in the mounting connecting portion 4257.

Specifically, the wire support 4251*c* can face the region of the mounting surface 4251*a* where the terminal is located and the mounting supports 4251*d* and 4251*e* are not formed, and can guide the wire to the terminal while preventing interference of the wire with other components.

The wire support 4251*c* can protrude from the mounting connecting portion 4257, and can include a hole through which the wire can pass. The hole can have a length equal to or greater than a predetermined length, so that the wire can be more strongly supported.

The wire support 4251*c* can be formed integrally with the rear plate 420, or can be manufactured separately and coupled to the rear plate 420. For example, FIGS. 11A to 11C show that the wire support 4251*c* is separately manufactured and coupled to the rear plate 420 through a fastening member.

Figure 13A:
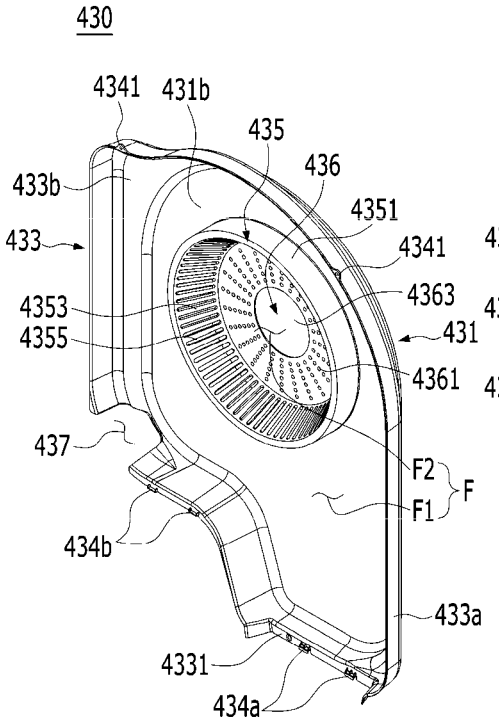
FIGS. 13A to 14B are views showing an example of a driver rib of a rear cover.
Figure 13B:
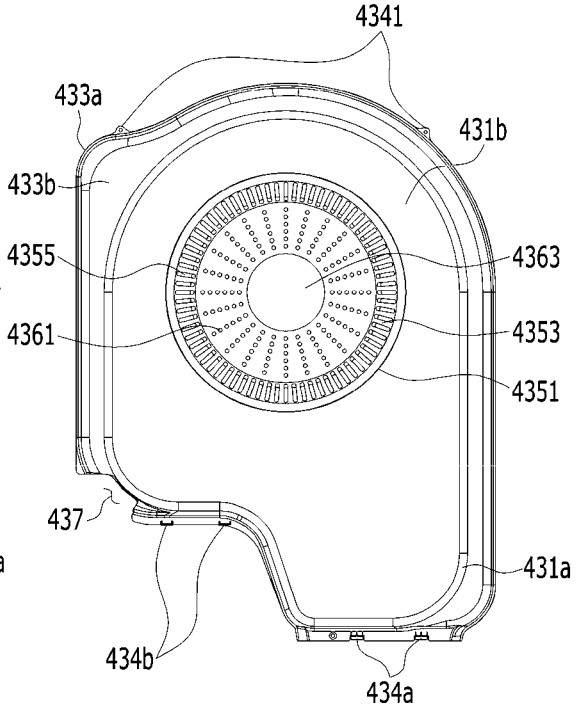
Figure 14A:
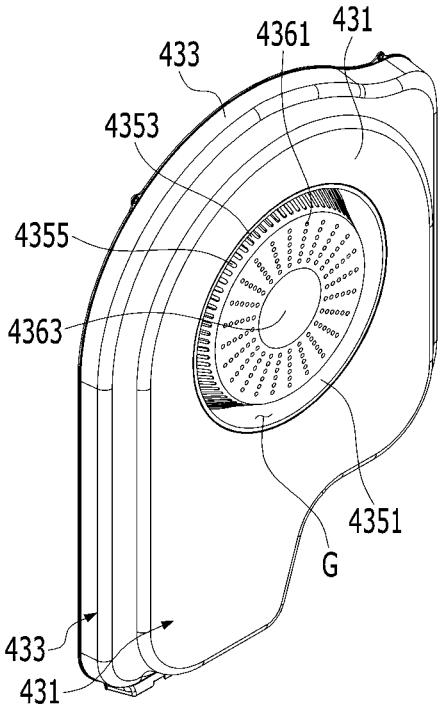
Figure 14B:
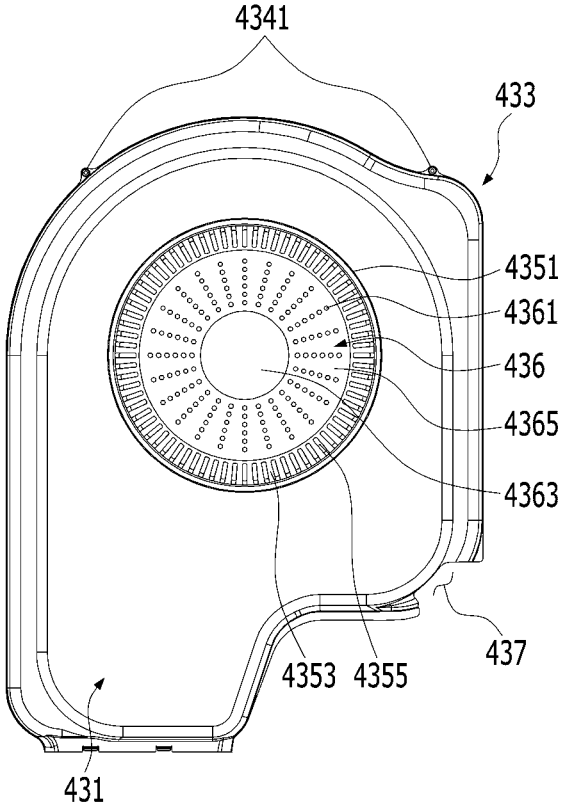

In some examples, FIGS. 13A to 14B are views showing an example of a driver rib of a rear cover. Specifically, FIG. 13A is a front perspective view of the driver rib of the rear cover, and FIG. 13B is a front view of the driver rib. FIG. 14A is a rear perspective view of the driver rib of the rear cover, and FIG. 14B shows a rear view of the driver rib.

As described above, the protruding length of the driver rib can vary. FIGS. 9A, 9B, and 12 show that the protruding length of the driver rib is smaller than an overall length of the driver, and FIGS. 13A to 14B show that, as the protruding length of the driver rib corresponds to the overall length of the driver, the driver is entirely covered by the driver rib.

As shown in FIGS. 13A to 14B, the driver rib 435 can have a protruding length corresponding to the length of the driver M, and can be configured to surround the driver M to protect the driver M from the external impact.

The driver rib 435 can protrude frontwards from the cover shielding portion 431*b* to face the mounting portion 425, and can be configured to surround the driver M. Specifically, the driver rib 435 can have an end facing the mounting circumferential portion 4253, and can have an inner circumferential surface spaced apart from the outer circumferential surface of the driver M and surrounding the outer circumferential surface of the driver M.

That is, when an impact is applied from the outside, the end of the driver rib 435 can come into contact with the mounting circumferential portion 4253 to support the entire rear cover 430, and the driver rib 435 can prevent the rear cover 430 from contacting the driver M.

The driver M provides the power to rotate the drum 200 by rotating directly. Thus, when the driver M comes into contact with the rear cover 430, serious damage can occur. The driver rib 435 can preferentially come into contact with the mounting circumferential portion 4253 even when the external impact is applied thereto, thereby preventing the contact between the driver M and the rear cover 430 in advance.

The driver rib 435 can be configured such that the end thereof comes into contact with the mounting circumferential portion 4253 even when there is no external impact, or is spaced apart from the mounting circumferential portion 4253 and comes into contact with the mounting circumferential portion 4253 when a degree of the external impact is equal to or greater than a certain degree.

For example, FIGS. 14A and 14B show that the end of the driver rib 435 is in contact with the mounting circumferential portion 4253 even when there is no external impact. However, the present disclosure is not limited thereto.

Figure 15:
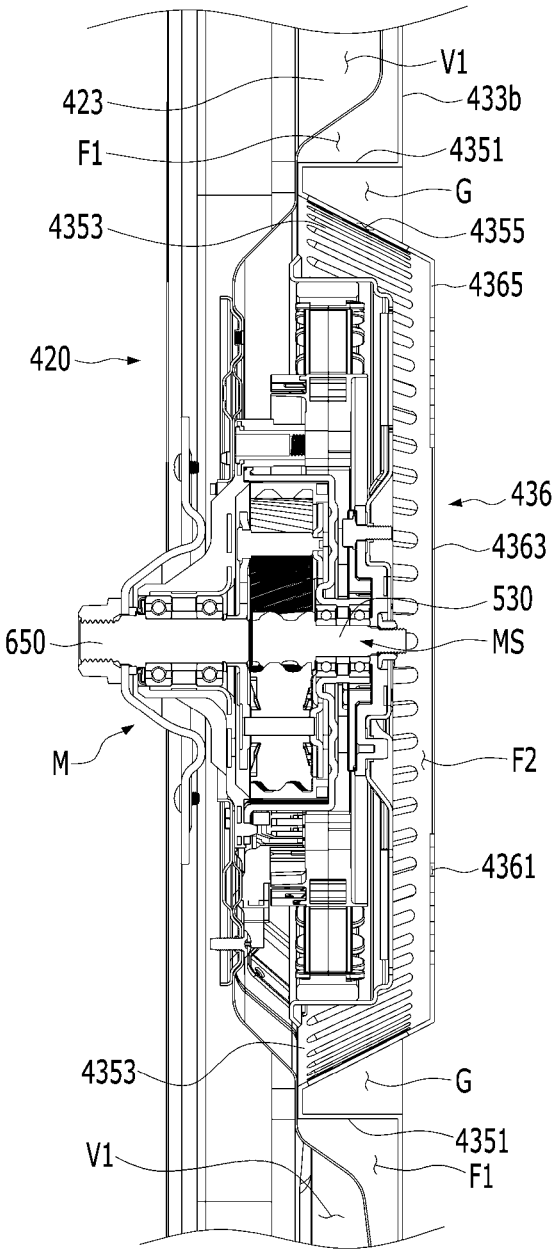
FIG. 15 is a cross-sectional view in which a rear cover according to FIGS. 13A to 14B is coupled to a rear plate.

In some examples, FIG. 15 is a cross-sectional view in which a rear cover according to FIGS. 13A to 14B is coupled to a rear plate.

Referring to FIGS. 13A, 13B, and 15, the driver rib 435 can divide the driver M and the flow portion 4231 of the duct 423 from each other.

As described above, the driver M can generate heat by itself by the rotation, and the flow portion 4231 can be heated by hot air flowing therein. For the flow portion 4231, it can be advantageous in terms of the drying efficiency to prevent the heat from being emitted to the outside. For the driver M, it can be advantageous for smooth operation to prevent the heat from being introduced from the outside.

That is, the driver rib 435 can divide the driver M and the flow portion 4231 from each other to maximally suppress the transfer of the heat that can be emitted from the flow portion 4231 to the driver M.

Specifically, the driver rib 435 can have the end positioned at the rear of the mounting circumferential portion 4253 to divide the flow portion 4231 and the driver M from each other.

That is, the rear cover 430 can have a placement space F in which the duct 423 and the driver M can be disposed therein, and the end of the driver rib 435 can be in contact with the mounting circumferential portion 4253 to divide the placement space F into a first placement space F1 in which the flow portion 4231 is placed and a second placement space F2 in which the driver M is placed.

The first placement space F1 can be defined outwardly of the driver rib 435, and the second placement space F2 can be defined inwardly of the driver rib 435.

Specifically, the first placement space F1 can be defined by the rear surface of the rear plate 420, the duct cover circumferential portion 431*a* of the rear cover 430, the cover shielding portion 431*b* of the rear cover 430, and the outer circumferential surface of the driver rib 435. The second placement space F2 can be defined by the rear surface of the rear plate 420, the cover shielding portion 431*b* of the rear cover 430, and the inner circumferential surface of the driver rib 435.

That is, in some implementations, the driver rib 435 can suppress heat exchange between the first placement space F1 and the second placement space F2 by dividing the first placement space F1 and the second placement space F2 from each other.

In addition, referring to FIGS. 14A and 14B, the driver rib 435 can have a heat dissipation space G defined therein. The heat dissipation space G can be a space for dissipating the heat generated by the driver M to the outside.

The driver rib 435 can have the heat dissipation space G defined therein, and can have an open rear surface.

Specifically, the driver rib 435 can include a rib inner circumferential portion 4353 surrounding the heat dissipation space G from the inside and a rib outer circumferential portion 4351 surrounding the heat dissipation space G from the outside, and the heat dissipation space G can be defined between the rib inner circumferential portion 4353 and the rib outer circumferential portion 4351. The rib inner circumferential portion 4353 can be an inner circumferential surface of the driver rib 435, and the rib outer circumferential portion 4351 can be an outer circumferential surface of the driver rib 435.

The rib inner circumferential portion 4353 can extend so as to increase in diameter forwardly from the rear cover 430 to prevent contact with the driver M or can extend with a constant diameter.

The rib outer circumferential portion 4351 can extend so as to decrease in diameter forwardly from the rear cover 430 to prevent contact with the duct 423 or can extend with a constant diameter.

For example, FIGS. 14A and 14B show that the rib inner circumferential portion 4353 extends to increase in diameter forwardly from the rear cover 430, and the rib outer circumferential portion 4351 extends forwardly from the rear cover 430 with the constant diameter. However, the present disclosure may not be limited thereto, and the diameters of the rib inner circumferential portion 4353 and the rib outer circumferential portion 4351 can be variously set through an arrangement relationship between the duct 423 and the driver M and the like.

The heat dissipation space G can be divided from the first placement space F1 and the second placement space F2 through the driver rib 435. The heat dissipation space G can be divided from the first placement space F1 through the rib outer circumferential portion 4351, and can be divided from the second placement space F2 through the rib inner circumferential portion 4353.

The heat dissipation space G can promote heat exchange between the second placement space F2 in which the driver M is disposed and the outside through the rib inner circumferential portion 4353 facing the driver M.

In addition, the driver rib 435 can include a rib slit 4355 for communicating the mounting portion 425 and the heat dissipation space G to each other.

The rib slit 4355 can be defined in the rib inner circumferential portion 4353 to communicate the second placement space F2 and the heat dissipation space G to each other, and can emit the heat generated by the driver M to the outside. In addition, the rib slit 4355 may not be defined in the rib outer circumferential portion 4351 to prevent the heat of the first placement space F1 from being emitted to the outside.

The rib slit 4355 can extend along a protrusion direction of the driver rib 435, and can include a plurality of rib slits spaced apart from each other along a circumference of the rib inner circumferential portion 4353, so that an area in which the second placement space F2 and the heat dissipation space G communicate with each other can be sufficiently secured, and thus, the heat exchange with the outside can more actively occur.

For example, in FIGS. 13A and 13B, the rib slit 4355 is shown in a slit shape. However, the present disclosure may not be limited thereto, and the rib slit 4355 can be formed in various shapes in consideration of the shape of the driver rib 435, the separation distance between the driver M and the rib inner circumferential portion 4353, and a degree of heat generation of the driver M.

In addition, the rib slits 4355 can be spaced apart from each other at an equal spacing along the circumference of the rib inner circumferential portion 4353, so that it is possible to prevent the structural rigidity of the entire driver rib 435 from being reduced as much as possible while sufficiently securing a communication area between the second placement space F2 and the outside.

In addition, referring to FIGS. 13A to 14B, the rear cover 430 can include a heat dissipation hole 4361 for communicating the mounting portion 425 and the outside to each other.

That is, the heat dissipation hole 4361 can communicate the second placement space F2 with the outside to discharge the heat generated from the driver M to the outside.

Specifically, the heat dissipation hole 4361 can be defined in the cover accommodating portion 436 connected to the rib inner circumferential portion 4353, and can be defined alone or together with the above-described rib slit 4355.

The heat dissipation hole 4361 can directly communicate the outside and the second placement space F2 to each other without via the heat dissipation space G to emit the heat of the second placement space F2 to the outside, and can include a plurality of heat dissipation holes to sufficiently secure the communication area between the second placement space F2 and the outside. The heat dissipation hole 4361 will be described later in detail.

In some examples, the cover accommodating portion 436 can include a cover recessed portion 4363 that is recessed to be away from the driver M from one surface of the cover accommodating portion 436.

The cover recessed portion 4363 can be recessed to be away from the rearwardly protruding portion of the front surface of the cover accommodating portion 436 to correspond to the rearwardly protruding portion of the driver M, thereby maximally preventing contact with the driver M.

Specifically, the driver M can include a drive rotation shaft MS that passes through the mounting accommodating portion 4251 of the mounting portion 425 to be coupled to the drum rear surface 220, and the drive rotation shaft MS can extend from one end thereof coupled to the drum rear surface 220 to the other end thereof facing the cover accommodating portion 436. The drive rotation shaft MS can include the drum rotating shaft 650 of the reducer 600 and the drive shaft 530 of the motor 500 to be described later.

The other end of the drive rotation shaft MS can face the cover accommodating portion 436, and the other end can protrude more rearwards than other portions of the driver M, so that the cover recessed portion 4363 can be recessed rearwards at a position corresponding to the drive rotation shaft MS to prevent contact with the drive rotation shaft MS as much as possible.

For example, FIG. 15 shows that the drive rotation shaft MS is disposed at the center of the driver M, and the cover recessed portion 4363 is disposed at the center of the cover accommodating portion 436 to correspond thereto.

In addition, the cover accommodating portion 436 can have a heat dissipation hole 4361 defined in a region except for the cover recessed portion 4363. That is, the cover accommodating portion 436 can further include a cover heat dissipation portion 4365 surrounding the cover recessed portion 4363, and the heat dissipation hole 4361 can be defined in the cover heat dissipation portion 4365.

The cover heat dissipation portion 4365 can be connected to the rib inner circumferential portion 4353 of the driver rib 435, and can protrude frontwards relative to the cover recessed portion 4363 as the cover recessed portion 4363 is recessed rearwards or can protrude frontwards from one surface of the cover accommodating portion 436.

The driver M can have a plurality of slits capable of dissipating heat along the circumferential direction of the driver M defined in one surface thereof facing the cover heat dissipation portion 4365, and the heat dissipation hole 4361 can be defined in the cover heat dissipation portion 4365 to more efficiently dissipate the heat of the driver M to the outside.

The heat dissipation hole 4361 can include a plurality of heat dissipation holes that can be spaced apart from each other along the radial direction or the circumferential direction of the cover heat dissipation portion 4365, thereby more efficiently discharging the heat of the driver M.

In addition, in the cover heat dissipation portion 4365, concentration of the definition of the heat dissipation holes 4361 in a certain portion can be prevented, so that reduction in structural rigidity by the heat dissipation hole 4361 can be minimized.

For example, in FIGS. 13A to 14B, the cover recessed portion 4363 is shown in a circular shape at the center of the cover accommodating portion 436, the cover heat dissipation portion 4365 is shown in an annular shape surrounding the cover recessed portion 4363 and connected to the rib inner circumferential portion 4353, and the heat dissipation hole 4361 is shown to be defined in the cover heat dissipation portion 4365 in a radial shape. That is, because the heat dissipation holes 4361 are evenly spaced apart from each other throughout the cover heat dissipation portion 4365, reduction in structural rigidity of the entire cover accommodating portion 436 can be prevented as much as possible.

Figure 16:
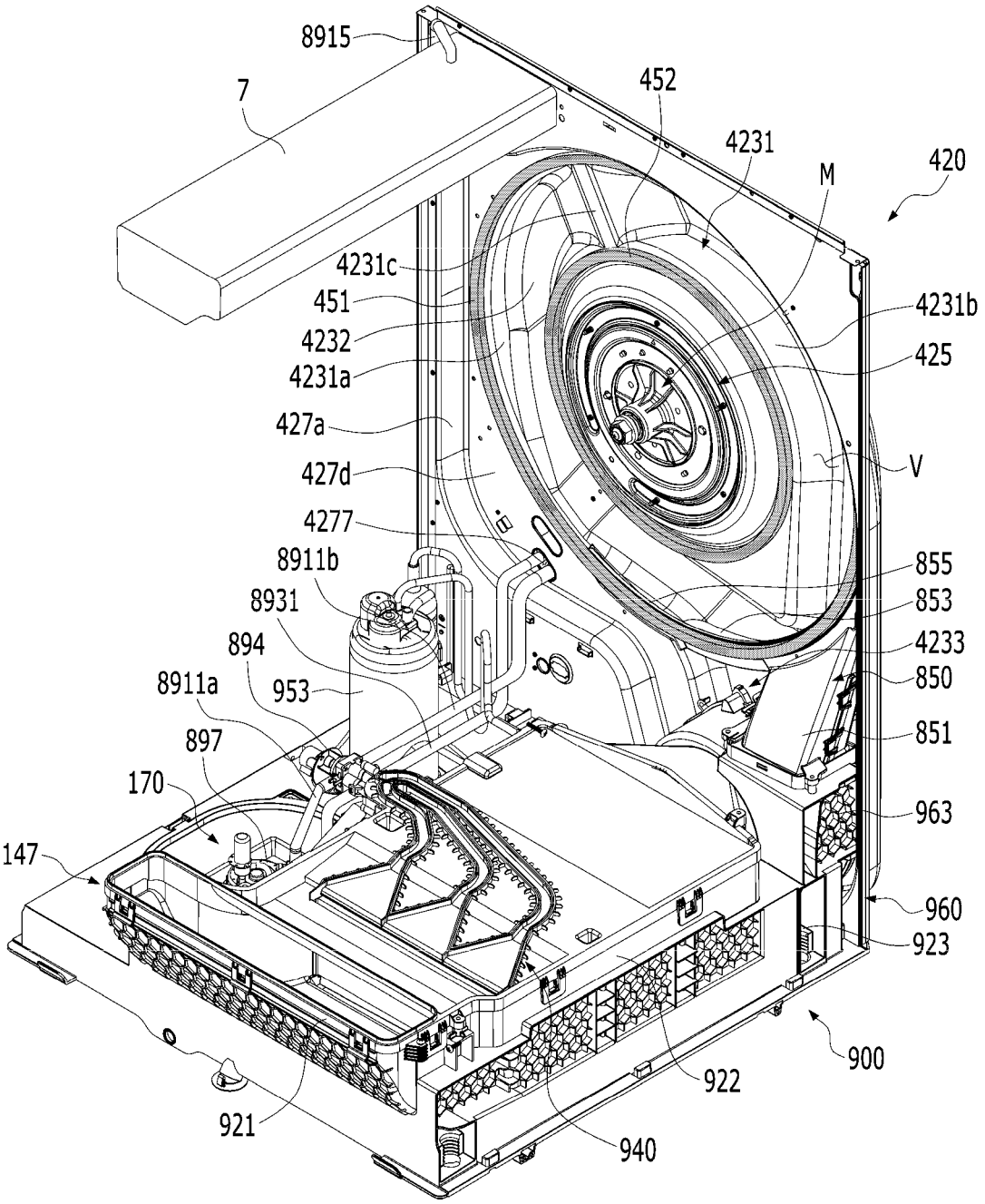
FIG. 16 is a view showing a water storage, a drain pipe, and a return pipe.

In some examples, FIG. 16 is a view showing a water storage, a drain pipe, and a return pipe.

The laundry treating apparatus 10 can include a drainage 890 for guiding the condensed water of the water collector 170 to the water storage 7.

As described above, the laundry treating apparatus 10 can include the evaporator 951 that removes the water vapor from the hot air discharged from the drum 200, the water collector 170 into which the condensed water formed in the evaporator 951 is introduced and stored, and the water storage 7 configured to receive and store the condensed water stored in the water collector 170, and can further include a drainage 890 for connecting the water collector 170 and the water storage 7 to each other to guide the condensed water of the water collector 170 to the water storage 7. The evaporator 951 can refer to a water vapor remover that removes the water vapor.

The drainage 890 can include a drain pipe 891 for connecting the water collector 170 and the water storage 7 to each other, and a drain pump 897 that provides power to flow the condensed water of the water collector 170 to the water storage 7.

The drain pipe 891 can provide a flow path along which the condensed water of the water collector 170 carried by the drain pump 897 is guided to the water storage 7. The drain pipe 891 can be formed as a rubber hose, a pipe, or the like. For convenience of description, water of the water collector 170 can be used as the same meaning as the condensed water.

Referring to FIGS. 11A to 11C together, the drain pipe 891 can be configured such that at least a portion thereof is exposed to the outside.

Specifically, the drain pipe 891 can extend to the outside through the rear plate 420 from the water collector 170, extend along the rear surface of the rear plate 420 at the outside, and be connected to the water storage 7 through the rear plate 420 again.

As described above, because the water collector 170 can be disposed on the bottom plate 147 and the water storage 7 can be disposed on the top plate 145, the drain pipe 891 can extend toward the top plate 145 at the outside from the water collector 170 through one side of the rear plate 420 close to the bottom plate 147, and can be connected to the water storage 7 again through the other side of the rear plate 420 close to the top plate 145.

The water collector 170 and the water storage 7 can be disposed inside the cabinet 100, and the drain pipe 891 can be at least partially exposed to the outside of the rear plate 420, so that a usable space inside the cabinet 100 can be increased.

For example, as at least a portion of the drain pipe 891 is exposed to the outside, the drum 200 can be expanded in size than that in the case in which the drain pipe 891 is disposed only inside the cabinet 100, so that the laundry accommodating capacity can be increased.

From another point of view, it can be understood that, by maximizing the drum 200 inside the cabinet 100 and placing the portion of the drain pipe 891 outside the cabinet 100 where there is insufficient free space, utilization of the space inside the cabinet 100 is increased.

More specifically, the drain pipe 891 can include a water collecting drain pipe 8911 extending from the water collector 170 to the outside through the rear plate 420, a drain exposed pipe 8913 extending along the rear surface of the rear plate 420 from the water collecting drain pipe 8911, and a reservoir drain pipe 8915 connected to the water storage 7 through the rear plate 420 from the drain exposed pipe 8913.

The water collecting drain pipe 8911, the drain exposed pipe 8913, and the reservoir drain pipe 8915 can be separately manufactured and coupled to each other or can be integrally manufactured to form a single pipe. That is, the drain pipe 891 can include the water collecting drain pipe 8911, the drain exposed pipe 8913, and the reservoir drain pipe 8915, and the water collecting drain pipe 8911, the drain exposed pipe 8913, and the reservoir drain pipe 8915 can form the drain pipe 891 together.

In some examples, in the drain pipe 891, the water collecting drain pipe 8911, the drain exposed pipe 8913, and the reservoir drain pipe 8915 can be sequentially disposed. For example, in the drain pipe 891, based on the water collector 170, the water collecting drain pipe 8911, the drain exposed pipe 8913, and the reservoir drain pipe 8915 can be sequentially connected to each other.

That is, the water of the water collector 170 can be guided to the water storage 7 by sequentially flowing through the water collecting drain pipe 8911, the drain exposed pipe 8913, and the reservoir drain pipe 8915.

In some examples, the drain exposed pipe 8913 can extend along the outer circumferential surface of the duct 423 and can extend to be in contact with the outer circumferential surface of the duct 423 or the inner circumferential surface of the rear cover 430, so that the drain exposed pipe 8913 can be supported by the outer circumferential surface of the duct 423 or the inner circumferential surface of the rear cover 430.

Specifically, the drain exposed pipe 8913 can extend so as to be in contact with both the flow outer circumferential portion 4231*a* and the coupling cover circumferential portion 433*a* at a location between the flow outer circumferential portion 4231*a* of the duct 423 and the coupling cover circumferential portion 433*a*, so that the position of the drain exposed pipe 8913 can be fixed.

In some examples, the drain pump 897 of the drainage 890 can transport the water of the water collector 170 to the water storage 7, and a portion connected to the water storage 7 of the reservoir drain pipe 8915 of the drain pipe 891 can be located above the water storage 7 to supply the water to an upper portion of the water storage 7, so that, even when the operation of the drain pump 897 is stopped, the water of the water storage 7 can be prevented from flowing back into the water collector 170 through the reservoir drain pipe 8915.

For example, FIG. 16 shows that the reservoir drain pipe 8915 extends from the interior of the cabinet 100 toward the top plate 145, extends such that a portion thereof is in parallel with the top plate 145, and is formed in a shape bent downwards to be connected to the upper portion of the water storage 7 again.

In some examples, referring back to FIG. 16, the laundry treating apparatus 10 can include a return pipe 893 for guiding the water stored in the water storage 7 to the water collector 170.

When the water stored in the water storage 7 is filled to have a water level equal to or higher than a certain vertical level, the return pipe 893 can guide the water stored in the water storage 7 to the water collector 170 to prevent overflow of the water of the water storage 7. That is, the return pipe 893 can be a kind of overflow pipe.

The return pipe 893 can be configured to be partially exposed to the outside like the drain pipe 891, and can increase the space that can be utilized inside the cabinet 100.

The return pipe 893 can extend outwardly through the rear plate 420 from the water storage 7, can extend along the rear surface of the rear plate 420 at the outside, and can be connected to the water collector 170 through the rear plate 420 again.

As described above, because the water collector 170 can be disposed on the bottom plate 147 and the water storage 7 can be disposed on the top plate 145, the return pipe 893 can extend from the water storage 7 toward the bottom plate 147 at the outside through the other side of the rear plate 420 close to the top plate 145, and can be connected to the water collector 170 again through one side of the rear plate 420 close to the bottom plate 147.

Specifically, the return pipe 893 can include a reservoir return pipe 8935 extending from water storage 7 to the outside through the rear plate 420, a return exposed pipe 8933 extending along the rear surface of the rear plate 420 from the reservoir return pipe 8935, and a water collecting return pipe 8931 connected to the water collector 170 through the rear plate 420 from the return exposed pipe 8933.

The water collecting return pipe 8931, the return exposed pipe 8933, and the reservoir return pipe 8935 can be separately manufactured and coupled to each other or can be formed integrally to form a single pipe. That is, the return pipe 893 can include the water collecting return pipe 8931, the return exposed pipe 8933, and the reservoir return pipe 8935, and the water collecting return pipe 8931, the return exposed pipe 8933, and the reservoir return pipe 8935 can form the return pipe 893 together.

In some examples, in the return pipe 893, the reservoir return pipe 8935, the return exposed pipe 8933, and the water collecting return pipe 8931 can be sequentially disposed. For example, in the return pipe 893, based on the water storage 7, the reservoir return pipe 8935, the return exposed pipe 8933, and the water collecting return pipe 8931 can be sequentially connected.

That is, the water of the water storage 7 can be guided to the water collector 170 by sequentially flowing through the reservoir return pipe 8935, the return exposed pipe 8933, and the water collecting return pipe 8931.

For example, the return exposed pipe 8933 can extend from the rear surface of the rear plate 420, and can be prevented from interfering with the flow portion 4231 defined in the rear plate 420 in an annular shape. The flow portion 4231 can be further extended to both side surfaces of the rear plate 420.

In addition, the return exposed pipe 8933 can extend along the outer circumferential surface of the duct 423 together with the drain exposed pipe 8913. Specifically, one of the return exposed pipe 8933 and the drain exposed pipe 8913 can be extended to be in contact with the flow outer circumferential portion 4231*a*, and the other can be extended to be in contact with the coupling cover circumferential portion 433*a*, so that the return exposed pipe 8933 and the drain exposed pipe 8913 can be entirely supported by the flow outer circumferential portion 4231*a* and the coupling cover circumferential portion 433*a* at a location between the flow outer circumferential portion 4231*a* and the coupling cover circumferential portion 433*a*.

However, the external discharge pipe 895 to be described later can be disposed on the drain exposed pipe 8913, the drain exposed pipe 8913 can be configured to be in contact with the coupling cover circumferential portion 433*a* such that the external discharge pipe 895 can be easily disposed, and the return exposed pipe 8933 can be configured to be in contact with the flow outer circumferential portion 4231*a* to correspond thereto.

In some examples, referring back to FIGS. 11A to 11C and 16, the drain pipe 891 and the return pipe 893 can extend to the outside through the rear plate 420 together.

Specifically, the rear plate 420 can include a water collecting connection hole 4277 defined through one surface of the rear plate 420, and a water storage connection hole 4725 that is spaced apart from the water collecting connection hole 4277 and penetrates one surface of the rear plate 420.

The water collecting connection hole 4277 can be extended to the outside from the water collector 170 through the water collecting drain pipe 8911 and the water collecting return pipe 8931 together, and the water storage connection hole 4725 can be extended to the outside from the water storage 7 through the reservoir drain pipe 8915 and the reservoir return pipe 8935 together, so that it can be easy for the drain exposed pipe 8913 and the return exposed pipe 8933 to be in contact with each other and extend along the outer circumferential surface of duct 423 together.

The water collecting connection hole 4277 can support the water collecting drain pipe 8911 and the water collecting return pipe 8931 together to be in contact with each other, and the water storage connection hole 4725 can be support the reservoir drain pipe 8915 and the reservoir return pipe 8935 together to be in contact with each other.

That is, the water collecting drain pipe 8911 and the water collecting return pipe 8931 can be in contact with each other and can be supported together in contact with the interior of the water collecting connection hole 4277, and the reservoir drain pipe 8915 and the reservoir return pipe 8935 can also be in contact with each other and can be supported together in contact with the interior of the water storage connection hole 4725. Accordingly, the drain pipe 891 and the return pipe 893 can be fixed to the rear plate 420 even when the drain exposed pipe 8913 and the return exposed pipe 8933 are respectively disposed outwardly thereof.

In addition, it can be convenient in terms of manufacturing and penetration of the rear plate 420 can be reduced when, in the rear plate 420, the water collecting drain pipe 8911 and the water collecting return pipe 8931 penetrate the water collecting connection hole 4277 together compared to a case in which holes respectively penetrated by the water collecting drain pipe 8911 and the water collecting return pipe 8931 are defined separately. The same effect can be obtained as the reservoir drain pipe 8915 and the reservoir return pipe 8935 penetrate the water storage connection hole 4725 together.

In some examples, referring back to FIGS. 11A to 11C, the water collecting connection hole 4277 and the water storage connection hole 4725 can be defined in the rear cover coupling portion 427.

The water collecting connection hole 4277 and the water storage connection hole 4725 can penetrate the rear cover coupling portion 427 and be spaced apart from the duct 423, and the drain pipe 891 and the return pipe 893 respectively penetrating the water collecting connection hole 4277 and the water storage connection hole 4275 can be prevented from interfering with the duct 423 through which the hot air flows.

Specifically, the rear cover coupling portion 427 can include a flow cover extension 4279 in which the water collecting connection hole 4277 and the water storage connection hole 4725 are defined.

The rear cover coupling portion 427 can include the flow cover coupling portion 4278 defined in a shape corresponding to the flow portion 4231, and the flow cover extension 4279 extending to be away from the flow portion 4231 from the flow cover coupling portion 4278.

Specifically, the flow portion 4231 can be defined in an annular shape, and the flow cover coupling portion 4278 can be defined in an annular shape. The flow cover extension 4279 can extend to be away from the flow cover coupling portion 4278 in a radial direction of the flow portion 4231.

As the water collecting connection hole 4277 and the water storage connection hole 4725 are defined in the flow cover extension 4279, the water collecting connection hole 4277 and the water storage connection hole 4725 can be spaced apart from the flow portion 4231 as much as possible. The drain pipe 891 and the return pipe 893 respectively penetrating the water collecting connection hole 4277 and the water storage connection hole 4275 can be further prevented from interfering with the flow portion 4231 in which the hot air flows.

In addition, the flow cover extension 4279 can include a water collecting extension 4279*a* extending in the radial direction of the flow portion 4231 from the flow cover coupling portion 4278 toward the bottom plate 147, and a water storage extension 4279*b* extending in the radial direction of the flow portion 4231 from the flow cover coupling portion 4278 toward the top plate 145.

The water collecting extension 4279*a* can extend downwards from one side of the flow cover coupling portion 4278 close to the bottom plate 147, and the water storage extension 4279*b* can extend upwards from the other side of the flow cover coupling portion 4278 close to the top plate 145.

The water collecting connection hole 4277 can be defined in the water collecting extension 4279*a* to be spaced apart from the flow portion 4231 as much as possible and positioned to be close to the water collector 170, and the water storage connection hole 4725 can be defined in the water storage extension 4279*b* to be spaced apart from the flow portion 4231 as much as possible and positioned to be close to the water storage 7.

Accordingly, a distance of the water collecting connection hole 4277 from the water collector 170 can be minimized, and overall lengths of the water collecting drain pipe 8911 and the water collecting return pipe 8931 can be reduced, which can be advantageous in terms of manufacturing, and can be advantageous in terms of the arrangement for preventing interference with other components inside the cabinet 100.

In addition, a distance of the water storage connection hole 4275 from the water collector 170 can be minimized, and overall lengths of the reservoir drain pipe 8915 and the reservoir return pipe 8935 can be reduced, which can be advantageous in terms of manufacturing, and can be advantageous in terms of the arrangement for preventing interference with other components inside the cabinet 100.

In some examples, the water collecting connection hole 4277 and the water storage connection hole 4725 can be defined closer to the other side surface of the both side surfaces of the cabinet 100.

As described above, the hot air flow channel 920 of the hot air supply 900 can be disposed closer to one side surface of the both side surfaces of the cabinet 100, and the water collector 170 and the water storage 7 can be disposed closer to the other side surface of the both side surfaces of the cabinet 100, so that the water collecting connection hole 4277 and the water storage connection hole 4725 can be defined closer to the other side surface of the both side surfaces of the cabinet 100. One side surface of the cabinet 100 can be the first side plate 1411, and the other side surface of the cabinet 100 can be the second side plate 1413.

That is, the water collecting connection hole 4277 and the water storage connection hole 4725 can be defined close to the second side plate 1413 among the side plates 141 of the cabinet 100 to minimize a connection length of the drain pipe 891 and the return pipe 893 connecting the water collector 170 and the water storage 7 to each other and minimize interference of the drain pipe 891 and the return pipe 893 with the hot air flow channel 920.

The above-described flow cover extension 4279 can be extended from the flow cover coupling portion 4278 toward the second side plate 1413 when viewed from another perspective.

That is, both the water collecting extension 4279*a* and the water storage extension 4279*b* can extend toward the second side plate 1413 from the flow cover coupling portion 4278, and both the water collecting connection hole 4277 defined in the water collecting extension 4279*a* and the water storage connection hole 4725 defined in the water storage extension 4279*b* can be located close to the second side plate 1413.

In addition, the water collecting extension 4279*a* and the water storage extension 4279*b* can extend to a side plate coupling portion coupled to the second side plate 1413 of the rear plate 420, and the coupling support 424 can be defined between the flow cover coupling portion 4278 and the side plate coupling portion described above. That is, the water collecting extension 4279*a* and the water storage extension 4279*b* can provide a stronger coupling force to the rear cover 430 by increasing a length of the coupling support 424.

Figures 17A, 17B, 17C:
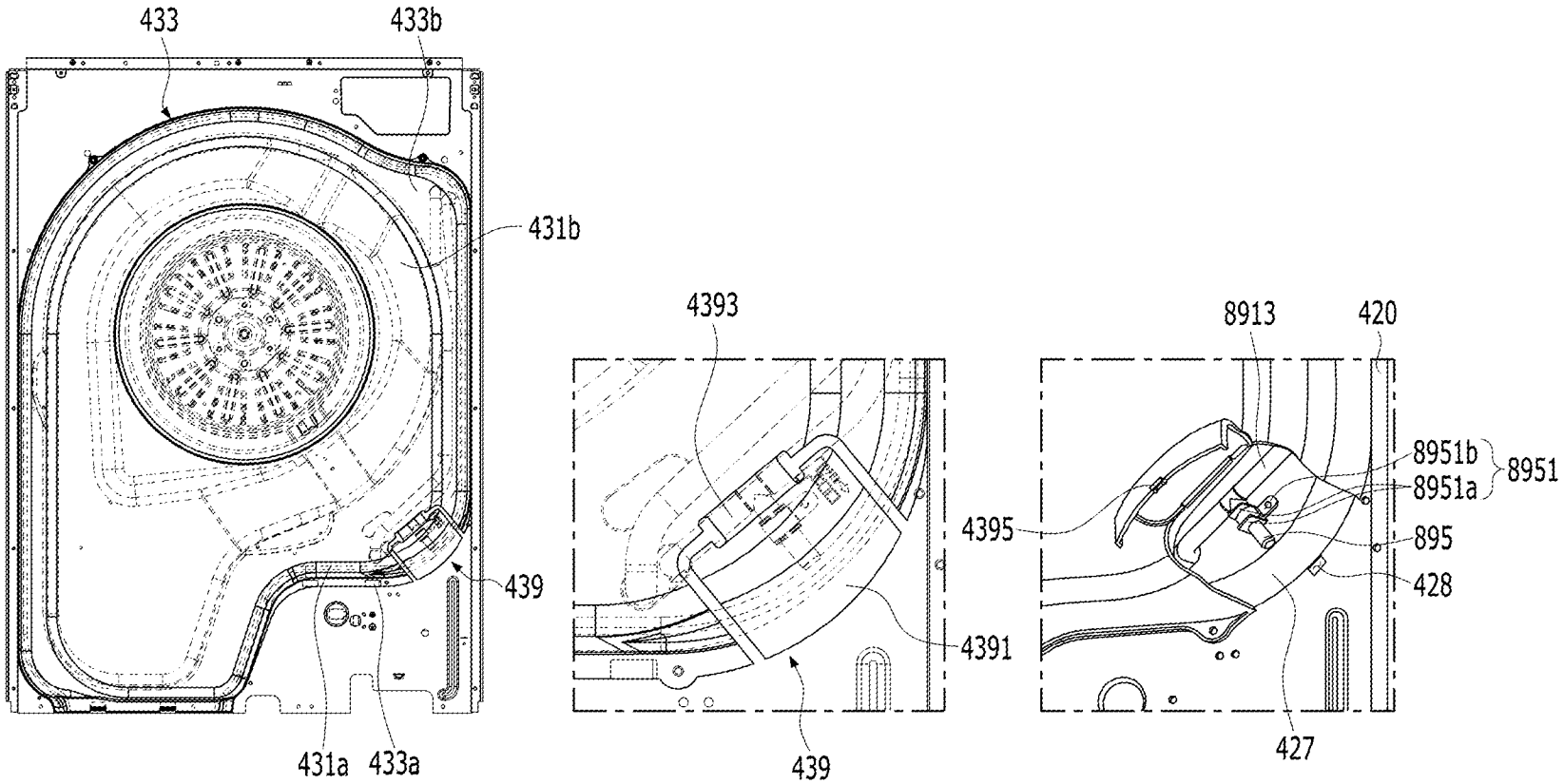
FIGS. 17A to 17C are views showing an example of a rear cover and a cover door configured to cover a drain pipe and a return pipe.

In some examples, FIGS. 17A to 17C are views showing an example of a rear cover and a cover door configured to cover a drain pipe and a return pipe.

Referring back to FIGS. 17A to 17C, the drain pipe 891 can include the external discharge pipe 895 configured to discharge the water of the water collector 170 to the outside.

The external discharge pipe 895 can be disposed on the drain exposed pipe 8913 of the drain pipe 891 exposed to the outside.

As the external discharge pipe 895 is disposed on the drain exposed pipe 8913 of the drain pipe 891, the laundry treating apparatus 10 can be configured such that the water of the water collector 170 is directly discharged to the outside by the external discharge pipe 895 without a separate work of the user instead of draining the water of the water collector 170 guided to the water storage 7 by directly withdrawing, by the user, the water storage tank.

Specifically, the external discharge pipe 895 can be disposed on the drain exposed pipe 8913 located close to the water collecting connection hole 4277 as the water transported by the drain pump 897 is discharged to the outside, and a distance at which the drain pump 897 guides the water of the water collector 170 to the external discharge pipe 895 can be minimized to reduce or prevent waste of energy of the drain pump 897.

The external discharge pipe 895 can be connected to a sewer through a separate hose or the like. One end of the external discharge pipe 895 can be connected to the drain exposed pipe 8913 such that the separate hose or the like can be easily disposed and coupled, and the other end thereof can be disposed to face the side plate 141.

For example, FIGS. 17A to 17C show that the drain exposed pipe 8913 extends along the rear surface of the rear plate 420 at a position closer to the second side plate 1413 than to the first side plate 1411, and the external discharge pipe 895 is disposed adjacent to the second side plate 1413 and has the other end thereof extending toward the second side plate 1413 to discharge the water flowing through the drain exposed pipe 8913.

The external discharge pipe 895 can be formed integrally with the drain exposed pipe 8913 and branched from the drain exposed pipe 8913 or manufactured separately and coupled to the drain exposed pipe 8913.

In addition, referring to FIG. 17C, in some examples, a discharge pipe support member 8951 can be provided to support the external discharge pipe 895.

The discharge pipe support member 8951 can be disposed on the rear coupling recessed surface 427*d* of the rear cover coupling portion 427, and can support the external discharge pipe 895 as an inner circumferential surface thereof is penetrated by the external discharge pipe 895.

The discharge pipe support member 8951 can include a first discharge pipe support member 8951*a* in contact with the rear coupling recessed surface 427*d* to support the external discharge pipe 895, and a second discharge pipe support member 8951*b* coupled to the rear coupling recessed surface 427*d* to support the external discharge pipe 895.

As an end of the first discharge pipe support member 8951*a* can be in contact with the rear coupling recessed surface 427*d*, the first discharge pipe support member 8951*a* can include a plurality of first discharge pipe support members, the external discharge pipe 895 can be supported more strongly.

Specifically, the first discharge pipe support member 8951*a* can be formed in a plate shape, can be penetrated by the external discharge pipe 895, and can be formed integrally with the external discharge pipe 895 or manufactured separately and coupled to the external discharge pipe 895. The first discharge pipe support member 8951*a* can include the plurality of first discharge pipe support members spaced apart from each other in a longitudinal direction of the external discharge pipe 895.

The second discharge pipe support member 8951*b* can be fixed to the rear coupling recessed surface 427*d* to support the external discharge pipe 895.

Specifically, the second discharge pipe support member 8951*b* can be manufactured to define a space through which the external discharge pipe 895 passes therein by bending the plate. Overlapping ends of the plate can be coupled to the rear coupling recessed surface 427*d* through a separate fastening member.

That is, the second discharge pipe support member 8951*b* can be coupled to the rear coupling recessed surface 427*d* to provide a strong supporting force to the external discharge pipe 895.

In addition, the first discharge pipe support member 8951*a* and the second discharge pipe support member 8951*b* can be mutually supported.

Specifically, the second discharge pipe support member 8951*b* can be disposed between the plurality of first discharge pipe support members 8951*a*, and the first discharge pipe support member 8951*a* can protrude further rearwards than the second discharge pipe support member 8951*b*.

The first discharge pipe support member 8951*a* and the second discharge pipe support member 8951*b* can be supported in contact with each other, and the second discharge pipe support member 8951*b* can be prevented from being shaken by vibration through a rear protrusion of the first discharge pipe support member 8951*a*.

In some examples, referring to FIGS. 17A to 17C, the rear cover 430 can be configured to cover the drain pipe 891 and the return pipe 893.

That is, the rear cover 430 can cover the drain exposed pipe 8913 and the return exposed pipe 8933 exposed to the outside to be protected from the external impact, and can prevent the drain exposed pipe 8913 and the return exposed pipe 8933 from being exposed to the outside as much as possible to improve esthetics.

The rear cover 430 can be configured to cover at least a portion of the drain exposed pipe 8913 and at least a portion of the return exposed pipe 8933. That is, the rear cover 430 can be configured to cover a portion of the drain exposed pipe 8913 and a portion of the return exposed pipe 8933, or can be configured to cover an entirety of the drain exposed pipe 8913 and an entirety of the return exposed pipe 8933.

For example, FIGS. 17A to 17C show that the rear cover 430 covers the entirety of the drain exposed pipe 8913 and the entirety of the return exposed pipe 8933. Hereinafter, for convenience of description, it will be described on the basis that the rear cover 430 covers the entirety of the drain exposed pipe 8913 and the entirety of the return exposed pipe 8933.

Specifically, the rear cover 430 can be configured such that the duct cover 431 covers one side of the drain exposed pipe 8913 facing the water collecting connection hole 4277.

The duct cover circumferential portion 431*a* can be defined to generally correspond to the flow outer circumferential portion 4231*a*, and can be expanded to be away from the flow outer circumferential portion 4231*a* toward the one side of the drain exposed pipe 8913. The duct cover 431 having a relatively larger space defined therein than the coupling portion cover 433 can cover the vicinity of the water collecting connection hole 4277.

For example, the duct cover circumferential portion 431*a* can be generally formed in a circular shape corresponding to the flow portion 4231, and can extend in the radial direction of the flow portion 4231 toward the second side plate 1413 and the bottom plate 147 from below. From another point of view, the duct cover 431 can cover at least a portion of the water collecting extension 4279*a* having the water collecting connection hole 4277 defined therein.

As described above, the external discharge pipe 895 can be disposed at one side of the drain exposed pipe 8913, the discharge pipe support member 8951 supporting the external discharge pipe 895 can be disposed on the external discharge pipe 895, and the duct cover 431 can easily cover the water collecting connection hole 4277, one side of the drain exposed pipe 8913, the external discharge pipe 895, the discharge pipe support member 8951, and the like.

In addition, the rear cover 430 can be configured such that the coupling portion cover 433 covers the other side of the drain exposed pipe 8913 facing the water collecting connection hole 4277.

The duct cover circumferential portion 431*a* can be formed to generally correspond to the flow outer circumferential portion 4231*a*, and may not extend toward the other side of the drain exposed pipe 8913. The cover extension 433*b* can connect the duct cover circumferential portion 431*a* and the coupling cover circumferential portion 433*a* to each other.

That is, the coupling portion cover 433 having a relatively smaller space defined therein than the duct cover 431 can cover the other side of the drain exposed pipe 8913. Unlike the one side, the other side of the drain exposed pipe 8913 may not have a separate component, so that the other side of the drain exposed pipe 8913 can be easily covered with only the coupling portion cover 433.

For example, the duct cover circumferential portion 431*a* can be formed in a circular shape such that an upper portion thereof corresponds to the flow portion 4231. From another point of view, the coupling portion cover 433 can cover at least a portion of the water storage extension 4279*b* described above having the water storage connection hole 4275 defined therein.

However, it was described above that the duct cover 431 covers the vicinity of the water collecting connection hole 4277 and the coupling portion cover 433 covers the vicinity of the water storage connection hole 4275. However, in consideration of components disposed in the vicinity of the water collecting connection hole 4277 and components disposed in the vicinity of the water storage connection hole 4275, the duct cover 431 or the coupling portion cover 433 can selectively cover the water collecting connection hole 4277 and the water storage connection hole 4275.

In summary, the rear cover 430 can set positions where the duct cover 431 and the coupling portion cover 433 are disposed in consideration of volumes of components protruding rearwards from the rear surface of the rear plate 420, thereby easily covering the components located on the rear surface of the rear plate 420 while minimizing the volume.

In some examples, referring back to FIGS. 11A to 11C and 17A to 17C, the rear cover 430 can include a cover-through-portion 437 defined to discharge the water flowing through the drain exposed pipe 8913 to the outside through the external discharge pipe 895.

The cover-through-portion 437 can be defined through one side of the rear cover 430, and said one side of the rear cover 430 can be a region facing the external discharge pipe 895.

The cover-through-portion 437 can expose at least a portion of the external discharge pipe 895 to the outside through the penetrated portion, and can allow the other end of the external discharge pipe 895 to be easily connected to the sewer located outside through the hose or the like.

Specifically, the duct cover 431 can be configured to cover a portion of the external discharge pipe 895, and the cover-through-portion 437 can be defined through the duct cover 431 and the coupling portion cover 433 of the rear cover 430 together, so that a larger penetration area can be secured. In addition, the cover-through-portion 437 can be penetrated such that the discharge pipe support member 8591 is exposed to the outside, so that maintenance of the discharge pipe support member 8591 can be easy.

In addition, the cover-through-portion 437 can be defined to penetrate a portion of the cover shielding portion 431*b* of the duct cover 431, and an opening and closing hinge portion 4393 of the cover door 439 to be described later can be disposed at an end of the cover shielding portion 431*b* facing the cover-through-portion 437, so that the opening and closing hinge portion 4393 can be easily installed.

For example, in FIGS. 17A to 17C, the cover-through-portion 437 is shown to be defined through the duct cover circumferential portion 431*a*, the cover shielding portion 431*b*, the coupling cover circumferential portion 433*a*, and the cover extension 430*b*.

A penetration area of the cover-through-portion 437 is sufficient enough that the hose connecting the external discharge pipe 895 and the sewer located outside to each other can be easily installed. A shape of cover-through-portion 437 can be variously set in consideration of manufacturing conditions and relationships with other components.

In addition, the rear cover 430 can include the cover door 439 configured to open and close the cover-through-portion 437.

Specifically, the cover door 439 can include an opening and closing body 4391 that is configured to close the cover-through-portion 437.

The opening and closing body 4391 can be formed in a shape corresponding to the cover-through-portion 437, and can be coupled to the rear cover 430 to form a portion of the rear cover 430. That is, the opening and closing body 4391 can be configured to form a portion of the duct cover 431 and a portion of the coupling portion cover 433.

For example, the opening and closing body 4391 can form a portion of the cover shielding portion 431*b*, a portion of the duct cover circumferential portion 431*a*, a portion of the cover extension 433*b*, and a portion of the coupling cover circumferential portion 433*a*, and an overall shape of the opening and closing body 4391 can be a stepped shape.

The opening and closing body 4391 can prevent the exposure of the external discharge pipe 895 by shielding the cover-through-portion 437, and can form the portion of the rear cover 430 to give a sense of unity in appearance.

In addition, the opening and closing body 4391 can be configured to be spaced apart from the duct cover 431 and the coupling portion cover 433 by a predetermined spacing, and can be prevented from contacting with the duct cover 431 and the coupling portion cover 433 when the cover-through-portion 437 is opened and closed.

In some examples, the cover door 439 can include the opening and closing hinge portion 4393 in which the opening and closing body 4391 is configured to selectively open and close the cover-through-portion 437.

Specifically, the opening and closing hinge portion 4393 can connect the rear cover 430 and the opening and closing body 4391 to each other, and the opening and closing body 4391 can be configured to be movable in the cover-through-portion 437. As described above, the opening and closing hinge portion 4933 can connect the cover shielding portion 431*b* and a portion constituting the cover shielding portion 431*b* of the opening and closing body 4391 to each other.

The opening and closing hinge portion 4393 can selectively open and close the cover-through-portion 437 by allowing the opening and closing body 4391 to pivot.

That is, the cover door 439 can selectively expose the external discharge pipe 895 to the outside. For example, when discharging the water of the water collector 170 to the outside through the external discharge pipe 895, the cover-through-portion 437 can be opened. When discharging the water of the water collector 170 to the outside through water storage 7, the cover-through-portion 437 can be shielded.

Although it has been described that the cover door 439 selectively opens and closes the cover-through-portion 437 by pivoting the opening and closing body 4391 through the opening and closing hinge portion 4393, the scheme in which the opening and closing body 4391 is selectively opened and closed can be a separate different scheme such as a sliding scheme.

In some examples, the cover door 439 can include an opening and closing hook 4395 configured to fix the opening and closing body 4391 to the rear cover 430 or the rear plate 420.

Specifically, the opening and closing hook 4395 can protrude from an end of the opening and closing body 4391, and can be hooked to the rear plate 420 or the rear cover 430 to fix the opening and closing body 4391 to the rear plate 420 or the rear cover 430.

In addition, the rear plate 420 or the rear cover 430 can have an opening and closing hook accommodating portion 428 defined therein that can accommodate the opening and closing hook 4395 therein at a position corresponding to the opening and closing hook 4395.

For example, the opening and closing hook 4395 can be disposed at an end of the opening and closing body 4391 forming a portion of the coupling portion cover 433, and can face the rear surface of the rear plate 420. In addition, the rear plate 420 can include the opening and closing hook accommodating portion 428 defined through the rear plate 420 at the position corresponding to the opening and closing hook 4395.

The opening and closing hook 4395 can be inserted into the opening and closing hook accommodating portion 428 to allow the opening and closing body 4391 to shield the cover-through-portion 437, and can be separated from the opening and closing hook accommodating portion 428 to allow the opening and closing body 4391 to open the cover-through-portion 437.

The opening and closing hook 4395 and the opening and closing hook accommodating portion 428 can fix the opening and closing body 4391 to shield the cover-through-portion 497 when not using the external discharge pipe 895 through a relatively simple coupling scheme called hook coupling. The opening and closing body 4391 can be separated to open the cover-through-portion 497 when using the external discharge pipe 895.

In some examples, referring back to FIG. 16, the drain pipe 891 can include a flow channel switching valve 894 for selectively guiding the water delivered from the water collector 170 to the washer 940 or the drain exposed pipe 8913.

Specifically, the flow channel switching valve 894 can be disposed on the water collecting drain pipe 8911, and the water collecting drain pipe 8911 can include a first water collecting drain pipe 8911*a* connecting the flow channel switching valve 894 and the water collector 170 to each other, and a second water collecting drain pipe 8911*b* connecting the flow channel switching valve 894 and the drain exposed pipe 8913 to each other.

When discharging the water of the water collector 170 to the outside, the water of the water collector 170 can sequentially pass through the first water collecting drain pipe 8911*a*, the flow channel switching valve 894, and the second water collecting drain pipe 8911*b* to be guided to the drain exposed pipe 8913, and the water guided to the drain exposed pipe 8913 can be discharged to the outside by being guided to the external discharge pipe 895 or the water storage 7.

When using the water of the water collector 170 for washing, the water of the water collector 170 can be guided to the first water collecting drain pipe 8911*a*, the flow channel switching valve 894, and a washing flow channel of the washer 940, and the water guided to the washing flow channel can flow into the evaporator 951 to wash the evaporator 951.

The flow channel switching valve 894 can selectively guide the water of the water collector 170 to the washer 940 or the drain exposed pipe 8913, so that the water of the water collector 170 can be efficiently recycled.

In some examples, FIGS. 18A to 18D are views showing an example of a fan duct. FIG. 19 is a view showing a fan duct connected to a hot air supply.

Figure 18A:
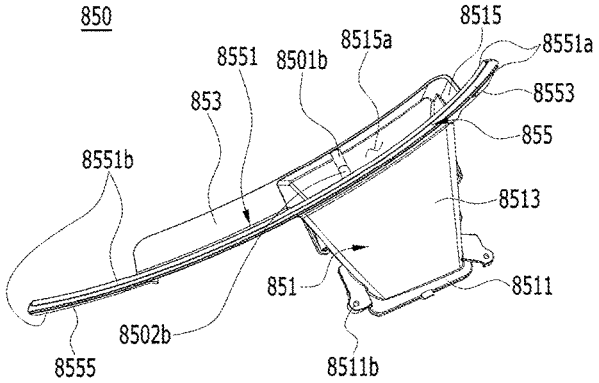
FIGS. 18A to 18D are views showing an example of a fan duct.
Figure 18C:
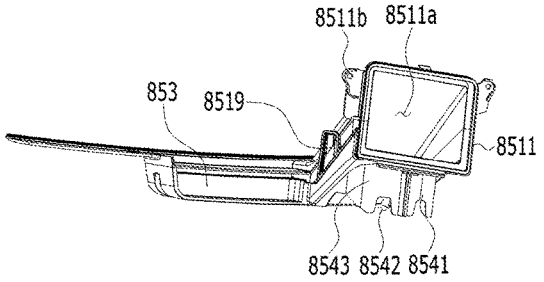
Figure 18B:
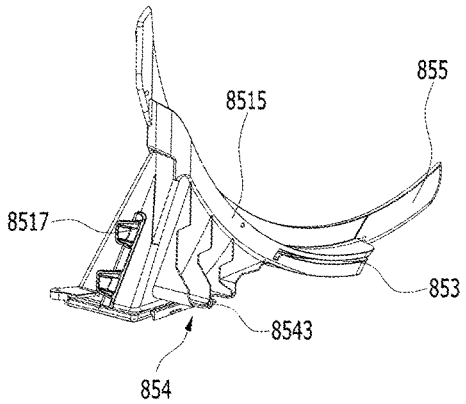
Figure 18D:
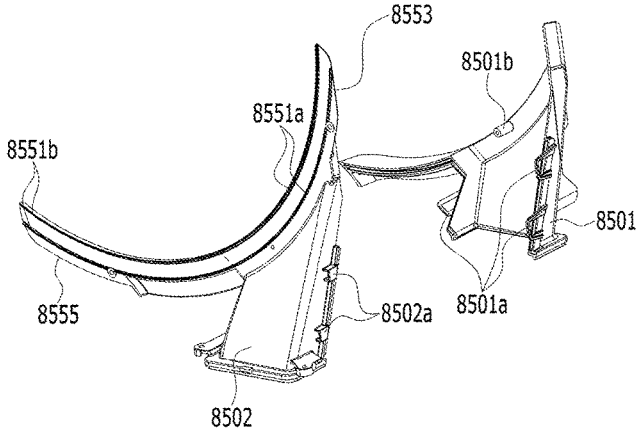
Figure 19:
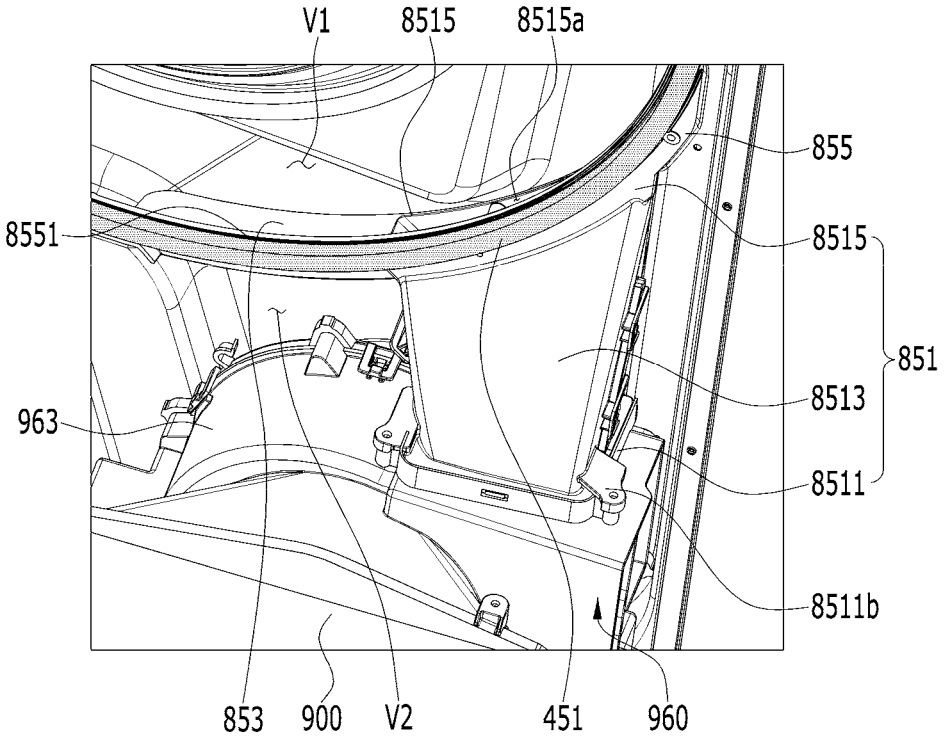
FIG. 19 is a view showing an example of a fan duct connected to a hot air supply.

Specifically, FIG. 18A is a view of the fan duct viewed from the front, FIG. 18B is a view of the fan duct viewed from the rear, FIG. 18C is a view of the fan duct viewed from below, and FIG. 18D is a view showing the fan duct being separated.

Referring to FIG. 18A and FIG. 19, the laundry treating apparatus can include the fan duct 850 for supplying the hot air from the hot air supply 900 to the duct 423.

Specifically, the fan duct 850 can include a fan duct body 851 that forms an appearance of the fan duct 850.

One end of the fan duct body 851 can be connected to the hot air supply 900, and the other end thereof can be opened to receive the hot air from the hot air supply 900.

Specifically, one end of the fan duct body 851 can be coupled to the blower fan housing 963 of the blower 960 to receive the hot air from the blower fan housing 963.

For example, the blower fan housing 963 can be connected to the hot air flow channel 920 such that the hot air can be introduced thereinto, and can discharge the introduced hot air through the open top surface thereof. One end of the fan duct body 851 can be coupled to the open top surface of the blower fan housing 963.

The fan duct body 851 can include a fan duct inlet 8511 coupled to the open top surface of the blower fan housing 963.

The fan duct inlet 8511 can be formed in a shape corresponding to the open top of the blower fan housing 963. For instance, in the example shown in FIG. 18C, the fan duct inlet 8511 has a rectangular shape.

In addition, the fan duct inlet 8511 can include a fan duct inlet hole 8511*a* defined to receive the hot air from the blower fan housing 963, and the fan duct inlet hole 8511*a* can be defined to correspond to a hole for discharging the hot air to the outside of the blower fan housing 963.

The fan duct inlet 8511 can be inserted into and coupled to the blower fan housing 963. Accordingly, the fan duct inlet hole 8511*a* can receive the hot air from the interior of the blower fan housing 963.

Because the fan duct inlet 8511 is inserted into and coupled to the blower fan housing 963, the fan duct inlet 8511 can receive a strong coupling force, and the leakage of the hot air to the outside through the space between the fan duct inlet 8511 and the blower fan housing 963 can be prevented as much as possible.

In some examples, the fan duct body 851 can include a plurality of connection fastening portions 8511*b* disposed on an outer circumferential surface thereof to be coupled to the blower fan housing 963. The connection fastening portion 8511*b* can be coupled to the blower fan housing 963 by being penetrated by a separate fastening member.

The connection fastening portion 8511*b* can be disposed on the outer circumferential surface of the fan duct body 851 adjacent to the fan duct inlet 8511 or on the fan duct inlet 8511. Specifically, the connection fastening portion 8511*b* can protrude from the outer circumferential surface of the fan duct body 851 or the fan duct inlet 8511, and can have a fastening hole through which the fastening member can pass at an end thereof.

In addition, the plurality of connection fastening portions 8511*b* can be disposed along a circumference of the fan duct body 851 and coupled to the blower fan housing 963 as the separate fastening member penetrates each of the plurality of connection fastening portions 8511*b*. The connection fastening portion 8511*b* can provide a coupling force for an entirety of the fan duct 850 to be strongly fixed to the blower fan housing 963.

In some examples, referring to FIG. 18B, the fan duct body 851 can include a fan duct support rib 854 that increases structural rigidity of the entire fan duct 850.

The fan duct support rib 854 can be disposed at the rear of the fan duct body 851 to be supported by the inlet recessed surface 4234. That is, the fan duct support rib 854 can protrude from a rear surface of the fan duct body 851.

The fan duct support rib 854 can be formed in a plate shape that protrudes toward the inlet recessed surface 4234 and extends along a longitudinal direction of the fan duct body 851, and can include a plurality of fan duct support ribs spaced apart from each other by a predetermined distance. The plurality of fan duct support ribs 854 can be spaced apart from each other in a width direction as they extend in the longitudinal direction of the fan duct body 851. The fan duct support rib 854 can be disposed on an entirety of the rear surface of the fan duct body 851 to further increase the structural rigidity of the fan duct 850.

In addition, when the fan duct 850 is coupled to the inlet recessed surface 4234 as described above, the fan duct support rib 854 can be in contact with the inlet recessed surface 4234 to further increase the supporting force of the fan duct 850.

In some examples, the fan duct body 851 can include a support rib connection portion 8541 for connecting the plurality of fan duct support ribs 854 to each other. The support rib connection portion 8541 can connect the plurality of fan duct support ribs 854 to each other, so that the plurality of fan duct support ribs 854 can integrally absorb vibration or shock.

For example, referring to FIG. 18B, the support rib connection portion 8541 is shown to connect lower ends of the plurality of fan duct support rib 854 to each other. However, the present disclosure should not be construed as being limited thereto, and a position of the support rib connection portion 8541 can be varied.

In addition, the fan duct body 851 can include a support coupling portion 8543 for coupling the inlet recessed surface 4234 to the fan duct body 851.

The support coupling portion 8543 can be disposed on the fan duct support rib 854 or the support rib connection portion 8541 and can have a predetermined area, and can be coupled to the inlet recessed surface 4234 by being penetrated by a separate fastening member. Accordingly, the support coupling portion 8543 can strongly fix the fan duct 850 to the inlet recessed surface 4234.

For example, referring to FIG. 18B, the support coupling portion 8543 is illustrated to be disposed in a portion where the fan duct support rib 854 and the support rib connection portion 8541 are connected to each other. However, the present disclosure should not be construed as being limited thereto, and a position of the support coupling portion 8543 can be varied.

In addition, when the fan duct support rib 854 is in contact with the inlet recessed surface 4234, a space surrounded by the fan duct support rib 854 and the support rib connection portion 8541 can be shielded from the outside, and the fan duct body 851 can include a support rib connection hole 8542 for communicating an interior of the fan duct support rib 854 and an exterior of the fan duct support rib 854 with each other. The support rib connection hole 8542 can be defined in the fan duct support rib 854 or the support rib connection portion 8541.

Figure 20A:
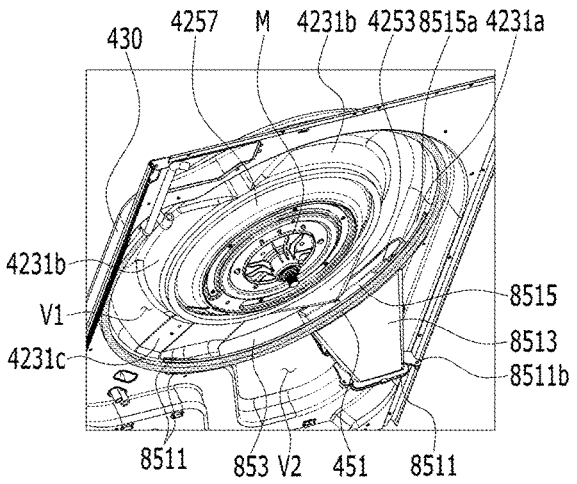
FIGS. 20A and 20B are views showing an example of a fan duct and a duct.
Figure 20B:
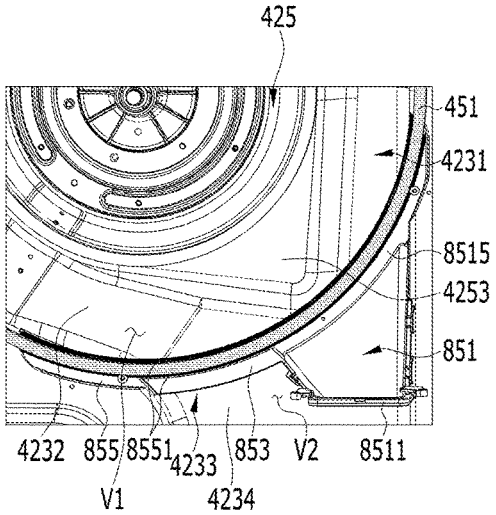

In some examples, FIGS. 20A and 20B are views showing an example of a fan duct and a duct. Specifically, FIG. 20A shows the fan duct coupled to the duct from the top, and FIG. 20B shows the fan duct coupled to the duct from the front.

Referring to FIG. 20A, the fan duct body 851 can include a fan duct outlet 8515 for guiding the hot air supplied from the hot air supply 900 to the flow portion 4231.

As described above, the fan duct body 851 can have one end connected to the hot air supply 900 and the other end connected to the inlet 4233 or the flow portion 4231, and the fan duct outlet 8515 can form the other end of the fan duct body 851.

Specifically, the fan duct outlet 8515 can be disposed to be inserted into the first flow space V1 of the flow portion 4231 or the second flow space V2 of the inlet 4233. In addition, the fan duct outlet 8515 can be coupled to the flow recessed surface 4232 of the flow portion 4231 and the inlet recessed surface 4234 of the inlet 4233.

The fan duct outlet 8515 can be configured such that a rear surface thereof is in contact with the inlet recessed surface 4234 or the flow recessed surface 4232 over a certain area, so that the fan duct outlet 8515 can be strongly supported by the flow recessed surface 4232 or the inlet recessed surface 4234.

As described above, the first flow space V1 and the second flow space V2 can be in communication with each other as one side to be connected with the inlet circumferential portion 4233*a* and the other side of the flow outer circumferential portion 4231*a* are opened, and the inlet circumferential portion 4233*a* can have the arc shape.

For convenience of description, one side of the flow outer circumferential portion 4231*a* will be described as a first flow connection portion 4235, and the other side of the flow outer circumferential portion 4231*a* will be described as a second flow connection portion 4236.

That is, the first flow connection portion 4235 can be located farther from the first side plate 1411 than the second flow connection portion 4236, and can be located close to the bottom plate 147 of the cabinet 100.

The fan duct outlet 8515 can be disposed at a boundary between the flow portion 4231 and the inlet 4233, can be inserted at a boundary between the first flow space V1 and the second flow space V2, and can be in contact with a boundary between the flow recessed surface 4232 and the inlet recessed surface 4234.

The fan duct outlet 8515 can be disposed at the boundary between the flow portion 4231 and the inlet 4233 to directly guide the hot air flowing inside the fan duct 850 to the flow portion 4231, thereby minimizing a flow distance. The fan duct outlet 8515 can minimize a heat loss of the hot air by minimizing the flow distance of the hot air.

In some examples, the fan duct outlet 8515 can be configured to partition the flow portion 4231 and the inlet 4233.

The fan duct outlet 8515 can extend along a circumference of the flow outer circumferential portion 4231*a* to form a portion of the flow portion 4231. The fan duct outlet 8515 can form a circle shape together with the flow outer circumferential portion 4231*a* to partition the flow portion 4231 and the inlet 4233.

That is, a length of the fan duct outlet 8515 can be the same as a length of a portion between the first flow connection portion 4235 and the second flow connection portion 4236. The fan duct outlet 8515 can be configured such that both side surfaces thereof are in contact with the first flow connection portion 4235 and the second flow connection portion 4236 of the flow outer circumferential portion 4231*a* described above.

Specifically, one side surface of the fan duct outlet 8515 can be in contact with the second flow connection portion 4236, and the other side surface thereof can be in contact with the first flow connection portion 4235.

Accordingly, the hot air flowed into the flow portion 4231 can be prevented from flowing to the inlet 4233 through the fan duct outlet 8515 as much as possible.

In some examples, the fan duct 850 can further include a fan duct shielding portion 853 partitioning the flow portion 4231 and the inlet 4233 together with the fan duct outlet 8515.

First, the fan duct outlet 8515 will be described. The fan duct outlet 8515 can have a width smaller than an open width of the flow outer circumferential portion 4231*a*. The reason that the fan duct outlet 8515 has the width smaller than the open width of the flow outer circumferential portion 4231*a* can be varied.

For example, the blower 960 can have the blower fan 961 disposed therein and can have a width greater than that of the fan duct outlet 8515 to sufficiently secure a flow rate of the hot air. As the blower 960 and the fan duct outlet 8515 are disposed together in the second flow space V2 of the inlet 4233, the width of the fan duct outlet 8515 can be smaller than a width between the first flow connection portion 4235 and the second flow connection portion 4236 of the flow outer circumferential portion 4231*a*.

In addition, as described above, a portion of one surface of the blower 960 can be opened and coupled to the fan duct inlet 8511. When an open area of the fan duct outlet 8515 is too large, an efficiency of the hot air supplied to the flow portion 4231 can be reduced, such as a rapid decrease in a flow velocity of the hot air. In addition to the above reason, there can be various reasons.

In some implementations, the fan duct outlet 8515 can shield a portion of the boundary between the flow portion 4231 and the inlet 4233, and the fan duct shielding portion 853 can shield a portion of the boundary that is not shielded by the fan duct outlet 8515. That is, the fan duct shielding portion 853 can extend along the circumference of the flow outer circumferential portion 4231*a* from the fan duct outlet 8515, and can form a portion of the flow portion 4231.

Specifically, one side surface or the other side surface of the fan duct outlet 8515 can be spaced apart from the flow outer circumferential portion 4231*a*, and the fan duct shielding portion 853 can extend from one side or the other side of the fan duct outlet 8515 to the first flow connection portion 4235 or the second flow connection portion 4236 described above. That is, the fan duct shielding portion 853 can form the circle shape together with the fan duct outlet 8515 and the flow outer circumferential portion 4231*a*.

In some examples, the fan duct shielding portion 853 can extend from one of the both side surfaces of the fan duct outlet 8515.

That is, one of one side surface and the other side surface of the fan duct outlet 8515 can be in contact with the first flow connection portion 4235 or the second flow connection portion 4236, and the fan duct shielding portion 853 can extend toward the first flow connection portion 4235 or the second flow connection portion 4236 from the other of one side surface and the other side surface of the fan duct outlet 8515.

One side surface of the fan duct outlet 8515 can refer to a side surface disposed closer to the first side plate 1411 among the both side surfaces.

For example, FIG. 11B illustrates that one side surface of the fan duct outlet 8515 is in contact with the second flow connection portion 4236, and the fan duct shielding portion 853 extends from the other side surface of the fan duct outlet 8515 to be in contact with the first flow connection portion 4235. However, the present disclosure may not be limited thereto. The other side surface of the fan duct outlet 8515 can be in contact with the first flow connection portion 4235, and the fan duct shielding portion 853 can extend from one side surface of the fan duct outlet 8515 to be in contact with the first flow connection portion 4235.

The fan duct shielding portion 853 can extend from only one of the both side surfaces of the fan duct outlet 8515, so that manufacturing thereof can become more facilitated. In addition, the fan duct 850 can include a fan duct extension 8513 for connecting the fan duct outlet 8515 and the fan duct inlet 8511 to each other. As the fan duct outlet 8515 is in contact with the first flow connection portion 4235 or the second flow connection portion 4236, a portion of the fan duct extension 8513 can be in contact with the inlet circumferential portion 4233*a*. That is, as the fan duct extension 8513 is in contact with the inlet circumferential portion 4233*a*, the support force of the fan duct 850 can be improved.

In some examples, referring to FIG. 20B, the fan duct 850 can include a fan duct outlet hole 8515*a* defined in the fan duct outlet 8515 to discharge the hot air supplied from the hot air supply 900 to the flow portion 4231.

The fan duct outlet hole 8515*a* can be opened from the fan duct outlet 8515 toward the first flow space V1. Specifically, the fan duct outlet hole 8515*a* can be defined through one surface of the fan duct outlet 8515 facing the flow inner circumferential portion 4231*b*.

As described above, the fan duct outlet 8515 can partition the first flow space V1 and the second flow space V2 from each other alone or together with the fan duct shielding portion 853. As the fan duct outlet hole 8515*a* faces the flow inner circumferential portion 4231*b*, the hot air passing through the fan duct outlet hole 8515*a* may not directly face the drum shielding portion 221 of the drum rear surface 220, but can face the first flow space V1.

The fan duct outlet hole 8515*a* can allow the hot air passing through the fan duct outlet hole 8515*a* to diffuse throughout the flow portion 4231 and uniformly flow into the drum 200 through the drum shielding portion 221 facing the flow portion 4231. Furthermore, it is possible to prevent the hot air supplied to the flow portion 4231 from leaking to the outside through the fan duct 850 as much as possible.

In some examples, referring to FIGS. 5A to 5C again, the hot air introduced through the fan duct 850 can flow in one direction C1 and the other direction C2 in the flow portion 4231 of the duct 423. For example, the one direction C1 can refer to a clockwise direction, and the other direction C2 can refer to a counterclockwise direction.

In some examples, referring to FIG. 20B, the fan duct 850 can include a fan duct coupling portion 855 coupled to the rear plate 420. The fan duct 850 can be coupled to the rear plate 420 through the fan duct coupling portion 855.

The fan duct coupling portion 855 can include a first fan duct coupling portion 8553 disposed in the fan duct shielding portion 853 and a second fan duct coupling portion 8555 disposed in the fan duct outlet 8515.

That is, the first fan duct coupling portion 8553 can be disposed on a front surface of the fan duct outlet 8515, and can be formed in a shape corresponding to the flow outer circumferential portion 4231*a*, so that one end thereof can extend further outward than the fan duct outlet 8515.

For example, one end of the first fan duct coupling portion 8553 can extend further in the other direction C2 than the fan duct outlet 8515, and the first fan duct coupling portion 8553 can be coupled to the front surface of the rear plate 420 outwardly of the flow outer circumferential portion 4231*a*.

In addition, the second fan duct coupling portion 8555 can be disposed on the front surface of the fan duct shielding portion 853, can be formed in a shape corresponding to the flow outer circumferential portion 4231*a*, and can have the other end extending further outward than the fan duct shielding portion 853. The second fan duct coupling portion 8555 can have the other end extending further in one direction C1 than the fan duct shielding portion 853, and can be coupled to the front surface of the rear plate 420 outwardly of the flow outer circumferential portion 4231*a*.

A separate fastening member can pass through each of the first fan duct coupling portion 8553 and the second fan duct coupling portion 8555 to be coupled to the rear plate 420, thereby forming a strong coupling force.

In addition, the first fan duct coupling portion 8553 can be connected to the second fan duct coupling portion 8555. That is, the fan duct coupling portion 855 can extend from one end to the other end thereof, and a length of an arc formed from one end to the other end of the fan duct coupling portion 855 can be greater than a length of the arc formed by the fan duct shielding portion 853 and the fan duct outlet 8515.

In some examples, the rear plate 420 can include a fan duct accommodating portion 4271 coupled to the fan duct coupling portion 855.

The fan duct accommodating portion 4271 can be coupled to both ends of the fan duct coupling portion 855, and can include a first fan duct accommodating portion 4271*a* coupled to the first fan duct coupling portion 8553 and a second fan duct accommodating portion 4271*b* coupled to the second fan duct coupling portion 8555.

The first fan duct accommodating portion 4271*a* can be recessed in a shape corresponding to a portion protruding more in one direction C1 than the fan duct shielding portion 853 of the first fan duct coupling portion 8553.

In addition, the second fan duct accommodating portion 4271*b* can be recessed in a shape corresponding to a portion protruding more in the other direction C2 than the fan duct outlet 8515 of the second fan duct coupling portion 8555.

The fan duct coupling portion 855 can receive strong supporting force as the both ends thereof are accommodated in the fan duct accommodating portion 4271, an entirety of the fan duct 850 can be more strongly fixed by the fan duct accommodating portion 4271.

In some examples, the fan duct 850 can include a coupling guider 8551 disposed to support the first sealing portion 451.

As described above, the fan duct outlet 8515 can form the portion of the outer circumference of the flow portion 4231, and the first sealing portion 451 can be formed in the annular shape and disposed along the outer circumference of the flow portion 4231 including the fan duct outlet 8515.

The coupling guider 8551 can include a first coupling guider 8551*a* disposed in front of the fan duct outlet 8515, and a second coupling guider 8551*b* disposed in front of the fan duct shielding portion 853.

The first fan duct coupling portion 8553 can be disposed in front of the fan duct outlet 8515, and the first coupling guider 8551*a* can be disposed on a front surface of the first fan duct coupling portion 8553.

The first coupling guider 8551*a* can protrude from the front surface of the first fan duct coupling portion 8553, and can be formed as a plurality of ribs extending to correspond to the circumference of the first sealing portion 451.

When the first coupling guider 8551*a* is formed as the plurality of ribs, the plurality of ribs can be spaced apart from each other, so that the first sealing portion 451 can be disposed therebetween. The plurality of ribs can respectively be in contact with the inner circumferential surface and the outer circumferential surface of the first sealing portion 451 to support the first sealing portion 451. In addition, the plurality of ribs can extend throughout the first fan duct coupling portion 8553 along the circumferential direction of the flow portion 4231, and an area thereof in contact with the first sealing portion 451 can be increased to more strongly support the first sealing portion 451.

In addition, the second fan duct coupling portion 8555 can be disposed in front of the fan duct shielding portion 853, and the second coupling guider 8551*b* can be disposed on a front surface of the second fan duct coupling portion 8555.

The second coupling guider 8551*b* can protrude from the front surface of the second fan duct coupling portion 8555, and can be formed as a plurality of ribs extending to correspond to the circumference of the first sealing portion 451.

When the second coupling guider 8551*b* is formed as the plurality of ribs, the plurality of ribs can be spaced apart from each other, so that the first sealing portion 451 can be disposed therebetween. The plurality of ribs can respectively be in contact with the inner circumferential surface and the outer circumferential surface of the first sealing portion 451 to support the first sealing portion 451. In addition, the plurality of ribs can extend throughout the first fan duct coupling portion 8553 along the circumferential direction of the flow portion 4231, and an area thereof in contact with the first sealing portion 451 can be increased to more strongly support the first sealing portion 451.

The first coupling guider 8551*a* can be connected to the second coupling guider 8551*b* to support the first sealing portion 451 together. The first coupling guider 8551*a* and the second coupling guider 8551*b* can be connected to each other to support the first sealing portion 451 with a larger area.

In some examples, referring to FIG. 20A, the fan duct coupling portion 855 can be located closer to the center of the flow portion 4231 than the fan duct outlet 8515 and the fan duct shielding portion 853.

For example, the fan duct coupling portion 855 can protrude more toward a center of the flow portion 4231 than the fan duct outlet 8515 and the fan duct shielding portion 853. That is, the fan duct coupling portion 855 can have an increased cross-sectional area than the fan duct outlet 8515 and the fan duct shielding portion 853, so that the coupling guider 8551 can be easily disposed on the front surface of the fan duct coupling portion 855.

In some examples, referring to FIG. 18D, the fan duct 850 can be formed as a plurality of divided bodies. That is, the fan duct 850 can be configured such that the plurality of divided bodies are coupled to each other to define a flow channel therein.

The fan duct 850 can be manufactured as an integral body, but as the shape thereof is complicated and a space in which the hot air flows is defined, the fan duct 850 can be manufactured as the plurality of divided bodies coupled to each other for manufacturing convenience. As for a coupling scheme of the plurality of divided bodies, various schemes such as screw coupling, riveting coupling, fitting coupling, bonding, welding, and the like can be used.

Specifically, the fan duct 850 can include a first fan duct forming portion 8501 and a second fan duct forming portion 8502.

The first fan duct forming portion 8501 can form a shape of a portion of the fan duct 850, and the second fan duct forming portion 8502 can form a shape of the remaining portion of the fan duct 850, so that, when the first fan duct forming portion 8501 and the second fan duct forming portion 8502 are coupled to each other, the shape of the fan duct 850 can be completed.

For example, the first fan duct forming portion 8501 can face the rear plate 420, and can form a portion of the above-described fan duct inlet 8511, a portion of the fan duct body 851, a portion of the fan duct outlet 8515, and a portion of the fan duct shielding portion 853.

In addition, the second fan duct forming portion 8502 can face the drum rear surface 220, and can form a portion of the above-described fan duct inlet 8511, a portion of the fan duct body 851, a portion of the fan duct outlet 8515, a portion of the fan duct shielding portion 853, the fan duct coupling portion 855, and the coupling guider 8551.

That is, when viewing from the side, the first fan duct forming portion 8501 and the second fan duct forming portion 8502 can be divided at a center of the fan duct 850 in a direction from the top plate 145 to the bottom plate 147. The first fan duct forming portion 8501 can form a rear portion of the fan duct 850, and the second fan duct forming portion 8502 can form a front portion of the fan duct 850.

However, a divided shape of the fan duct 850 can be varied depending on an overall shape of the fan duct 850, manufacturing conditions, and the like.

In some examples, the first fan duct forming portion 8501 can be coupled to the second fan duct forming portion 8502 by a separate coupling portion.

That is, the first fan duct forming portion 8501 can include a first fan duct coupling portion 8501*a* disposed on one surface of the first fan duct forming portion 8501, and the second fan duct forming portion 8502 can include a second fan duct coupling portion 8502*a* disposed on one surface of the second fan duct forming portion 8502. The first fan duct coupling portion 8501*a* and the second fan duct coupling portion 8502*a* can be coupled to each other as one thereof is fastened to the other.

As described above, the first fan duct forming portion 8501 and the second fan duct forming portion 8503 can form the fan duct body 851 together, and each of the first fan duct coupling portion 8501*a* and the second fan duct coupling portion 8502*a* can be disposed on both side surfaces of the fan duct body 851.

Hereinafter, for convenience of description, a structure in which the second fan duct coupling portion 8502*a* is inserted into and coupled to the first fan duct coupling portion 8501*a* will be described. The structure in which one component is inserted into and coupled to another component can be a kind of hook coupling.

However, the present disclosure may not be limited thereto, and the first fan duct coupling portion 8501*a* can be inserted into and coupled to the second fan duct coupling portion 8502*a*.

The first fan duct coupling portion 8501*a* can protrude from both side surfaces of the first fan duct forming portion 8501, can extend frontwards toward the second fan duct coupling portion 8502*a*, and can have a fan duct coupling hole 8501*c* defined therein.

The second fan duct coupling portion 8502*a* can protrude from both side surfaces of the second fan duct forming portion 8502 and can be formed in a shape corresponding to the fan duct coupling hole 8501*c*.

The second fan duct coupling portion 8502*a* can be inserted into and coupled to the fan duct coupling hole 8501*c*. In addition, the first fan duct coupling portion 8501*a* and the second fan duct coupling portion 8502*a* can respectively include a plurality of first fan duct coupling portions and a plurality of second fan duct coupling portions to increase a coupling force and a supporting force of the first fan duct forming portion 8501 and the second fan duct forming portion 8502.

In some examples, the first fan duct forming portion 8501 and the second fan duct forming portion 8502 can include a support that can support both.

The first fan duct forming portion 8501 can define a space inside the fan duct 850 together with the second fan duct forming portion 8502. For example, the fan duct inlet 8511, the fan duct body 851, and the fan duct outlet 8515 can all have an empty space defined therein. The fan duct 850 can be damaged or unable to maintain the shape thereof when an external force is applied thereto during the coupling process or the manufacturing process.

The support can provide a supporting force for maintaining the shape of the fan duct 850 by the first fan duct forming portion 8501 and the second fan duct forming portion 8502.

The support can include a first fan duct support 8501*b* disposed on the first fan duct forming portion 8501, and a second fan duct support 8502*b* disposed on the second fan duct forming portion 8502.

The first fan duct support 8501*b* and the second fan duct support 8502*b* can respectively protrude from the first fan duct forming portion 8501 and the second fan duct forming portion 8502 such that ends thereof are in contact with each other, thereby providing the supporting force to the first fan duct forming portion 8501 and the second fan duct forming portion 8502.

For example, the first fan duct support 8501*b* and the second fan duct support 8502*b* can be disposed inside the fan duct outlet 8515.

Specifically, the first fan duct support 8501*b* can protrude toward the second fan duct support 8502*b* from one surface of the first fan duct forming portion 8501 forming the fan duct outlet 8515, and the second fan duct support 8502*b* can protrude toward the first fan duct support 8501*b* from one surface of the second fan duct forming portion 8502 forming the fan duct outlet 8515. The ends of the first fan duct support 8501*b* and the second fan duct support 8502*b* can be in contact with each other inside the fan duct outlet 8515.

In addition, a separate fastening member can penetrate the first fan duct support 8501*b* and the second fan duct support 8502*b* together to fix the first fan duct forming portion 8501 and the second fan duct forming portion 8502.

Furthermore, the separate fastening member can penetrate the rear plate 420 together with the first fan duct forming portion 8501 and the second fan duct forming portion 8502, thereby increasing the coupling force between the first fan duct forming portion 8501 and the second fan duct forming portion 8502, as well as the coupling force between the rear plate 420 and the fan duct 850.

In some examples, referring to FIG. 18A and FIG. 19, the fan duct 850 can be prevented from being in contact with the drum 200.

For efficient utilization of the space inside cabinet 100, the fan duct 850 can be inclined to be prevented from being in contact with the drum 200.

As described above, in the fan duct body 851, the fan duct inlet 8511 forming one end can be connected to the blower 960 of the hot air supply 900, and the fan duct outlet 8515 forming the other end can be connected to the duct 423 of the rear plate 420.

As the blower 960 can be disposed below the drum 200 and the duct 423 can be disposed at the rear of the drum 200 to face the drum 200, the fan duct body 851 connecting the blower 960 and the drum 200 to each other can be inclinedly extended from the fan duct inlet 8511 to the fan duct outlet 8515.

For example, referring to FIG. 19, the fan duct body 851 can extend upwardly from the fan duct inlet 8511 to the fan duct outlet 8515 to be inclined rearwards.

When the fan duct 850 extends upwards to be inclined rearwards, interference with the drum can be reduced compared to a case in which the fan duct 850 vertically extends upwards, so that a design freedom of the drum can be improved. For example, the drum 200 can further extend rearwards and can have a larger size to increase a laundry accommodating capacity.

In some examples, the flow inner circumferential portion 4231*b* can be configured to guide the hot air into the flow portion 4231.

As described above, the hot air introduced through the fan duct 850 can flow in one direction C1 and the other direction C2 in the flow portion 4231 of the duct 423. For instance, the one direction C1 can refer to the clockwise direction, and the other direction C2 can refer to the counterclockwise direction.

The flow inner circumferential portion 4231*b* can be configured such that a portion thereof facing the fan duct outlet 8515 protrudes toward the fan duct outlet 8515. That is, the flow inner circumferential portion 4231*b* can prevent concentration of the hot air in one of one direction C1 and the other direction C2, can allow the hot air to be supplied into the drum 200 in a balanced manner.

Referring to FIG. 6B and FIG. 20B, in some examples, the flow inner circumferential portion 4231*b* can include a flow inner circumferential body 4231*d* and a flow inner circumferential guide portion 4231*e*. The flow inner circumferential portion 4231*b* can be formed in a shape of a circle, and the flow inner circumferential guide portion 4231*e* can protrude from the flow inner circumferential body 4231*d* toward the fan duct outlet 8515.

That is, an overall shape of the flow inner circumferential portion 4231*b* can be a water droplet shape or a streamlined shape. In other words, the flow inner circumferential guide portion 4231*e* can face the fan duct outlet 8515 and can extend with overlapping arcs, and a length of an arc can be reduced toward the fan duct outlet 8515.

The hot air discharged from the fan duct outlet 8515 can be divided in one direction C1 and the other direction C2 by the flow inner circumferential guide portion 4231*e*, so that the hot air can be guided to an entirety of the first flow space V1 in a balanced manner.

In some examples, referring back to FIG. 4 and FIG. 6B, the flow portion 4231 can include a flow guider 4231*c* for more efficiently guiding the hot air to the drum rear surface 220.

The flow guider 4231*c* can protrude frontwards from the flow recessed surface 4232. The flow guider 4231*c* can extend in a direction in which the hot air of the first flow space V1 flows.

The flow guider 4231*c* can extend to connect the flow outer circumferential portion 4231*a* and the flow inner circumferential portion 4231*b* to each other. That is, the flow guider 4231*c* can change the flow direction of the hot air introduced into the first flow space V1 toward the drum rear surface 220 and reduce the flow rate of the hot air, thereby allowing the hot air to be efficiently introduced into the drum 200.

The flow guider 4231*c* can have different protruding heights along a circumferential direction of the flow portion 4231 in the flow recessed surface 4232. The flow guider 4231*c* can be inclined in the circumferential direction.

That is, the flow guider 4231*c* can include an inclined section in which a height protruding forward increases as a distance from the fan duct outlet 8515 along the circumferential direction of the flow portion 4231 increases, a constant section in which the height protruding forward is constant as the distance from the fan duct outlet 8515 along the circumferential direction of the flow portion 4231 increases, and a decreasing section in which the height protruding forward decreases as the distance from the fan duct outlet 8515 along the circumferential direction of the flow portion 4231 increases.

The flow guider 4231*c* can be configured such that an overall protrusion height thereof varies. The hot air flowing through the first flow space V1 can be efficiently guided to the drum rear surface 220 as the flow velocity and flow direction of the hot air change by the flow guider 4231*c*.

For example, the flow guider 4231*c* can extend to further protrude frontwards from the flow recessed surface 4232 along one direction C1 with respect to the fan duct 850. In addition, after the flow guider 4231*c* protrudes to a predetermined height to prevent contact with the drum rear surface 220, the flow guider 4231*c* can extend to maintain the predetermined height along one direction C1. In addition, the flow guider 4231*c* can extend to maintain the predetermined height, and can extend to decrease the protrusion height again along one direction C1.

In some examples, referring back to FIG. 4 and FIG. 6B, the flow guider 4231*c* can include a plurality of flow guiders spaced apart from each other along the circumferential direction. FIG. 4 shows a flow portion with two flow guider 4231*c*.

One flow guider 4231*c* can be disposed to be positioned furthest from the fan duct 850. That is, one flow guider 4231*c* can be disposed on an opposite side of the fan duct 850 with respect to a center of the flow portion 4231.

The other flow guider 4231*c* can be disposed between the fan duct 850 and one flow guider 4231*c*, and can be disposed along one of the one direction C1 and the other direction C2.

The number and an arrangement of the flow guiders 4231*c* may not be limited thereto, and can be determined in consideration of a volume of the first flow space V1, a size of the drum rear surface 220, a speed of the hot air, and the like.

Although representative implementations of the present disclosure have been described in detail above, those of ordinary skill in the technical field to which the present disclosure belongs will understand that various modifications are possible with respect to the above-described implementation without departing from the scope of the present disclosure. Therefore, the scope of the present disclosure should not be limited to the described implementation, and should be defined not only by the claims described below, but also by these claims and equivalents thereof.

What is claimed is:

1. A laundry treating apparatus comprising:

a cabinet comprising a rear plate, the rear plate defining a rear surface of the cabinet;

a drum rotatably disposed in the cabinet and configured to accommodate laundry;

an air supply disposed in the cabinet, the air supply being configured to dehumidify air discharged from the drum and to supply the dehumidified air to the drum;

a driver coupled to the rear plate from a rear side of the rear plate and configured to rotate the drum; and a drain pipe that extends to bypass the driver and is configured to guide water that is condensed from the air discharged from the air by the air supply, wherein the drain pipe passes through a first portion of the rear plate from an interior of the cabinet to an exterior of the cabinet, extends along the rear side of the rear plate at the exterior of the cabinet, and is inserted through a second portion of the rear plate from the exterior of the cabinet to the interior of the cabinet.

2. The laundry treating apparatus of claim 1, further comprising:

a duct defined at the rear plate and configured to guide the dehumidified air into the drum;

a water vapor remover disposed in the air supply and configured to condense the water from the air discharged from the drum;

a water collector disposed in the cabinet and configured to receive the condensed water from the water vapor remover; and a water storage disposed in the cabinet and configured to receive the condensed water from the water collector, wherein the drain pipe connects the water collector to the water storage and is configured to guide the condensed water from the water collector to the water storage.

3. The laundry treating apparatus of claim 2, further comprising a return pipe that extends from the water storage in the interior of the cabinet to the exterior of the cabinet through the rear plate, the return pipe being configured to guide the condensed water from the water storage to the water collector, wherein the return pipe extends along the rear side of the rear plate at the exterior of the cabinet and is inserted from the exterior of the cabinet to the interior of the cabinet through the rear plate, the return pipe being connected to the water collector in the interior of the cabinet.

4. The laundry treating apparatus of claim 3, wherein the drain pipe comprises:

a water collecting drain pipe that extends from the water collector to the exterior of the cabinet through the rear plate;

a drain exposed pipe that extends from the water collecting drain pipe along the duct of the rear plate; and a reservoir drain pipe that extends from the drain exposed pipe and passes through the rear plate, the reservoir drain pipe being connected to the water storage, and wherein the return pipe comprises:

a reservoir return pipe that extends from the water storage to the exterior of the cabinet through the rear plate, a return exposed pipe that extends from the reservoir return pipe along the duct of the rear plate, and a water collecting return pipe that extends from the return exposed pipe and passes through the rear plate, the water collecting return pipe being connected to the water collector.

5. The laundry treating apparatus of claim 4, wherein the water collector is disposed below the drum, and the water storage is disposed above the drum, the reservoir drain pipe being connected to a top of the water storage, and wherein the laundry treating apparatus further comprises:

a drainage comprising the drain pipe and a drain pump, the drain pump being connected to the water collecting drain pipe and configured to flow the condensed water through the drain pipe from the water collector to the water storage;

a washer disposed in the air supply and configured to wash the water vapor remover with the condensed water that has passed through the drain pump;

a washing flow channel that connects the washer and the water collecting drain pipe to each other; and a flow channel switching valve disposed at the water collecting drain pipe and connected to the washing flow channel, the flow channel switching valve being configured to selectively guide, to the washer or the water storage, the condensed water that has passed through the drain pump.

6. The laundry treating apparatus of claim 4, wherein the rear plate defines a water collecting connection hole and a water storage connection hole that are spaced apart from each other, wherein the water collecting drain pipe and the water collecting return pipe pass through the water collecting connection hole, and wherein the reservoir drain pipe and the reservoir return pipe pass through the water storage connection hole.

7. The laundry treating apparatus of claim 6, further comprising a rear cover that is coupled to the rear plate from the rear side of the rear plate and covers the duct of the rear plate.

8. The laundry treating apparatus of claim 7, wherein the rear plate comprises a rear cover coupling portion that protrudes rearward from the rear side of the rear plate and is coupled to the rear cover, and wherein the rear cover coupling portion defines the duct of the rear plate, the water collecting connection hole, and the water storage connection hole.

9. The laundry treating apparatus of claim 8, wherein the water collecting connection hole and the water storage connection hole are defined at positions that are located outward relative to the duct with respect to a rotation axis of the drum, wherein the rear cover extends outward relative to the duct and covers the water collecting connection hole and the water storage connection hole, and wherein the rear plate has a region located outside the rear cover coupling portion and exposed outside the rear cover.

10. The laundry treating apparatus of claim 8, further comprising:

an external discharge pipe disposed at the drain exposed pipe and configured to discharge the water from the drain exposed pipe to an outside of the drain exposed pipe, wherein the rear cover defines a cover-through-portion at a position corresponding to the external discharge pipe, the cover-through-portion being configured to expose the external discharge pipe to the exterior of the cabinet.

11. The laundry treating apparatus of claim 10, wherein the rear cover comprises a rear cover door configured to open and close the cover-through-portion.

12. The laundry treating apparatus of claim 8, wherein the rear cover comprises:

a duct cover that covers the duct of the rear plate; and a coupling portion cover that extends from the duct cover and covers a portion of the rear cover coupling portion located outward relative to the duct with respect to a rotation axis of the drum, and wherein an inner circumferential surface of the coupling portion cover faces an outer circumferential surface of the rear cover coupling portion.

13. The laundry treating apparatus of claim 12, wherein the rear cover coupling portion has a lower portion that is located at a lower portion of the rear plate, the lower portion of the rear cover coupling portion being opened downward and accommodating a portion of the air supply, and wherein a portion of the coupling portion cover is opened downward and coupled to the lower portion of the rear cover coupling portion.

14. The laundry treating apparatus of claim 7, wherein the rear cover covers the drain exposed pipe and the return exposed pipe to thereby hide the drain exposed pipe and the return exposed pipe from the exterior of the cabinet.

15. The laundry treating apparatus of claim 7, wherein the duct protrudes rearward from the rear side of the rear plate and surrounds the driver, and wherein at least a portion of the rear cover has a shape corresponding to the duct and covers the duct and the driver, the rear cover exposing at least a portion of the rear plate to the exterior of the cabinet.

16. The laundry treating apparatus of claim 15, wherein the rear cover further comprises a driver rib that protrudes from an inner surface of the rear cover toward the rear plate and surrounds the driver, the driver being located inward relative to the duct.

17. The laundry treating apparatus of claim 16, wherein the driver rib defines a heat dissipation space that is exposed to the exterior of the cabinet through an open rear surface of the rear cover, and wherein the driver rib is spaced apart from the driver, the driver rib having a front portion that is in contact with the rear plate at a position inward relative to the duct.

18. The laundry treating apparatus of claim 17, wherein the driver rib defines a rib slit at an inner circumferential portion of the driver rib facing the driver, the rib slit passing through the inner circumferential portion of the driver rib and extending along a protruding direction of the driver rib, and wherein the rib slit fluidly communicates an interior of the duct with the heat dissipation space.

19. The laundry treating apparatus of claim 18, wherein the rear cover further comprises a cover accommodating portion that is surrounded by the inner circumferential portion of the driver rib, the cover accommodating portion defining a heat dissipation hole that fluidly communicates the interior of the duct with an exterior of the duct.

20. The laundry treating apparatus of claim 19, wherein the driver comprises a drive rotation shaft connected to the drum through the rear plate, and wherein the cover accommodating portion further defines a cover recessed portion that is recessed rearward from a front surface of the rear cover facing the driver and accommodates at least a portion of the drive rotation shaft.

* * * * *